US011203465B2

(12) United States Patent
Seiders et al.

(10) Patent No.: US 11,203,465 B2
(45) Date of Patent: Dec. 21, 2021

(54) CONTAINER AND LATCHING SYSTEM

(71) Applicant: YETI Coolers, LLC, Austin, TX (US)

(72) Inventors: Roy Joseph Seiders, Austin, TX (US); Steve Charles Nichols, Austin, TX (US); Kyle Ellison, Austin, TX (US); Andy Bondhus, Austin, TX (US); Tobias Hotchkiss, Austin, TX (US); Liza Morris, Austin, TX (US); Dennis Zuck, Austin, TX (US); Ryan Nixon, Austin, TX (US); Mark Carlson Rane, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 268 days.

(21) Appl. No.: 16/006,344

(22) Filed: Jun. 12, 2018

(65) Prior Publication Data

US 2018/0354687 A1 Dec. 13, 2018

Related U.S. Application Data

(60) Provisional application No. 62/518,358, filed on Jun. 12, 2017.

(51) Int. Cl.
*B65D 43/16* (2006.01)
*B65D 25/28* (2006.01)
(Continued)

(52) U.S. Cl.
CPC ..... *B65D 43/165* (2013.01); *B65D 25/2841* (2013.01); *B65D 43/22* (2013.01);
(Continued)

(58) Field of Classification Search
CPC .. B65D 43/165; B65D 25/2841; B65D 43/22; B65D 45/24; E05B 65/5207; E05B 5/00;
(Continued)

(56) References Cited

U.S. PATENT DOCUMENTS 286,909 A 10/1883 Commander
749,959 A 1/1904 Curtiss
(Continued)

FOREIGN PATENT DOCUMENTS

BE 1013040 A3 8/2001
BE 1016429 A3 10/2006
(Continued)

OTHER PUBLICATIONS

Lowe's, "Craftsman 37-in Black Plastic Wheels Lockable Tool Box," https://lowes.com/pd/CRAFTSMAN-37-In-Black-Plastic-Wheeled-Tool-Box/1000578337.
(Continued)

*Primary Examiner* — Anthony D Stashick
*Assistant Examiner* — Blaine G Neway
(74) *Attorney, Agent, or Firm* — Banner & Witcoff, Ltd.

(57) ABSTRACT

A container having a base and a lid is provided. The lid may be rotatable about a hinge from a closed configuration to an open configuration and may be secured, via one or more latching assemblies. The latching assembly may comprise a latch body, a locking member, a biasing member, and an activating member. Additional features of the container may include handles and strength increasing features. The base and lid may also feature attachment points for various accessories.

15 Claims, 42 Drawing Sheets

(51) Int. Cl.
*E05C 5/00* (2006.01)
*B65D 45/24* (2006.01)
*E05B 65/52* (2006.01)
*B65D 43/22* (2006.01)

(52) U.S. Cl.
CPC ..... *B65D 45/24* (2013.01); *E05B 65/5207* (2013.01); *E05C 5/00* (2013.01)

(58) Field of Classification Search
CPC ..... E05B 65/52; E05B 65/5276; E05C 3/12; E05C 19/14
See application file for complete search history.

(56) References Cited

U.S. PATENT DOCUMENTS 1,008,041 A 11/1911 Leonard
1,056,648 A 3/1913 Earley
2,101,337 A 12/1937 Komenak
2,109,928 A 3/1938 Passalaqua
2,439,660 A 4/1948 Keil
2,472,491 A 6/1949 Quinton
2,510,643 A 6/1950 Long
2,565,939 A 8/1951 Wriston
2,574,089 A 11/1951 Cochran
2,577,951 A 12/1951 Cortsen
2,581,417 A 1/1952 Jones
2,604,961 A 7/1952 Koch
2,647,653 A 8/1953 Dube
2,717,093 A 9/1955 Mautner
2,747,732 A 5/1956 Fischer
2,803,956 A 8/1957 Womer
2,869,909 A 1/1959 Harling
2,931,205 A 4/1960 Schmitz
2,936,189 A 5/1960 Pearson
3,057,636 A 10/1962 D'Ettorre
3,141,680 A 7/1964 McCord
3,191,244 A 6/1965 Burke
3,202,310 A 8/1965 Tibbets
3,225,983 A 12/1965 Majka
3,250,558 A 5/1966 McClintock
3,259,412 A 7/1966 Wheeler
3,416,701 A 12/1968 Kramer et al.
3,432,025 A 3/1969 Luhe
3,464,579 A 9/1969 Asenbauer
3,519,298 A * 7/1970 Gley ..... E05C 19/14 292/113
3,565,305 A 2/1971 Belokin, Jr.
3,642,168 A 2/1972 Wiley, Jr. et al.
3,656,650 A 4/1972 Frater
3,661,410 A 5/1972 Larson et al.
3,688,942 A 9/1972 Mitchell et al.
3,690,708 A 9/1972 Worley et al.
3,741,433 A 6/1973 Bentley et al.
3,831,224 A * 8/1974 MacMaster ..... E05C 19/14 24/68 T
3,847,423 A 11/1974 Gley
3,861,504 A 1/1975 McGraw
3,882,914 A 5/1975 Strutz
3,886,625 A 6/1975 Rollband
3,902,628 A 9/1975 Schurman
3,915,362 A 10/1975 Hart
3,917,038 A 11/1975 Foge et al.
3,933,269 A 1/1976 Mastrovito
3,955,656 A 5/1976 Kashinski
3,987,829 A 10/1976 Leone
3,991,921 A 11/1976 Hirsch
4,094,392 A 6/1978 Gregg et al.
4,095,711 A 6/1978 Conley
4,116,479 A 9/1978 Poe
4,143,442 A 3/1979 Harlang
4,153,178 A 5/1979 Weavers
4,184,705 A * 1/1980 Little ..... E05C 19/14 292/247
D256,630 S 9/1980 Maney
D257,218 S 10/1980 Eriksson
4,249,760 A 2/1981 Conley
4,254,850 A 3/1981 Knowles
4,273,223 A 6/1981 Tomlinson
4,343,412 A 8/1982 Wilcox et al.
4,351,165 A 9/1982 Gottsegen et al.
4,446,705 A 5/1984 Loucks
4,465,189 A 8/1984 Molzan
4,476,988 A 10/1984 Tanner
4,509,622 A 4/1985 Morszeck
4,515,421 A 5/1985 Steffes
4,516,686 A 5/1985 Chaussepied
4,522,312 A 6/1985 Rathgeber et al.
4,523,692 A 6/1985 Lemkin
4,550,813 A 11/1985 Browning
4,561,526 A 12/1985 Winter et al.
4,573,202 A 2/1986 Lee
4,575,109 A 3/1986 Cowdery
4,592,482 A 6/1986 Seager
4,615,464 A 10/1986 Byrns
4,662,188 A 5/1987 Hullihan
4,673,207 A 6/1987 Reynolds et al.
D290,908 S 7/1987 Thomas
4,706,344 A 11/1987 Tanaka et al.
4,707,011 A 11/1987 McKim, Jr.
4,712,657 A 12/1987 Myers et al.
4,746,008 A 5/1988 Heverly et al.
4,768,815 A 9/1988 Harmon
4,775,072 A 10/1988 Lundblade et al.
4,792,024 A 12/1988 Morton et al.
4,802,344 A 2/1989 Livingston et al.
4,805,272 A 2/1989 Yamaguchi
4,826,060 A 5/1989 Hollingsworth
4,858,444 A 8/1989 Scott
4,873,841 A 10/1989 Bradshaw et al.
4,899,904 A 2/1990 Dooley et al.
4,904,007 A 2/1990 Woodruff
4,917,261 A 4/1990 Borst
4,928,800 A 5/1990 Green et al.
4,930,649 A 6/1990 Moser
4,975,073 A 12/1990 Weisman
4,982,863 A 1/1991 Skillius
5,011,013 A 4/1991 Meisner et al.
5,011,020 A 4/1991 Stevens et al.
5,014,830 A 5/1991 Seynhaeve
5,024,471 A 6/1991 Kahl et al.
5,040,834 A 8/1991 Kahl et al.
5,044,513 A 9/1991 Van Berne
5,062,557 A 11/1991 Mahvi et al.
5,075,925 A 12/1991 Maloney
5,080,250 A 1/1992 Dickinson et al.
5,096,030 A 3/1992 Espinosa et al.
5,101,541 A 4/1992 Watanabe
5,111,920 A 5/1992 Castelli et al.
D327,427 S 6/1992 McCooey
5,117,952 A 6/1992 Suh
D328,186 S 7/1992 Hanke
5,139,294 A 8/1992 Ward et al.
D329,135 S 9/1992 Embree
5,153,561 A 10/1992 Johnson
5,165,583 A 11/1992 Kouwenberg
5,167,433 A 12/1992 Ryan
5,169,018 A 12/1992 Fiore
D333,775 S 3/1993 Krape
D334,870 S 4/1993 Griffin
D335,030 S 4/1993 Alfonso
5,205,413 A 4/1993 Cautereels et al.
5,213,381 A 5/1993 Anderson
5,216,905 A 6/1993 Sersch et al.
5,235,830 A 8/1993 Benge
D340,167 S 10/1993 Kahl
D342,609 S 12/1993 Brightbill
5,269,157 A 12/1993 Ciminelli et al.
5,282,706 A 2/1994 Anthony et al.
5,295,369 A 3/1994 Garcia
5,313,817 A 5/1994 Meinders
D347,971 S 6/1994 Krugman
5,319,937 A 6/1994 Fritsch et al.
5,322,178 A 6/1994 Foos

(56) References Cited

U.S. PATENT DOCUMENTS

| | | | |
|---|---|---|---|
| 5,335,451 | A | 8/1994 | Druzynski |
| D351,533 | S | 10/1994 | Lynam, Jr. |
| 5,353,946 | A | 10/1994 | Behrend |
| 5,358,082 | A | 10/1994 | Armstrong, IV |
| 5,373,708 | A | 12/1994 | Dumoulin, Jr. |
| D355,568 | S | 2/1995 | Paulin et al. |
| 5,390,811 | A | 2/1995 | Ogino et al. |
| 5,402,557 | A | 4/1995 | Dalen |
| D358,765 | S | 5/1995 | Dickinson et al. |
| 5,419,432 | A | 5/1995 | Ingram |
| 5,423,644 | A | 6/1995 | First, Sr. |
| 5,427,308 | A | 6/1995 | Swift et al. |
| D359,836 | S | 7/1995 | Shuler |
| 5,431,263 | A | 7/1995 | Nordstrom |
| 5,435,256 | A | 7/1995 | Svehaug |
| D361,888 | S | 9/1995 | Kahl et al. |
| 5,454,477 | A | 10/1995 | Bornhorst et al. |
| D364,426 | S | 11/1995 | Bucaccio |
| 5,465,985 | A | 11/1995 | Devan et al. |
| 5,478,097 | A | 12/1995 | Forma |
| D367,360 | S | 2/1996 | Wolff |
| D368,161 | S | 3/1996 | Miller |
| D369,342 | S | 4/1996 | Williams |
| D369,695 | S | 5/1996 | Imotani |
| 5,518,139 | A | 5/1996 | Trower et al. |
| 5,519,919 | A | 5/1996 | Lee |
| D370,619 | S | 6/1996 | Hall et al. |
| D371,051 | S | 6/1996 | Melk |
| D371,052 | S | 6/1996 | Melk |
| 5,524,737 | A | 6/1996 | Wang |
| 5,526,953 | A | 6/1996 | Chieng |
| D371,724 | S | 7/1996 | Melk |
| D371,942 | S | 7/1996 | Lippincott et al. |
| 5,533,231 | A | 7/1996 | Bai |
| D373,514 | S | 9/1996 | Melk |
| D373,515 | S | 9/1996 | Melk |
| 5,564,805 | A | 10/1996 | Dickinson |
| 5,568,848 | A | 10/1996 | Liang |
| 5,570,915 | A | 11/1996 | Asadurian |
| 5,575,362 | A | 11/1996 | Franklin et al. |
| 5,603,545 | A | 2/1997 | Benson et al. |
| 5,620,212 | A | 4/1997 | Bourne et al. |
| 5,620,213 | A | 4/1997 | Ellis |
| 5,626,373 | A | 5/1997 | Chambers et al. |
| 5,630,630 | A | 5/1997 | Price et al. |
| D380,369 | S | 7/1997 | Antonucci |
| D381,512 | S | 7/1997 | Green |
| D381,562 | S | 7/1997 | Westcott |
| D381,871 | S | 8/1997 | Melk |
| D382,114 | S | 8/1997 | Dickinson et al. |
| D383,306 | S | 9/1997 | Pennoyer |
| D383,603 | S | 9/1997 | Pedlar |
| 5,662,223 | A | 9/1997 | Sylegård |
| 5,683,097 | A | 11/1997 | Fenton et al. |
| 5,688,001 | A | 11/1997 | Klein et al. |
| D387,249 | S | 12/1997 | Mogil |
| D387,558 | S | 12/1997 | Mann et al. |
| D387,626 | S | 12/1997 | Melk |
| 5,704,158 | A | 1/1998 | Whiteaker |
| 5,718,350 | A | 2/1998 | Williams |
| D392,510 | S | 3/1998 | Perez |
| 5,727,844 | A | 3/1998 | O'Quinn et al. |
| 5,732,987 | A | 3/1998 | Wright et al. |
| 5,755,311 | A | 5/1998 | Younessian et al. |
| 5,762,242 | A | 6/1998 | Yost |
| 5,762,411 | A | 6/1998 | Yemini |
| 5,769,194 | A | 6/1998 | Chang |
| 5,797,488 | A | 8/1998 | Yemini |
| 5,803,472 | A | 9/1998 | Lien |
| 5,813,503 | A | 9/1998 | Chang |
| 5,816,185 | A | 10/1998 | Ruthrford |
| 5,826,718 | A | 10/1998 | Ahern, Jr. et al. |
| 5,826,770 | A | 10/1998 | Chuang |
| 5,839,553 | A | 11/1998 | Dorsam |
| 5,860,281 | A | 1/1999 | Coffee et al. |
| 5,865,281 | A | 2/1999 | Wang |
| 5,875,948 | A | 3/1999 | Sadler |
| 5,887,745 | A | 3/1999 | Wood |
| 5,896,962 | A | 4/1999 | Smith et al. |
| 5,901,571 | A | 5/1999 | Whaley |
| 5,904,269 | A | 5/1999 | Wolff |
| D410,387 | S | 6/1999 | Jacques |
| 5,924,303 | A | 7/1999 | Hodosh |
| 5,933,929 | A | 8/1999 | Kawakami et al. |
| 5,934,716 | A | 8/1999 | Koveal et al. |
| 5,940,940 | A | 8/1999 | Tanikoshi et al. |
| 5,950,368 | A | 9/1999 | Bradford |
| 5,956,805 | A | 9/1999 | Huang |
| 5,957,321 | A | 9/1999 | Jones |
| D414,673 | S | 10/1999 | Dickinson et al. |
| 5,971,218 | A | 10/1999 | Le |
| 5,975,334 | A | 11/1999 | Mayo |
| 5,984,064 | A | 11/1999 | Byington |
| 5,984,326 | A | 11/1999 | Abraham et al. |
| 5,984,382 | A | 11/1999 | Bourne et al. |
| 5,988,658 | A | 11/1999 | Ritchie et al. |
| 6,015,072 | A | 1/2000 | Young |
| D419,767 | S | 2/2000 | Richardson et al. |
| D419,768 | S | 2/2000 | Richardson et al. |
| D420,221 | S | 2/2000 | Williams et al. |
| 6,047,976 | A | 4/2000 | Wang |
| 6,050,373 | A | 4/2000 | Wonka et al. |
| 6,079,083 | A | 6/2000 | Akashi |
| 6,079,754 | A | 6/2000 | Alexy |
| D427,882 | S | 7/2000 | Wytcherley et al. |
| D428,698 | S | 8/2000 | Cheng |
| 6,105,767 | A | 8/2000 | Vasudeva |
| 6,129,231 | A | 10/2000 | Hsiao et al. |
| 6,135,253 | A | 10/2000 | Weissman et al. |
| 6,152,501 | A | 11/2000 | Magi et al. |
| D435,780 | S | 1/2001 | Tieu |
| 6,167,994 | B1 | 1/2001 | Kuo et al. |
| 6,170,122 | B1 | 1/2001 | Kuo |
| 6,176,499 | B1 | 1/2001 | Conrado et al. |
| 6,176,559 | B1 | 1/2001 | Tiramani et al. |
| 6,179,176 | B1 | 1/2001 | Saggese et al. |
| D441,954 | S | 5/2001 | Parker |
| 6,234,287 | B1 | 5/2001 | Pfeiffer |
| 6,244,064 | B1 | 6/2001 | Powell et al. |
| 6,244,066 | B1 | 6/2001 | LaRose |
| 6,244,458 | B1 | 6/2001 | Frysinger et al. |
| 6,247,203 | B1 | 6/2001 | Kuo |
| 6,247,328 | B1 | 6/2001 | Mogil |
| 6,260,240 | B1 | 7/2001 | Akashi et al. |
| 6,279,971 | B1 | 8/2001 | Dessenberger, Jr. |
| 6,289,554 | B1 | 9/2001 | Wang |
| 6,289,684 | B1 | 9/2001 | Guidry, II et al. |
| D449,163 | S | 10/2001 | Dahlen et al. |
| 6,305,185 | B1 | 10/2001 | Sloan |
| D451,278 | S | 12/2001 | Cooper |
| 6,343,815 | B1 | 2/2002 | Poe |
| D454,292 | S | 3/2002 | Plummer et al. |
| 6,353,978 | B1 | 3/2002 | Kawahara et al. |
| 6,357,080 | B1 | 3/2002 | Tsai |
| 6,360,400 | B1 | 3/2002 | Chang |
| 6,363,739 | B1 | 4/2002 | Hodosh et al. |
| 6,367,602 | B1 | 4/2002 | Chang |
| 6,371,320 | B2 | 4/2002 | Sagol |
| 6,371,346 | B1 | 4/2002 | Sharma |
| 6,375,237 | B1 | 4/2002 | Koenig |
| D457,725 | S | 5/2002 | Parsons |
| 6,389,645 | B1 | 5/2002 | Polidoro |
| 6,398,272 | B1 | 6/2002 | Plummer et al. |
| 6,401,308 | B1 | 6/2002 | Kawahara |
| 6,422,386 | B1 | 7/2002 | Wiese et al. |
| 6,427,475 | B1 | 8/2002 | DeFelice et al. |
| 6,427,501 | B2 | 8/2002 | Ramsauer |
| D462,519 | S | 9/2002 | Gaydos et al. |
| 6,446,382 | B1 | 9/2002 | Cloutier et al. |
| 6,446,988 | B1 | 9/2002 | Kho |
| D464,485 | S | 10/2002 | Sward et al. |
| 6,467,779 | B1 | 10/2002 | Mills |
| 6,478,463 | B2 | 11/2002 | Snider |
| 6,481,239 | B2 | 11/2002 | Hodosh et al. |

(56) References Cited

U.S. PATENT DOCUMENTS

| | | | |
|---|---|---|---|
| D466,439 | S | 12/2002 | Wagner et al. |
| D467,424 | S | 12/2002 | Hardigg et al. |
| D467,425 | S | 12/2002 | Hardigg et al. |
| D467,426 | S | 12/2002 | Hardigg et al. |
| 6,497,311 | B2 | 12/2002 | Tiramani et al. |
| 6,497,438 | B1 | 12/2002 | Holub et al. |
| 6,499,574 | B1 | 12/2002 | Anthony |
| 6,502,677 | B1 | 1/2003 | Tiramani et al. |
| 6,508,389 | B1 | 1/2003 | Ripoyla et al. |
| 6,520,514 | B2 | 2/2003 | Clegg |
| D471,711 | S | 3/2003 | Addison |
| 6,527,309 | B1 | 3/2003 | Gaydos et al. |
| 6,532,624 | B1 | 3/2003 | Yang |
| D472,431 | S | 4/2003 | Spence, Jr. |
| 6,543,096 | B2 | 4/2003 | Settelmayer et al. |
| 6,547,218 | B2 | 4/2003 | Landy |
| 6,547,289 | B1 | 4/2003 | Greenheck et al. |
| 6,550,592 | B1 | 4/2003 | Godshaw et al. |
| 6,554,327 | B1 | 4/2003 | Riley |
| D474,649 | S | 5/2003 | Spence, Jr. |
| 6,574,983 | B2 | 6/2003 | Smith et al. |
| 6,585,090 | B2 | 7/2003 | Harvey |
| D477,916 | S | 8/2003 | Nykoluk |
| D478,782 | S | 8/2003 | Li |
| 6,612,411 | B2 | 9/2003 | Nykoluk et al. |
| 6,619,448 | B1 | 9/2003 | Wang |
| D481,293 | S | 10/2003 | Ayrest |
| 6,637,077 | B2 | 10/2003 | Doty |
| 6,637,562 | B2 | 10/2003 | Oh |
| D482,593 | S | 11/2003 | Wolf |
| 6,640,397 | B1 | 11/2003 | Gipson |
| 6,646,864 | B2 | 11/2003 | Richardson |
| D484,004 | S | 12/2003 | Lee |
| 6,658,903 | B1 | 12/2003 | McShane et al. |
| 6,679,358 | B2 | 1/2004 | Be |
| 6,679,359 | B2 | 1/2004 | Pfeiffer |
| 6,691,451 | B1 | 2/2004 | Keenan |
| D487,348 | S | 3/2004 | Fenton et al. |
| 6,698,608 | B2 | 3/2004 | Parker et al. |
| 6,718,559 | B1 | 4/2004 | Davidson |
| D489,531 | S | 5/2004 | Oh |
| D489,595 | S | 5/2004 | Gleichauf et al. |
| 6,736,265 | B2 | 5/2004 | Kipper et al. |
| D490,980 | S | 6/2004 | Concari |
| D491,797 | S | 6/2004 | Eriksson |
| D492,184 | S | 6/2004 | Parker et al. |
| 6,755,448 | B2 | 6/2004 | Jackson et al. |
| D493,286 | S | 7/2004 | Concari |
| 6,757,942 | B2 | 7/2004 | Matsui et al. |
| 6,761,366 | B1 | 7/2004 | Klemmensen et al. |
| 6,779,681 | B2 | 8/2004 | Doerfler et al. |
| 6,789,692 | B2 | 9/2004 | Prezelin |
| 6,793,096 | B1 | 9/2004 | Seok |
| D497,480 | S | 10/2004 | Drew et al. |
| D498,053 | S | 11/2004 | Nordstrom et al. |
| D498,054 | S | 11/2004 | Moon |
| 6,821,019 | B2 | 11/2004 | Mogil |
| D500,598 | S | 1/2005 | Ramos |
| 6,877,189 | B2 | 4/2005 | Simonson et al. |
| 6,883,208 | B1 | 4/2005 | Huang |
| D505,011 | S | 5/2005 | Einav |
| 6,895,789 | B2 | 5/2005 | Masseth, Jr. et al. |
| D508,376 | S | 8/2005 | Bhavnani |
| 6,929,145 | B2 | 8/2005 | Shepler |
| 6,955,381 | B2 | 10/2005 | Parker et al. |
| 6,981,780 | B2 | 1/2006 | Einav |
| 6,983,946 | B2 | 1/2006 | Sullivan et al. |
| D515,362 | S | 2/2006 | Chan |
| D517,947 | S | 3/2006 | Hollingworth et al. |
| 7,017,740 | B2 | 3/2006 | Itzkovitch |
| 7,028,730 | B2 | 4/2006 | Pace et al. |
| D520,237 | S | 5/2006 | Cheng |
| 7,040,115 | B1 | 5/2006 | Lopez et al. |
| D522,811 | S | 6/2006 | Martinez et al. |
| D523,242 | S | 6/2006 | Hardigg et al. |
| 7,066,311 | B2 | 6/2006 | O'Shea |
| D525,714 | S | 7/2006 | Ueda |
| 7,082,641 | B1 | 8/2006 | Jung et al. |
| 7,093,699 | B2 | 8/2006 | Yu |
| D528,800 | S | 9/2006 | Liu et al. |
| D530,095 | S | 10/2006 | Herzberg |
| 7,162,890 | B2 | 1/2007 | Mogil et al. |
| D537,251 | S | 2/2007 | Musgrove |
| 7,171,731 | B1 | 2/2007 | Borcherding |
| D539,543 | S | 4/2007 | Wu |
| D540,540 | S | 4/2007 | Szyf et al. |
| D540,651 | S | 4/2007 | Wolf |
| D540,652 | S | 4/2007 | Wolf |
| D544,211 | S | 6/2007 | Herzberg |
| 7,237,660 | B2 | 7/2007 | Wu |
| 7,246,704 | B2 | 7/2007 | Brunson et al. |
| 7,246,718 | B2 | 7/2007 | Einav et al. |
| D552,352 | S | 10/2007 | Lin |
| 7,284,393 | B1 | 10/2007 | Macmillan |
| 7,284,763 | B1 | 10/2007 | King |
| D555,902 | S | 11/2007 | Pendergraph et al. |
| 7,296,434 | B2 | 11/2007 | Scroggs |
| 7,306,243 | B2 | 12/2007 | Van Horn et al. |
| 7,309,106 | B2 | 12/2007 | Stallman |
| D562,646 | S | 2/2008 | Lown et al. |
| 7,334,680 | B2 | 2/2008 | Cunningham et al. |
| 7,334,802 | B2 | 2/2008 | Kaplan |
| D563,101 | S | 3/2008 | Kuchler |
| 7,344,028 | B2 | 3/2008 | Hanson |
| D566,479 | S | 4/2008 | Kabalin |
| 7,367,451 | B2 | 5/2008 | Pendergraph et al. |
| 7,370,891 | B1 | 5/2008 | Schmitt et al. |
| D570,601 | S | 6/2008 | Drew et al. |
| D570,603 | S | 6/2008 | Wu et al. |
| 7,387,350 | B2 | 6/2008 | Killinger et al. |
| D572,577 | S | 7/2008 | Hatton |
| 7,397,674 | B2 | 7/2008 | Schlack |
| D574,150 | S | 8/2008 | Ross |
| D574,667 | S | 8/2008 | Grabijas, III et al. |
| D575,059 | S | 8/2008 | Cappiello et al. |
| 7,415,794 | B1 | 8/2008 | Thompson |
| 7,418,311 | B1 | 8/2008 | Lagassey et al. |
| D578,758 | S | 10/2008 | Stevens et al. |
| D579,202 | S | 10/2008 | Grenier et al. |
| 7,434,410 | B2 | 10/2008 | Ford |
| 7,441,641 | B2 | 10/2008 | Beakey |
| D581,161 | S | 11/2008 | Tong |
| D582,678 | S | 12/2008 | Rekuc et al. |
| 7,458,481 | B2 | 12/2008 | Yuen |
| 7,461,871 | B2 | 12/2008 | Vauchel |
| 7,475,782 | B2 | 1/2009 | Lombardi |
| D587,902 | S | 3/2009 | Yoneno |
| 7,503,439 | B2 | 3/2009 | O'Shea et al. |
| D590,694 | S | 4/2009 | Stuckey |
| 7,516,520 | B2 | 4/2009 | Kelaher et al. |
| 7,516,842 | B2 | 4/2009 | Gu |
| D591,511 | S | 5/2009 | Wu |
| 7,530,405 | B2 | 5/2009 | Kollath et al. |
| 7,533,782 | B2 | 5/2009 | Parker et al. |
| 7,540,364 | B2 | 6/2009 | Sanderson |
| 7,549,652 | B2 | 6/2009 | Wu |
| D596,400 | S | 7/2009 | Chu et al. |
| D597,652 | S | 8/2009 | Tang |
| 7,568,739 | B2 | 8/2009 | Lee |
| 7,571,915 | B1 | 8/2009 | Simmons |
| D600,912 | S | 9/2009 | Brunner |
| 7,581,656 | B2 | 9/2009 | Gnepper et al. |
| D602,252 | S | 10/2009 | Ehret |
| 7,604,290 | B1 | 10/2009 | Giordano |
| 7,607,540 | B2 | 10/2009 | Ballard |
| D603,165 | S | 11/2009 | Losiewicz |
| D607,697 | S | 1/2010 | Whitlock et al. |
| D608,159 | S | 1/2010 | Whitlock et al. |
| D608,601 | S | 1/2010 | Whitlock et al. |
| D610,349 | S | 2/2010 | Ehret |
| 7,658,269 | B2 | 2/2010 | Wu |
| 7,669,436 | B2 | 3/2010 | Mogil et al. |
| 7,688,584 | B1 | 3/2010 | Becklin |
| D613,560 | S | 4/2010 | Robichaud et al. |

(56) References Cited

U.S. PATENT DOCUMENTS

| | | | |
|---|---|---|---|
| 7,703,588 | B2 | 4/2010 | Chiang |
| 7,722,204 | B1 | 5/2010 | Sandberg |
| D617,561 | S | 6/2010 | Salerno-Tortora |
| 7,735,261 | B2 | 6/2010 | Sellati |
| D618,966 | S | 7/2010 | Koehler et al. |
| D619,423 | S | 7/2010 | Koehler et al. |
| D619,854 | S | 7/2010 | Koehler et al. |
| D619,855 | S | 7/2010 | Koehler et al. |
| 7,748,232 | B2 | 7/2010 | Kang |
| D624,315 | S | 9/2010 | Amatrudo |
| 7,806,287 | B2 | 10/2010 | Rouns |
| D626,451 | S | 11/2010 | Helwig et al. |
| D627,162 | S | 11/2010 | Weng |
| D627,199 | S | 11/2010 | Pruchnicki |
| 7,841,207 | B2 | 11/2010 | Mogil et al. |
| D629,200 | S | 12/2010 | Turella-Yuan et al. |
| 7,854,321 | B2 | 12/2010 | Twig et al. |
| D630,435 | S | 1/2011 | Brunner |
| 7,861,552 | B1 | 1/2011 | Hughes |
| 7,861,834 | B2 | 1/2011 | Gorga et al. |
| 7,874,047 | B2 | 1/2011 | Breeden |
| 7,874,408 | B2 | 1/2011 | Suppancig |
| D633,300 | S | 3/2011 | Fair |
| D634,545 | S | 3/2011 | Fair |
| 7,909,148 | B1 | 3/2011 | Miller et al. |
| D635,366 | S | 4/2011 | Luburic |
| D636,292 | S | 4/2011 | Brown |
| 7,922,052 | B2 | 4/2011 | Podschus |
| D637,811 | S | 5/2011 | Hong |
| 7,937,884 | B1 | 5/2011 | Naylor et al. |
| 7,959,194 | B2 | 6/2011 | Mahoney |
| D642,379 | S | 8/2011 | Buller |
| D643,624 | S | 8/2011 | Hong |
| 7,997,591 | B2 | 8/2011 | Arthur |
| D644,434 | S | 9/2011 | Miles et al. |
| 8,016,153 | B2 | 9/2011 | Boenig et al. |
| D646,528 | S | 10/2011 | Stallman et al. |
| 8,037,983 | B2 | 10/2011 | Leung |
| D648,538 | S | 11/2011 | Reinhart et al. |
| D650,585 | S | 12/2011 | Jamison et al. |
| 8,091,731 | B2 | 1/2012 | Kidd et al. |
| 8,096,152 | B2 | 1/2012 | Wagh et al. |
| 8,096,442 | B2 | 1/2012 | Ramundi |
| 8,099,836 | B2 | 1/2012 | Breeden et al. |
| D654,694 | S | 2/2012 | Wu |
| 8,141,211 | B2 | 3/2012 | Weyer et al. |
| D659,395 | S | 5/2012 | Sijmons |
| D660,000 | S | 5/2012 | Peterson et al. |
| 8,167,166 | B2 | 5/2012 | Kidd et al. |
| 8,176,749 | B2 | 5/2012 | LaMere et al. |
| 8,191,747 | B2 | 6/2012 | Pruchnicki |
| 8,210,353 | B2 | 7/2012 | Epicureo |
| 8,214,972 | B2 | 7/2012 | Lai |
| D664,891 | S | 8/2012 | Takeda |
| D665,166 | S | 8/2012 | Khalifa et al. |
| D666,002 | S | 8/2012 | Lai |
| 8,245,868 | B2 | 8/2012 | Ikeda et al. |
| 8,251,113 | B2 | 8/2012 | Baxter |
| 8,251,245 | B2 | 8/2012 | DiPietro et al. |
| D666,831 | S | 9/2012 | Kinskey et al. |
| D666,832 | S | 9/2012 | Kinskey et al. |
| D667,697 | S | 9/2012 | Shah |
| 8,256,156 | B1 | 9/2012 | Burgoyne, Jr. |
| D668,049 | S | 10/2012 | Buller |
| 8,286,828 | B2 | 10/2012 | Schafer |
| 8,287,009 | B2 | 10/2012 | Dane et al. |
| 8,292,119 | B2 | 10/2012 | Kenneally |
| 8,297,464 | B2 | 10/2012 | Grenier et al. |
| D670,502 | S | 11/2012 | Wu |
| 8,328,247 | B2 | 12/2012 | Tonelli |
| 8,336,708 | B2 | 12/2012 | Potterfield et al. |
| D674,192 | S | 1/2013 | Li |
| 8,342,580 | B2 | 1/2013 | Cowie et al. |
| 8,378,323 | B1 | 2/2013 | Spann et al. |
| 8,382,171 | B2 | 2/2013 | Williams |
| D677,896 | S | 3/2013 | Wu |
| D678,749 | S | 3/2013 | Tung |
| D678,750 | S | 3/2013 | Tung |
| 8,424,930 | B2 | 4/2013 | Matsubara et al. |
| 8,430,284 | B2 | 4/2013 | Broadbent et al. |
| D681,337 | S | 5/2013 | Wu |
| 8,459,058 | B2 | 6/2013 | Mogil |
| 8,459,422 | B1 | 6/2013 | Efron |
| 8,459,487 | B2 | 6/2013 | Sharma et al. |
| 8,459,495 | B2 | 6/2013 | Koenig et al. |
| D685,186 | S | 7/2013 | Massaud |
| 8,474,098 | B1 | 7/2013 | Yang |
| 8,484,813 | B2 | 7/2013 | Taniguchi et al. |
| 8,490,413 | B2 | 7/2013 | Blackway et al. |
| 8,496,133 | B2 | 7/2013 | Mizukoshi et al. |
| D688,589 | S | 8/2013 | Hung et al. |
| 8,505,729 | B2 | 8/2013 | Sosnovsky et al. |
| 8,517,211 | B2 | 8/2013 | Brown et al. |
| D688,920 | S | 9/2013 | Manley et al. |
| D691,808 | S | 10/2013 | Wu |
| 8,544,648 | B2 | 10/2013 | Cleveland et al. |
| 8,561,264 | B2 | 10/2013 | Hasegawa et al. |
| 8,561,269 | B2 | 10/2013 | LeCompte et al. |
| 8,567,631 | B2 | 10/2013 | Brunner |
| 8,567,796 | B2 | 10/2013 | Bar-Erez et al. |
| 8,572,821 | B2 | 11/2013 | Hasegawa |
| 8,573,399 | B2 | 11/2013 | Ulmer et al. |
| 8,590,704 | B2 | 11/2013 | Koenig et al. |
| 8,590,724 | B2 | 11/2013 | Kreidler et al. |
| 8,596,485 | B2 | 12/2013 | Lindsay |
| 8,596,487 | B1 | 12/2013 | Su |
| 8,601,838 | B2 | 12/2013 | Hansen et al. |
| 8,616,600 | B2 | 12/2013 | Owen |
| D697,717 | S | 1/2014 | Santy |
| 8,622,235 | B2 | 1/2014 | Suchecki |
| 8,627,972 | B2 | 1/2014 | Thomas |
| D699,100 | S | 2/2014 | Moreau et al. |
| D699,438 | S | 2/2014 | Mathieu et al. |
| 8,640,937 | B2 | 2/2014 | Pruchnicki |
| 8,677,661 | B2 | 3/2014 | Michels et al. |
| 8,678,227 | B2 | 3/2014 | Patstone |
| D701,697 | S | 4/2014 | Sabbag et al. |
| D703,435 | S | 4/2014 | Wile et al. |
| 8,683,660 | B2 | 4/2014 | Hasegawa et al. |
| 8,689,396 | B2 | 4/2014 | Wolfe et al. |
| 8,714,568 | B2 | 5/2014 | Allam et al. |
| 8,740,010 | B1 | 6/2014 | Page |
| 8,757,642 | B2 | 6/2014 | Arthur et al. |
| 8,757,643 | B2 | 6/2014 | Arthur et al. |
| 8,757,696 | B2 | 6/2014 | Schneider |
| D709,336 | S | 7/2014 | Liebenthal |
| D709,696 | S | 7/2014 | Wu |
| 8,763,848 | B2 | 7/2014 | Carey |
| 8,763,851 | B2 | 7/2014 | Jiang et al. |
| 8,770,426 | B2 | 7/2014 | Arnett et al. |
| 8,777,045 | B2 | 7/2014 | Mitchell et al. |
| D710,099 | S | 8/2014 | Horovitz et al. |
| D710,610 | S | 8/2014 | Sijmons et al. |
| D710,614 | S | 8/2014 | Meersschaert |
| D711,104 | S | 8/2014 | Lai |
| D711,646 | S | 8/2014 | Ke |
| D711,647 | S | 8/2014 | Chen |
| D711,648 | S | 8/2014 | Chen |
| D711,649 | S | 8/2014 | Chen |
| D712,143 | S | 9/2014 | Chehebar |
| D714,056 | S | 9/2014 | Weng |
| D714,057 | S | 9/2014 | Hou |
| D714,064 | S | 9/2014 | Kim |
| 8,844,749 | B2 | 9/2014 | Manahan et al. |
| 8,844,950 | B2 | 9/2014 | Greene et al. |
| 8,850,666 | B2 | 10/2014 | Hasegawa et al. |
| 8,851,282 | B2 | 10/2014 | Brunner |
| 8,851,289 | B2 | 10/2014 | Shi |
| 8,857,654 | B2 | 10/2014 | Mogil et al. |
| 8,863,975 | B2 | 10/2014 | McCanless |
| 8,864,185 | B2 | 10/2014 | Do |
| 8,864,189 | B2 | 10/2014 | Fournie et al. |
| D717,152 | S | 11/2014 | Weinerman et al. |
| D718,051 | S | 11/2014 | Frahm et al. |

(56) References Cited

U.S. PATENT DOCUMENTS

| | | | |
|---|---|---|---|
| 8,875,877 | B2 | 11/2014 | Cottle et al. |
| 8,875,888 | B2 | 11/2014 | Koenig et al. |
| 8,875,934 | B2 | 11/2014 | Deka |
| 8,881,930 | B2 | 11/2014 | Banik |
| 8,887,515 | B2 | 11/2014 | Patstone |
| D718,936 | S | 12/2014 | Sanz et al. |
| D719,351 | S | 12/2014 | Hailwood |
| 8,905,412 | B2 | 12/2014 | Fux |
| 8,910,788 | B2 | 12/2014 | Roach et al. |
| 8,910,819 | B2 | 12/2014 | Seiders |
| 8,919,596 | B2 | 12/2014 | Carino |
| D720,536 | S | 1/2015 | Hsu |
| D720,599 | S | 1/2015 | Weinerman et al. |
| D720,928 | S | 1/2015 | Roncato |
| 8,925,752 | B2 | 1/2015 | Smith |
| D722,771 | S | 2/2015 | Wu |
| D722,860 | S | 2/2015 | Linares |
| 8,944,476 | B1 | 2/2015 | Henderson |
| 8,960,430 | B2 | 2/2015 | Roach et al. |
| 8,960,735 | B2 | 2/2015 | Michael et al. |
| D724,323 | S | 3/2015 | Wang |
| 8,979,100 | B2 | 3/2015 | Bensman et al. |
| 8,979,101 | B2 | 3/2015 | Primiano |
| 8,979,144 | B2 | 3/2015 | Paugh et al. |
| 8,985,326 | B2 | 3/2015 | Halsne et al. |
| 8,985,385 | B2 | 3/2015 | Parker et al. |
| D725,907 | S | 4/2015 | Yu |
| D727,620 | S | 4/2015 | Tonelli |
| 9,004,274 | B2 | 4/2015 | Thornberg |
| 9,004,548 | B2 | 4/2015 | Joret et al. |
| D728,933 | S | 5/2015 | Sanz et al. |
| D730,050 | S | 5/2015 | Hogan et al. |
| 9,027,751 | B2 | 5/2015 | Lee |
| D730,716 | S | 6/2015 | Weinerman et al. |
| D731,250 | S | 6/2015 | Butler et al. |
| D732,348 | S | 6/2015 | Seiders et al. |
| D732,349 | S | 6/2015 | Seiders et al. |
| D732,350 | S | 6/2015 | Seiders et al. |
| D732,823 | S | 6/2015 | Baron |
| D732,899 | S | 6/2015 | Seiders et al. |
| D732,923 | S | 6/2015 | Rechberg et al. |
| 9,045,264 | B2 | 6/2015 | Pils |
| 9,060,577 | B2 | 6/2015 | Farrelly et al. |
| 9,067,081 | B2 | 6/2015 | Roach et al. |
| D734,742 | S | 7/2015 | Fujioka |
| 9,079,595 | B2 | 7/2015 | Chen et al. |
| 9,085,403 | B2 | 7/2015 | Roach et al. |
| 9,101,186 | B2 | 8/2015 | Lai |
| 9,108,772 | B2 | 8/2015 | Hovatter |
| 9,113,686 | B1 | 8/2015 | Bishop |
| 9,114,909 | B2 | 8/2015 | Wagner |
| D738,702 | S | 9/2015 | Linares |
| 9,139,352 | B2 | 9/2015 | Seiders et al. |
| D740,557 | S | 10/2015 | Liao |
| D740,558 | S | 10/2015 | Liao |
| D741,064 | S | 10/2015 | Ramos |
| 9,163,871 | B1 | 10/2015 | Costello |
| 9,169,678 | B2 | 10/2015 | Rozema |
| D743,171 | S | 11/2015 | Reinhart |
| 9,187,210 | B2 | 11/2015 | Zhu et al. |
| 9,193,060 | B2 | 11/2015 | Ben-Gigi |
| D744,750 | S | 12/2015 | Sabbag et al. |
| 9,198,492 | B2 | 12/2015 | Chehebar |
| 9,199,370 | B2 | 12/2015 | Crull |
| 9,199,657 | B2 | 12/2015 | Martin |
| 9,204,699 | B2 | 12/2015 | Pickens et al. |
| 9,205,551 | B2 | 12/2015 | Green et al. |
| 9,211,040 | B2 | 12/2015 | Lane |
| 9,215,918 | B2 | 12/2015 | Kao et al. |
| D747,639 | S | 1/2016 | Linares |
| D747,950 | S | 1/2016 | Jacobsen et al. |
| D747,951 | S | 1/2016 | Jacobsen et al. |
| 9,233,465 | B2 | 1/2016 | Lai |
| D748,452 | S | 2/2016 | Jacobsen et al. |
| 9,248,566 | B2 | 2/2016 | Horiyama et al. |
| 9,254,901 | B2 | 2/2016 | Gill |
| 9,259,090 | B1 | 2/2016 | Cronin |
| 9,259,593 | B2 | 2/2016 | Roach et al. |
| 9,259,828 | B2 | 2/2016 | Bermes |
| 9,266,462 | B2 | 2/2016 | Miller |
| D750,953 | S | 3/2016 | Jacobsen et al. |
| D752,344 | S | 3/2016 | Green |
| 9,272,820 | B2 | 3/2016 | Cowie |
| 9,278,704 | B2 | 3/2016 | Cates |
| 9,290,297 | B2 | 3/2016 | Overath |
| D752,862 | S | 4/2016 | Riddiford et al. |
| 9,307,840 | B2 | 4/2016 | Restrepo et al. |
| 9,322,192 | B2 | 4/2016 | Burd |
| D755,518 | S | 5/2016 | Sijmons |
| 9,327,887 | B2 | 5/2016 | Farentinos et al. |
| 9,340,224 | B2 | 5/2016 | Yoder et al. |
| 9,341,003 | B2 | 5/2016 | Ely et al. |
| 9,341,403 | B2 | 5/2016 | Conrad et al. |
| 9,346,616 | B2 | 5/2016 | Foster |
| 9,351,550 | B2 | 5/2016 | Arthur et al. |
| D759,971 | S | 6/2016 | Riddiford et al. |
| 9,359,798 | B2 | 6/2016 | Greenwood et al. |
| 9,376,050 | B1 | 6/2016 | Gill |
| 9,387,963 | B2 | 7/2016 | McBroom et al. |
| 9,393,684 | B2 | 7/2016 | Christopher et al. |
| D762,471 | S | 8/2016 | Green et al. |
| D762,977 | S | 8/2016 | Xu |
| 9,408,449 | B1 | 8/2016 | Tsai |
| 9,415,787 | B2 | 8/2016 | Mericle |
| 9,427,058 | B2 | 8/2016 | Boglione |
| D765,397 | S | 9/2016 | Reinhart |
| D765,406 | S | 9/2016 | Faibish |
| D765,407 | S | 9/2016 | Reinhart |
| D765,408 | S | 9/2016 | Reinhart |
| D765,409 | S | 9/2016 | Reinhart |
| D765,410 | S | 9/2016 | Reinhart |
| D765,411 | S | 9/2016 | Reinhart |
| D765,973 | S | 9/2016 | Tonelli et al. |
| D767,277 | S | 9/2016 | Faibish |
| 9,435,578 | B2 | 9/2016 | Calderon et al. |
| 9,443,366 | B2 | 9/2016 | Rayner |
| D768,464 | S | 10/2016 | Hatton |
| 9,468,277 | B2 | 10/2016 | King |
| D770,179 | S | 11/2016 | Menirom |
| D771,381 | S | 11/2016 | Sosnovsky et al. |
| D772,577 | S | 11/2016 | Muchin et al. |
| D773,821 | S | 12/2016 | Reinhart |
| D773,901 | S | 12/2016 | Marret |
| 9,511,491 | B2 | 12/2016 | Brunner |
| D776,429 | S | 1/2017 | Zagorski et al. |
| D776,932 | S | 1/2017 | Reinhart |
| D776,934 | S | 1/2017 | Braendle |
| D777,441 | S | 1/2017 | Li |
| D777,530 | S | 1/2017 | Marret |
| D778,054 | S | 2/2017 | Li |
| D778,707 | S | 2/2017 | Tonelli |
| D779,201 | S | 2/2017 | Beilman et al. |
| 9,566,704 | B1 | 2/2017 | Stoikos et al. |
| 9,567,784 | B2 | 2/2017 | Defrance et al. |
| D780,523 | S | 3/2017 | Jacobsen |
| D780,524 | S | 3/2017 | Jacobsen |
| D780,525 | S | 3/2017 | Jacobsen |
| D784,017 | S | 4/2017 | Hsieh |
| 9,622,547 | B2 | 4/2017 | Seader |
| D785,937 | S | 5/2017 | Morszeck |
| D786,561 | S | 5/2017 | Seiders et al. |
| 9,637,294 | B2 | 5/2017 | Kinskey |
| 9,655,418 | B2 | 5/2017 | Chien et al. |
| D788,460 | S | 6/2017 | Morszeck |
| 9,669,986 | B1 | 6/2017 | Evans |
| D792,094 | S | 7/2017 | Stoikos et al. |
| D792,105 | S | 7/2017 | Reinhart |
| D793,089 | S | 8/2017 | Jackson |
| D796,199 | S | 9/2017 | Law |
| D796,838 | S | 9/2017 | Sijmons et al. |
| D797,518 | S | 9/2017 | Pavia, III |
| 9,809,376 | B2 | 11/2017 | Mitchell et al. |
| D804,819 | S | 12/2017 | Faibish et al. |
| D805,772 | S | 12/2017 | Oshima |

(56) References Cited

U.S. PATENT DOCUMENTS

| | | | |
|---|---|---|---|
| D805,851 | S | 12/2017 | Sullivan et al. |
| 9,839,272 | B2 | 12/2017 | Licciardino |
| 9,848,681 | B1 | 12/2017 | Chen |
| 9,849,901 | B2 | 12/2017 | Jackman |
| D806,483 | S | 1/2018 | Stanford et al. |
| D807,123 | S | 1/2018 | Carey et al. |
| D807,124 | S | 1/2018 | Carey et al. |
| D808,164 | S | 1/2018 | Summers |
| D808,653 | S | 1/2018 | Rayeski et al. |
| D808,655 | S | 1/2018 | Seiders et al. |
| D808,730 | S | 1/2018 | Sullivan et al. |
| 9,878,841 | B2 | 1/2018 | Holderness et al. |
| D809,293 | S | 2/2018 | Virassamy et al. |
| D809,295 | S | 2/2018 | Ehret |
| D810,432 | S | 2/2018 | Ballou et al. |
| D810,433 | S | 2/2018 | Ballou et al. |
| D811,084 | S | 2/2018 | Ballou et al. |
| D811,090 | S | 2/2018 | Karl |
| 9,883,724 | B2 | 2/2018 | Woode |
| 9,894,971 | B2 | 2/2018 | Scicluna et al. |
| 9,901,153 | B2 | 2/2018 | Nash |
| D811,742 | S | 3/2018 | Ballou et al. |
| D811,744 | S | 3/2018 | Ballou et al. |
| D812,909 | S | 3/2018 | Morszeck |
| 9,913,518 | B2 | 3/2018 | Su |
| D814,187 | S | 4/2018 | Caglar |
| D815,831 | S | 4/2018 | Tonelli |
| D815,919 | S | 4/2018 | DeFrancia |
| D816,337 | S | 5/2018 | Cheng |
| D816,492 | S | 5/2018 | Reinhart |
| D817,722 | S | 5/2018 | Bradley |
| D818,712 | S | 5/2018 | Fleming et al. |
| 9,968,170 | B2 | 5/2018 | Morszeck |
| D819,331 | S | 6/2018 | Ballou et al. |
| D820,049 | S | 6/2018 | Ahlstrom et al. |
| 9,999,284 | B1 | 6/2018 | Tan |
| D821,824 | S | 7/2018 | Rane et al. |
| D821,825 | S | 7/2018 | Sullivan et al. |
| D824,168 | S | 7/2018 | Morszeck |
| D824,731 | S | 8/2018 | Sullivan et al. |
| 10,058,151 | B2 | 8/2018 | Morszeck |
| D827,304 | S | 9/2018 | Tao |
| D828,028 | S | 9/2018 | Seiders et al. |
| D828,029 | S | 9/2018 | Seiders et al. |
| D828,108 | S | 9/2018 | Bowling |
| D828,112 | S | 9/2018 | Furneaux et al. |
| D829,244 | S | 9/2018 | Sullivan et al. |
| 10,080,412 | B2 | 9/2018 | Hartmann et al. |
| D830,132 | S | 10/2018 | Sullivan et al. |
| D830,133 | S | 10/2018 | Sullivan et al. |
| D830,134 | S | 10/2018 | Sullivan et al. |
| 10,086,745 | B2 | 10/2018 | Gill |
| 10,088,144 | B1 | 10/2018 | Sandberg |
| D832,653 | S | 11/2018 | Waskow et al. |
| 10,124,742 | B2 | 11/2018 | Martinez et al. |
| 10,138,048 | B2 | 11/2018 | Mitchell et al. |
| D834,819 | S | 12/2018 | Burek et al. |
| D835,470 | S | 12/2018 | Seiders et al. |
| D835,472 | S | 12/2018 | Seiders et al. |
| D835,473 | S | 12/2018 | Jacobsen |
| D835,946 | S | 12/2018 | Seiders et al. |
| 10,143,282 | B2 | 12/2018 | Seiders et al. |
| 10,159,312 | B2 | 12/2018 | Ito |
| 10,160,471 | B2 | 12/2018 | Yahav et al. |
| D836,993 | S | 1/2019 | Meda et al. |
| D836,996 | S | 1/2019 | Jacobsen |
| D836,997 | S | 1/2019 | Jacobsen |
| D836,998 | S | 1/2019 | Jacobsen |
| D836,999 | S | 1/2019 | Jacobsen |
| D837,001 | S | 1/2019 | Jacobsen |
| D837,515 | S | 1/2019 | Shpitzer |
| D837,611 | S | 1/2019 | Lane et al. |
| D838,208 | S | 1/2019 | Hirabayashi et al. |
| D839,094 | S | 1/2019 | Giraud et al. |
| D839,682 | S | 2/2019 | Jacobsen |
| D840,150 | S | 2/2019 | Seiders et al. |
| D840,194 | S | 2/2019 | Furneaux et al. |
| D842,048 | S | 3/2019 | Wells |
| D844,325 | S | 4/2019 | Nelson |
| 10,272,934 | B2 | 4/2019 | DeFrancia |
| D848,219 | S | 5/2019 | Munie et al. |
| D848,220 | S | 5/2019 | Munie et al. |
| D848,221 | S | 5/2019 | Munie et al. |
| D848,222 | S | 5/2019 | Munie et al. |
| D848,223 | S | 5/2019 | Munie et al. |
| D848,744 | S | 5/2019 | Axelbaum |
| D848,798 | S | 5/2019 | Munie et al. |
| D849,486 | S | 5/2019 | Munie et al. |
| 10,292,473 | B2 | 5/2019 | Meersschaert |
| D850,796 | S | 6/2019 | Ricca |
| D851,401 | S | 6/2019 | Zhang |
| 10,314,377 | B2 | 6/2019 | Stephens |
| D853,729 | S | 7/2019 | Axelbaum |
| D854,826 | S | 7/2019 | Tonelli |
| 10,334,935 | B2 | 7/2019 | Chung |
| 10,350,746 | B2 | 7/2019 | Martinez et al. |
| 10,351,330 | B2 | 7/2019 | Smith et al. |
| 10,357,874 | B2 | 7/2019 | Engvall et al. |
| D857,386 | S | 8/2019 | Shpitzer |
| 10,376,031 | B1 | 8/2019 | Majhess |
| 10,378,569 | B2 | 8/2019 | Jensen et al. |
| D859,842 | S | 9/2019 | Frank |
| D860,789 | S | 9/2019 | Rayeski et al. |
| 10,399,748 | B2 | 9/2019 | Reinhart |
| 10,401,075 | B2 | 9/2019 | Bond |
| D861,535 | S | 10/2019 | Venables |
| 10,443,918 | B2 | 10/2019 | Li et al. |
| D869,160 | S | 12/2019 | Seiders et al. |
| D869,244 | S | 12/2019 | Ellison et al. |
| D869,848 | S | 12/2019 | Wu |
| D872,478 | S | 1/2020 | Seiders et al. |
| D872,485 | S | 1/2020 | Seiders et al. |
| D873,020 | S | 1/2020 | Seiders et al. |
| 10,568,395 | B2 | 2/2020 | Hayashi |
| 10,568,400 | B2 | 2/2020 | Shechter et al. |
| D876,833 | S | 3/2020 | Brunner et al. |
| D878,054 | S | 3/2020 | Reinhart et al. |
| 10,595,608 | B2 | 3/2020 | Korey et al. |
| 2002/0024189 | A1 | 2/2002 | Chen |
| 2002/0038745 | A1 | 4/2002 | Lamming |
| 2002/0074332 | A1 | 6/2002 | Sagol |
| 2002/0162841 | A1 | 11/2002 | Shamir et al. |
| 2002/0185871 | A1 | 12/2002 | Straka |
| 2002/0195827 | A1 | 12/2002 | Jackson et al. |
| 2003/0019705 | A1 | 1/2003 | Lau |
| 2003/0038007 | A1 | 2/2003 | Han |
| 2003/0038142 | A1 | 2/2003 | Gee |
| 2003/0106821 | A1 | 6/2003 | Bar-Erez |
| 2003/0111476 | A1 | 6/2003 | Serio |
| 2003/0136702 | A1 | 7/2003 | Redzisz et al. |
| 2004/0007604 | A1 | 1/2004 | Plzak |
| 2004/0016854 | A1 | 1/2004 | Hart |
| 2004/0025306 | A1 | 2/2004 | Coffey |
| 2004/0040967 | A1 | 3/2004 | Eiskant et al. |
| 2004/0163910 | A1 | 8/2004 | Lee |
| 2004/0178208 | A1 | 9/2004 | Leba et al. |
| 2004/0238543 | A1 | 12/2004 | Askew |
| 2004/0246695 | A1 | 12/2004 | Schlack |
| 2004/0262319 | A1 | 12/2004 | Fisher |
| 2005/0023096 | A1 | 2/2005 | Tiramani |
| 2005/0099019 | A1 | 5/2005 | Hall et al. |
| 2005/0103813 | A1 | 5/2005 | Edwards |
| 2005/0139741 | A1 | 6/2005 | Yuen |
| 2005/0150892 | A1 | 7/2005 | Miller |
| 2005/0180835 | A1 | 8/2005 | Schneider |
| 2005/0199628 | A1 | 9/2005 | Van Handel et al. |
| 2005/0217071 | A1 | 10/2005 | Shinner |
| 2005/0258610 | A1 | 11/2005 | Stone et al. |
| 2005/0279123 | A1 | 12/2005 | Maldonado et al. |
| 2006/0011641 | A1 | 1/2006 | Sanderson |
| 2006/0017293 | A1 | 1/2006 | Tonelli |
| 2006/0037178 | A1 | 2/2006 | Sulhoff |
| 2006/0037824 | A1 | 2/2006 | Park et al. |
| 2006/0042897 | A1 | 3/2006 | Sanderson |

(56) References Cited

U.S. PATENT DOCUMENTS

| | | | |
|---|---|---|---|
| 2006/0049640 | A1 | 3/2006 | Lee |
| 2006/0180422 | A1 | 8/2006 | Lin |
| 2006/0196218 | A1 | 9/2006 | Mogil et al. |
| 2006/0213736 | A1 | 9/2006 | Godshaw |
| 2006/0213941 | A1 | 9/2006 | Sweeney |
| 2006/0225981 | A1 | 10/2006 | Lin |
| 2006/0249412 | A1 | 11/2006 | Hernandez et al. |
| 2006/0249522 | A1 | 11/2006 | Ringo |
| 2006/0276768 | A1 | 12/2006 | Miller et al. |
| 2007/0039957 | A1 | 2/2007 | Shulz et al. |
| 2007/0101754 | A1 | 5/2007 | Maldonado |
| 2007/0175898 | A1 | 8/2007 | Craft et al. |
| 2007/0235452 | A1 | 10/2007 | Killinger et al. |
| 2007/0261977 | A1 | 11/2007 | Sakai |
| 2008/0001373 | A1 | 1/2008 | Vaughn |
| 2008/0029528 | A1 | 2/2008 | Mireault |
| 2008/0042460 | A1 | 2/2008 | Fuchs |
| 2008/0067095 | A1 | 3/2008 | Mueller |
| 2008/0067206 | A1 | 3/2008 | Kuhn |
| 2008/0078637 | A1 | 4/2008 | Su |
| 2008/0078682 | A1 | 4/2008 | Clark et al. |
| 2008/0110892 | A1 | 5/2008 | House |
| 2008/0116215 | A1 | 5/2008 | Chuang |
| 2008/0128428 | A1 | 6/2008 | Beckerman |
| 2008/0156858 | A1 | 7/2008 | Perry et al. |
| 2008/0170388 | A1 | 7/2008 | Greil |
| 2008/0190940 | A1 | 8/2008 | Scott |
| 2008/0196650 | A1 | 8/2008 | Fernung |
| 2008/0230339 | A1 | 9/2008 | Pereira |
| 2008/0245095 | A1 | 10/2008 | Schlipman et al. |
| 2008/0257775 | A1 | 10/2008 | Randolph |
| 2008/0264946 | A1 | 10/2008 | Moschella et al. |
| 2009/0009039 | A1 | 1/2009 | Mayes, Jr. |
| 2009/0014974 | A1 | 1/2009 | VanVorst et al. |
| 2009/0049859 | A1 | 2/2009 | Moon |
| 2009/0078593 | A1 | 3/2009 | Patstone |
| 2009/0080809 | A1 | 3/2009 | Pham et al. |
| 2009/0101460 | A1 | 4/2009 | Justham et al. |
| 2009/0114646 | A1 | 5/2009 | Whalen |
| 2009/0114653 | A1 | 5/2009 | Schenker |
| 2009/0120126 | A1 | 5/2009 | Mew |
| 2009/0158770 | A1 | 6/2009 | Cohrs et al. |
| 2009/0173744 | A1 | 7/2009 | Hassell |
| 2009/0194541 | A1 | 8/2009 | Mayo |
| 2009/0277905 | A1 | 11/2009 | Gillan |
| 2010/0072215 | A1 | 3/2010 | Coon |
| 2010/0078451 | A1 | 4/2010 | Mount |
| 2010/0108556 | A1 | 5/2010 | Claffy |
| 2010/0133132 | A1 | 6/2010 | Allan |
| 2010/0200784 | A1 | 8/2010 | Turner |
| 2010/0258576 | A1 | 10/2010 | Marquez |
| 2010/0275642 | A1 | 11/2010 | Klettner |
| 2011/0016911 | A1 | 1/2011 | Mosby |
| 2011/0064332 | A1 | 3/2011 | Piazza et al. |
| 2011/0114526 | A1 | 5/2011 | Neumann et al. |
| 2011/0119986 | A1 | 5/2011 | Sellers |
| 2011/0121002 | A1 | 5/2011 | Stiller |
| 2011/0127264 | A1 | 6/2011 | Whalen |
| 2011/0132046 | A1 | 6/2011 | Tonelli |
| 2011/0181008 | A1 | 7/2011 | Bensman et al. |
| 2011/0182532 | A1 | 7/2011 | Baltus |
| 2011/0186396 | A1 | 8/2011 | Sheikh |
| 2011/0186398 | A1 | 8/2011 | Sheikh |
| 2011/0197625 | A1 | 8/2011 | Urban et al. |
| 2011/0203328 | A1 | 8/2011 | Vilkomirski et al. |
| 2011/0220531 | A1 | 9/2011 | Meether et al. |
| 2011/0226003 | A1 | 9/2011 | Chaney et al. |
| 2011/0226785 | A1 | 9/2011 | Sakell |
| 2012/0024896 | A1 | 2/2012 | Scobey et al. |
| 2012/0104012 | A1 | 5/2012 | Cowie et al. |
| 2012/0168444 | A1 | 7/2012 | Shitrit et al. |
| 2012/0193353 | A1 | 8/2012 | Cronin et al. |
| 2012/0267208 | A1 | 10/2012 | D'Angelo |
| 2012/0273506 | A1 | 11/2012 | Adams et al. |
| 2012/0286489 | A1 | 11/2012 | Bartholomew |
| 2012/0312708 | A1 | 12/2012 | Roehm et al. |
| 2013/0068579 | A1 | 3/2013 | Mathieu et al. |
| 2013/0140120 | A1 | 6/2013 | Rasmussen |
| 2013/0168196 | A1 | 7/2013 | Stanley |
| 2013/0175130 | A1 | 7/2013 | Liang |
| 2013/0175276 | A1 | 7/2013 | Gleichauf et al. |
| 2013/0248390 | A1 | 9/2013 | Roehm et al. |
| 2013/0284619 | A1 | 10/2013 | Daley |
| 2013/0292220 | A1 | 11/2013 | Kerley |
| 2013/0292221 | A1 | 11/2013 | Ryan et al. |
| 2013/0307214 | A1 | 11/2013 | Groller et al. |
| 2014/0027454 | A1 | 1/2014 | Banik |
| 2014/0062042 | A1 | 3/2014 | Wagner et al. |
| 2014/0069832 | A1 | 3/2014 | Roehm |
| 2014/0130310 | A1 | 5/2014 | Roth |
| 2014/0137370 | A1 | 5/2014 | Lo et al. |
| 2014/0138384 | A1 | 5/2014 | O'Brien |
| 2014/0151388 | A1 | 6/2014 | Culeron et al. |
| 2014/0158028 | A1 | 6/2014 | Adams |
| 2014/0166516 | A1 | 6/2014 | Martinez et al. |
| 2014/0197059 | A1 | 7/2014 | Evans et al. |
| 2014/0251864 | A1 | 9/2014 | Voeller |
| 2014/0252010 | A1 | 9/2014 | Miller |
| 2014/0265197 | A1 | 9/2014 | Russell et al. |
| 2014/0271095 | A1 | 9/2014 | Umans et al. |
| 2014/0284158 | A1 | 9/2014 | Reid |
| 2014/0284243 | A1 | 9/2014 | Tucker |
| 2014/0311361 | A1 | 10/2014 | Wangler |
| 2014/0311844 | A1 | 10/2014 | Meersschaert et al. |
| 2014/0319147 | A1 | 10/2014 | Horovitz et al. |
| 2015/0027835 | A1 | 1/2015 | Moon |
| 2015/0034515 | A1 | 2/2015 | Monyak et al. |
| 2015/0069962 | A1 | 3/2015 | Dietzel et al. |
| 2015/0089903 | A1 | 4/2015 | Carey |
| 2015/0090551 | A1 | 4/2015 | Sikka |
| 2015/0114024 | A1 | 4/2015 | Grepper |
| 2015/0129569 | A1 | 5/2015 | Miller |
| 2015/0175338 | A1 | 6/2015 | Culp et al. |
| 2015/0189963 | A1 | 7/2015 | Lai et al. |
| 2015/0190920 | A1 | 7/2015 | Karlsson et al. |
| 2015/0208779 | A1 | 7/2015 | Tong |
| 2015/0209226 | A1 | 7/2015 | Priebe et al. |
| 2015/0233630 | A1 | 8/2015 | Bond |
| 2015/0292840 | A1 | 10/2015 | Tobin |
| 2015/0296945 | A1 | 10/2015 | Douglas |
| 2015/0315532 | A1 | 11/2015 | Bergbohm et al. |
| 2015/0352709 | A1 | 12/2015 | Diamond |
| 2015/0375558 | A1 | 12/2015 | Ben-Or |
| 2015/0375918 | A1 | 12/2015 | Holderness et al. |
| 2016/0023837 | A1 | 1/2016 | Furneaux et al. |
| 2016/0046417 | A1 | 2/2016 | Kromer |
| 2016/0052682 | A1 | 2/2016 | Gunnerson et al. |
| 2016/0083186 | A1 | 3/2016 | Wright |
| 2016/0084454 | A1 | 3/2016 | Svitak, Sr. et al. |
| 2016/0091239 | A1 | 3/2016 | Beland |
| 2016/0135563 | A1 | 5/2016 | Truong |
| 2016/0138809 | A1 | 5/2016 | Colucci et al. |
| 2016/0150862 | A1 | 6/2016 | Tonelli |
| 2016/0166024 | A1 | 6/2016 | Lai |
| 2016/0183651 | A1 | 6/2016 | Tonelli |
| 2016/0244209 | A1 | 8/2016 | Hain |
| 2016/0251124 | A1 | 9/2016 | Arnold et al. |
| 2016/0279840 | A1 | 9/2016 | French et al. |
| 2017/0079398 | A1 | 3/2017 | Reh et al. |
| 2017/0082342 | A1 | 3/2017 | Weinberg et al. |
| 2017/0108260 | A1 | 4/2017 | Ansted et al. |
| 2017/0127782 | A1 | 5/2017 | Korey et al. |
| 2017/0165829 | A1 | 6/2017 | Damberg |
| 2017/0173781 | A1 | 6/2017 | Damberg |
| 2017/0215537 | A1 | 8/2017 | Yu |
| 2017/0290400 | A1 | 10/2017 | Thomas |
| 2017/0347765 | A1 | 12/2017 | Jackson et al. |
| 2018/0035775 | A1 | 2/2018 | Haimoff |
| 2018/0078008 | A1 | 3/2018 | Sturm |
| 2018/0087819 | A1 | 3/2018 | Triska et al. |
| 2018/0141718 | A1 | 5/2018 | Ahlstrom et al. |
| 2018/0194533 | A1 | 7/2018 | Bramwell |
| 2018/0335241 | A1 | 11/2018 | Li et al. |
| 2018/0339820 | A1 | 11/2018 | Reinhart et al. |

(56) References Cited

U.S. PATENT DOCUMENTS

| | | | |
|---|---|---|---|
| 2018/0354687 | A1 | 12/2018 | Seiders et al. |
| 2019/0008254 | A1 | 1/2019 | Newson |
| 2019/0170422 | A1 | 6/2019 | Dexter |
| 2019/0234671 | A1 | 8/2019 | Stanford et al. |
| 2019/0256119 | A1 | 8/2019 | Brilhante et al. |
| 2019/0271433 | A1 | 9/2019 | Tonelli |
| 2020/0037719 | A1 | 2/2020 | Jaworski et al. |
| 2020/0039056 | A1 | 2/2020 | Damberg |
| 2020/0060400 | A1 | 2/2020 | Glaser |
| 2020/0061802 | A1 | 2/2020 | Samsel et al. |
| 2020/0062454 | A1 | 2/2020 | Duong et al. |
| 2020/0086905 | A1 | 3/2020 | Yao et al. |

FOREIGN PATENT DOCUMENTS

| | | | |
|---|---|---|---|
| BR | 202015031355 | U2 | 6/2017 |
| CA | 60997 | A | 8/1898 |
| CA | 72336 | A | 7/1901 |
| CA | 72337 | A | 7/1901 |
| CA | 72338 | A | 7/1901 |
| CA | 73327 | A | 10/1901 |
| CA | 77273 | A | 9/1902 |
| CA | 81456 | A | 6/1903 |
| CA | 152411 | A | 12/1913 |
| CA | 175930 | A | 3/1917 |
| CA | 175939 | A | 3/1917 |
| CA | 2624994 | A1 | 5/2000 |
| CA | 89737 | A | 6/2000 |
| CA | 2483772 | A1 | 4/2005 |
| CA | 2633223 | A1 | 12/2009 |
| CA | 2635328 | A1 | 12/2009 |
| CA | 2782668 | A1 | 12/2013 |
| CH | 365631 | A | 11/1962 |
| CN | 2073459 | U | 3/1991 |
| CN | 2132145 | Y | 5/1993 |
| CN | 1112819 | A | 12/1995 |
| CN | 2515999 | Y | 10/2002 |
| CN | 2549792 | Y | 5/2003 |
| CN | 1457237 | A | 11/2003 |
| CN | 2664452 | Y | 12/2004 |
| CN | 3498732 | | 1/2006 |
| CN | 3498735 | | 1/2006 |
| CN | 2813823 | Y | 9/2006 |
| CN | 300690540 | | 9/2007 |
| CN | 300690541 | | 9/2007 |
| CN | 201076126 | Y | 6/2008 |
| CN | 300854008 | | 12/2008 |
| CN | 300856959 | | 12/2008 |
| CN | 300918117 | | 5/2009 |
| CN | 301150817 | | 3/2010 |
| CN | 301189065 | | 5/2010 |
| CN | 201691232 | U | 1/2011 |
| CN | 301548656 | | 5/2011 |
| CN | 301620134 | | 7/2011 |
| CN | 201919912 | U | 8/2011 |
| CN | 201938601 | U | 8/2011 |
| CN | 301711528 | | 11/2011 |
| CN | 301808188 | | 1/2012 |
| CN | 301950501 | | 6/2012 |
| CN | 102626271 | A | 8/2012 |
| CN | 302115731 | | 10/2012 |
| CN | 102805467 | A | 12/2012 |
| CN | 202722894 | U | 2/2013 |
| CN | 102948946 | A | 3/2013 |
| CN | 202760445 | U | 3/2013 |
| CN | 302365993 | | 3/2013 |
| CN | 202874104 | U | 4/2013 |
| CN | 302425923 | | 5/2013 |
| CN | 302448361 | | 6/2013 |
| CN | 203182247 | U | 9/2013 |
| CN | 203283617 | U | 11/2013 |
| CN | 302631183 | | 11/2013 |
| CN | 203439475 | U | 2/2014 |
| CN | 302811286 | | 5/2014 |
| CN | 302868078 | | 7/2014 |
| CN | 203789329 | U | 8/2014 |
| CN | 203814784 | U | 9/2014 |
| CN | 204032607 | U | 12/2014 |
| CN | 104433073 | A | 3/2015 |
| CN | 204245396 | U | 4/2015 |
| CN | 303154464 | | 4/2015 |
| CN | 303186110 | | 4/2015 |
| CN | 303221245 | | 5/2015 |
| CN | 204409860 | U | 6/2015 |
| CN | 303228513 | | 6/2015 |
| CN | 303228514 | | 6/2015 |
| CN | 303242426 | | 6/2015 |
| CN | 303251869 | | 6/2015 |
| CN | 303324038 | | 8/2015 |
| CN | 303333672 | | 8/2015 |
| CN | 201530103483 | | 8/2015 |
| CN | 303381343 | | 9/2015 |
| CN | 303390870 | | 9/2015 |
| CN | 303499903 | | 12/2015 |
| CN | 303546215 | | 1/2016 |
| CN | 201530438676 | | 2/2016 |
| CN | 201530438792 | | 2/2016 |
| CN | 105473462 | A1 | 4/2016 |
| CN | 303630971 | | 4/2016 |
| CN | 303680031 | | 5/2016 |
| CN | 303680054 | | 5/2016 |
| CN | 303687108 | | 6/2016 |
| CN | 205521292 | U | 8/2016 |
| CN | 303783877 | | 8/2016 |
| CN | 303799176 | | 8/2016 |
| CN | 201630123602 | | 8/2016 |
| CN | 303904119 | | 11/2016 |
| CN | 303918135 | | 11/2016 |
| CN | 205831341 | U | 12/2016 |
| CN | 303982382 | | 12/2016 |
| CN | 303982387 | | 12/2016 |
| CN | 304000494 | | 1/2017 |
| CN | 304036742 | | 2/2017 |
| CN | 304036750 | | 2/2017 |
| CN | 304050612 | | 2/2017 |
| CN | 304068469 | | 3/2017 |
| CN | 304076890 | | 3/2017 |
| CN | 106551485 | A | 4/2017 |
| CN | 304172638 | | 6/2017 |
| CN | 107125891 | A | 9/2017 |
| CN | 107173938 | A | 9/2017 |
| CN | 107307551 | A | 11/2017 |
| CN | 107467837 | A | 12/2017 |
| CN | 206702967 | U | 12/2017 |
| CN | 304411334 | | 12/2017 |
| CN | 304411336 | | 12/2017 |
| CN | 304411337 | | 12/2017 |
| CN | 304411389 | | 12/2017 |
| CN | 304417314 | | 12/2017 |
| CN | 304423206 | | 12/2017 |
| CN | 304423258 | | 12/2017 |
| CN | 304423259 | | 12/2017 |
| CN | 304423260 | | 12/2017 |
| CN | 304423317 | | 12/2017 |
| CN | 206880270 | U | 1/2018 |
| CN | 304461798 | | 1/2018 |
| CN | 107668874 | A | 2/2018 |
| CN | 304532315 | | 3/2018 |
| CN | 304532317 | | 3/2018 |
| CN | 304532318 | | 3/2018 |
| CN | 304532319 | | 3/2018 |
| CN | 304539046 | | 3/2018 |
| CN | 304555895 | | 3/2018 |
| CN | 304562598 | | 4/2018 |
| CN | 304569073 | | 4/2018 |
| CN | 304569074 | | 4/2018 |
| CN | 108078109 | A | 5/2018 |
| CN | 304645055 | | 5/2018 |
| CN | 207428627 | U | 6/2018 |
| CN | 304653754 | | 6/2018 |
| CN | 304660325 | | 6/2018 |
| CN | 304660327 | | 6/2018 |
| CN | 304660329 | | 6/2018 |
| CN | 304660332 | | 6/2018 |

(56) References Cited

FOREIGN PATENT DOCUMENTS

| | | | |
|---|---|---|---|
| CN | 304692146 | | 6/2018 |
| CN | 304701684 | | 6/2018 |
| CN | 304749390 | | 7/2018 |
| CN | 304764980 | | 8/2018 |
| CN | 108497660 | A | 9/2018 |
| CN | 304823685 | | 9/2018 |
| CN | 304823694 | | 9/2018 |
| CN | 108608804 | A | 10/2018 |
| CN | 207949211 | U | 10/2018 |
| CN | 304836888 | | 10/2018 |
| CN | 304854893 | | 10/2018 |
| CN | 304862165 | | 10/2018 |
| CN | 304862166 | | 10/2018 |
| CN | 108741519 | A | 11/2018 |
| CN | 108783799 | A | 11/2018 |
| CN | 108835813 | A | 11/2018 |
| CN | 108835814 | A | 11/2018 |
| CN | 304877452 | | 11/2018 |
| CN | 304900938 | | 11/2018 |
| CN | 108945792 | A | 12/2018 |
| CN | 109043770 | A | 12/2018 |
| CN | 208192442 | U | 12/2018 |
| CN | 208192487 | U | 12/2018 |
| CN | 304995265 | | 1/2019 |
| CN | 305641119 | | 1/2019 |
| CN | 109303399 | A | 2/2019 |
| CN | 305019548 | | 2/2019 |
| CN | 109431028 | A | 3/2019 |
| CN | 109497673 | A | 3/2019 |
| CN | 208581902 | U | 3/2019 |
| CN | 305050777 | | 3/2019 |
| CN | 305078423 | | 3/2019 |
| CN | 305078424 | | 3/2019 |
| CN | 305111950 | | 4/2019 |
| CN | 305181544 | | 5/2019 |
| CN | 305184268 | | 5/2019 |
| CN | 305242413 | | 7/2019 |
| CN | 305283238 | | 8/2019 |
| CN | 209403814 | U | 9/2019 |
| CN | 305347993 | | 9/2019 |
| CN | 305359134 | | 9/2019 |
| CN | 305359135 | | 9/2019 |
| CN | 209528183 | U | 10/2019 |
| CN | 305398498 | | 10/2019 |
| CN | 209563672 | U | 11/2019 |
| CN | 209628893 | U | 11/2019 |
| CN | 305424085 | | 11/2019 |
| CN | 305424089 | | 11/2019 |
| CN | 305437133 | | 11/2019 |
| CN | 305437134 | | 11/2019 |
| CN | 305437137 | | 11/2019 |
| CN | 110605939 | A | 12/2019 |
| CN | 209719155 | U | 12/2019 |
| CN | 209719159 | U | 12/2019 |
| CN | 209732871 | U | 12/2019 |
| CN | 209788810 | U | 12/2019 |
| CN | 305476163 | | 12/2019 |
| CN | 305488622 | | 12/2019 |
| CN | 305499080 | | 12/2019 |
| CN | 305518862 | | 12/2019 |
| CN | 209931762 | U | 1/2020 |
| CN | 209965461 | U | 1/2020 |
| CN | 305527333 | | 1/2020 |
| CN | 305533439 | | 1/2020 |
| CN | 305533533 | | 1/2020 |
| CN | 305533534 | | 1/2020 |
| CN | 305533538 | | 1/2020 |
| CN | 305533539 | | 1/2020 |
| CN | 305540311 | | 1/2020 |
| CN | 305547763 | | 1/2020 |
| CN | 305547764 | | 1/2020 |
| CN | 305547961 | | 1/2020 |
| CN | 305556652 | | 1/2020 |
| CN | 305563596 | | 1/2020 |
| CN | 305571758 | | 1/2020 |
| CN | 305571764 | | 1/2020 |
| CN | 305577923 | | 1/2020 |
| CN | 305577960 | | 1/2020 |
| CN | 305578103 | | 1/2020 |
| CN | 210076793 | U | 2/2020 |
| CN | 210114130 | U | 2/2020 |
| CN | 305584094 | | 2/2020 |
| CN | 305584095 | | 2/2020 |
| CN | 305584098 | | 2/2020 |
| CN | 305605578 | | 2/2020 |
| CN | 305614805 | | 2/2020 |
| CN | 305621592 | | 2/2020 |
| CN | 305621593 | | 2/2020 |
| CN | 305629332 | | 2/2020 |
| CN | 305635594 | | 3/2020 |
| CN | 305636583 | | 3/2020 |
| CN | 305639489 | | 3/2020 |
| CN | 305642338 | | 3/2020 |
| CN | 305642339 | | 3/2020 |
| CN | 305642418 | | 3/2020 |
| DE | 74708 | C | 4/1894 |
| DE | 2020368 | A1 | 11/1971 |
| DE | 7502524 | U | 9/1975 |
| DE | 2939826 | A1 | 4/1980 |
| DE | 3344410 | A1 | 6/1985 |
| DE | 8620597 | U1 | 9/1986 |
| DE | 9012845 | U1 | 10/1990 |
| DE | 4042245 | A1 | 7/1991 |
| DE | 9105033 | U1 | 3/1992 |
| DE | 9408707 | U1 | 9/1995 |
| DE | 29516306 | U1 | 2/1997 |
| DE | 29815666 | U1 | 11/1998 |
| DE | 19755532 | A1 | 6/1999 |
| DE | 20312950 | U1 | 10/2003 |
| DE | 20313077 | U1 | 1/2004 |
| DE | 202004007996 | U1 | 7/2004 |
| DE | 202004015475 | U1 | 1/2005 |
| DE | 202004016959 | U1 | 2/2005 |
| DE | 202005006105 | U1 | 6/2005 |
| DE | 202005014773 | U1 | 11/2005 |
| DE | 202006001888 | U1 | 4/2006 |
| DE | 402010002800-0008 | | 6/2010 |
| DE | 402010002800-0001 | | 7/2010 |
| DE | 402010002800-0002 | | 7/2010 |
| DE | 402010002800-0003 | | 7/2010 |
| DE | 402010002800-0004 | | 7/2010 |
| DE | 402010002800-0007 | | 7/2010 |
| DE | 402010002800-0009 | | 7/2010 |
| DE | 402010002800-0010 | | 7/2010 |
| DE | 402010002800-0011 | | 7/2010 |
| DE | 402010002800-0012 | | 7/2010 |
| DE | 202012006671 | U1 | 8/2012 |
| DE | 102012025617 | A1 | 10/2013 |
| DE | 102013004590 | A1 | 9/2014 |
| DE | 102013114520 | A1 | 6/2015 |
| DE | 202016004315 | U1 | 8/2016 |
| DE | 202015106823 | U1 | 3/2017 |
| DE | 102017122609 | A1 | 3/2019 |
| EM | 000134804-0001 | | 6/2004 |
| EM | 001606468-0001 | | 9/2009 |
| EM | 001606468-0002 | | 9/2009 |
| EM | 001682428-0001 | | 4/2010 |
| EM | 001682428-0002 | | 4/2010 |
| EM | 001682428-0003 | | 4/2010 |
| EM | 001682428-0004 | | 4/2010 |
| EM | 001682428-0005 | | 4/2010 |
| EM | 001682428-0006 | | 4/2010 |
| EM | 001781865-0001 | | 12/2010 |
| EM | 001781865-0006 | | 12/2010 |
| EM | 001781865-0007 | | 12/2010 |
| EM | 001781865-0008 | | 12/2010 |
| EM | 001781899-0006 | | 2/2011 |
| EM | 001781899-0009 | | 2/2011 |
| EM | 002215897-0001 | | 8/2013 |
| EM | 002277574-0001 | | 8/2013 |
| EM | 002277574-0002 | | 8/2013 |
| EM | 002325209-0001 | | 11/2013 |
| EM | 002325209-0002 | | 11/2013 |
| EM | 002576728-0013 | | 11/2014 |

(56) References Cited

FOREIGN PATENT DOCUMENTS

| | | | |
|---|---|---|---|
| EM | 902569467-0001 | | 11/2014 |
| EM | 902569467-0002 | | 11/2014 |
| EM | 902569467-0003 | | 11/2014 |
| EM | 902569467-0004 | | 11/2014 |
| EM | 002646935-0001 | | 3/2015 |
| EM | 002978569-0001 | | 2/2016 |
| EM | 003261668-0002 | | 7/2016 |
| EM | 003743905-0006 | | 2/2017 |
| EM | 004100048-0001 | | 9/2017 |
| EM | 004100048-0002 | | 9/2017 |
| EM | 004385409-0001 | | 10/2017 |
| EM | 004168789-0001 | | 11/2017 |
| EM | 004662039-0002 | | 3/2018 |
| EM | 004662039-0003 | | 3/2018 |
| EM | 005609583-0001 | | 8/2018 |
| EM | 005625977-0006 | | 9/2018 |
| EM | 005500311-0002 | | 10/2018 |
| EM | 005500311-0003 | | 10/2018 |
| EM | 005804747-0001 | | 10/2018 |
| EM | 005804762-0001 | | 10/2018 |
| EM | 005804770-0001 | | 10/2018 |
| EM | 005805140-0001 | | 10/2018 |
| EM | 005805199-0001 | | 10/2018 |
| EM | 006453072-0001 | | 5/2019 |
| EM | 006618583-0001 | | 10/2019 |
| EM | 006618583-0002 | | 10/2019 |
| EM | 006618583-0003 | | 10/2019 |
| EM | 006618583-0004 | | 10/2019 |
| EM | 007064233-0002 | | 11/2019 |
| EM | 007145461-0012 | | 11/2019 |
| EM | 007449095-0001 | | 1/2020 |
| EM | 007576806-0001 | | 2/2020 |
| EM | 007719141-0001 | | 3/2020 |
| EP | 0069419 | A1 | 1/1983 |
| EP | 3530067 | A1 | 3/1993 |
| EP | 0587451 | A1 | 3/1994 |
| EP | 0221215 | B1 | 6/1995 |
| EP | 0670791 | A1 | 9/1995 |
| EP | 1000865 | A1 | 5/2000 |
| EP | 1059239 | A1 | 12/2000 |
| EP | 1080656 | A1 | 3/2001 |
| EP | 1442845 | A1 | 8/2004 |
| EP | 1475008 | A1 | 11/2004 |
| EP | 1880948 | A2 | 1/2008 |
| EP | 1921009 | A1 | 5/2008 |
| EP | 2024218 | A2 | 2/2009 |
| EP | 2107982 | A1 | 10/2009 |
| EP | 2236428 | A1 | 10/2010 |
| EP | 2330939 | A1 | 6/2011 |
| EP | 2344000 | A1 | 7/2011 |
| EP | 2387906 | A1 | 11/2011 |
| EP | 2412493 | A2 | 2/2012 |
| EP | 2441340 | A1 | 4/2012 |
| EP | 2522248 | A1 | 11/2012 |
| EP | 2543481 | A1 | 1/2013 |
| EP | 2745727 | A2 | 6/2014 |
| EP | 2826394 | A1 | 1/2015 |
| EP | 2829484 | A1 | 1/2015 |
| EP | 2829485 | A1 | 1/2015 |
| EP | 2904926 | A1 | 8/2015 |
| EP | 3013176 | A1 | 5/2016 |
| EP | 3027078 | A1 | 6/2016 |
| EP | 3073852 | A1 | 10/2016 |
| EP | 3216363 | A1 | 9/2017 |
| EP | 3351130 | A1 | 7/2018 |
| EP | 3403521 | A1 | 11/2018 |
| EP | 3581059 | A1 | 12/2019 |
| FR | 2179844 | A1 | 11/1973 |
| FR | 2223248 | A1 | 10/1974 |
| FR | 2638950 | A1 | 5/1990 |
| FR | 2689100 | A1 | 10/1993 |
| FR | 2711044 | A1 | 4/1995 |
| FR | 2712257 | A1 | 5/1995 |
| FR | 2809690 | A1 | 12/2001 |
| FR | 2870692 | A1 | 12/2005 |
| FR | 2912997 | A1 | 8/2008 |
| GB | 854540 | A | 11/1960 |
| GB | 1041392 | A | 9/1966 |
| GB | 2023550 | A | 1/1980 |
| GB | 2023551 | A | 1/1980 |
| GB | 2032814 | A | 5/1980 |
| GB | 2045135 | A | 10/1980 |
| GB | 2047073 | A | 11/1980 |
| GB | 2023549 | A | 9/1992 |
| GB | 2278874 | A | 12/1994 |
| GB | 2291042 | A | 1/1996 |
| GB | 2308803 | A | 7/1997 |
| GB | 2289713 | B | 12/1997 |
| GB | 2421713 | A | 7/2006 |
| GB | 2438189 | A | 11/2007 |
| GB | 2459111 | A | 10/2009 |
| GB | 4036176 | | 7/2014 |
| GB | 4037039 | | 10/2014 |
| GB | 2575671 | A | 1/2020 |
| ID | D0000002662-0001 | | 1/2003 |
| IL | 55179 | A | 7/1981 |
| IN | 266778 | | 5/2015 |
| IN | 266779-0001 | | 5/2015 |
| IN | 276720 | | 2/2016 |
| JP | S57-150175 | U | 9/1982 |
| JP | S60-164570 | A | 8/1985 |
| JP | H03-066374 | U | 6/1991 |
| JP | H0574275 | A | 3/1993 |
| JP | H07-102842 | A | 4/1995 |
| JP | H08-093298 | A | 4/1996 |
| JP | 2569734 | B2 | 1/1997 |
| JP | 2976179 | B2 | 11/1999 |
| JP | 2001-107621 | A | 4/2001 |
| JP | 3177720 | B2 | 6/2001 |
| JP | 3197227 | B2 | 8/2001 |
| JP | 2001-262907 | A | 9/2001 |
| JP | 3211023 | B2 | 9/2001 |
| JP | D1121506 | | 9/2001 |
| JP | 3225244 | B2 | 11/2001 |
| JP | D2001-10753 | | 6/2002 |
| JP | D1193948 | | 1/2004 |
| JP | 2006122067 | A | 5/2006 |
| JP | D1312168 | | 10/2007 |
| JP | D2007-16058 | | 5/2008 |
| JP | D2007-16059 | | 5/2008 |
| JP | D1338388 | | 8/2008 |
| JP | D1382214 | | 3/2010 |
| JP | D1382215 | | 3/2010 |
| JP | D1397219 | | 9/2010 |
| JP | D1397346 | | 9/2010 |
| JP | D1408819 | | 3/2011 |
| JP | D1408988 | | 3/2011 |
| JP | 2014184051 | A | 10/2014 |
| JP | 6206200 | B2 | 10/2017 |
| JP | 6226662 | B2 | 11/2017 |
| JP | 2019119506 | A | 7/2019 |
| KR | 100395931 | B1 | 8/2003 |
| KR | 3020030024985 | | 9/2003 |
| KR | 200362331 | Y1 | 9/2004 |
| KR | 20070101643 | A | 10/2007 |
| KR | 20070103598 | A | 10/2007 |
| KR | 3020070008850 | | 12/2007 |
| KR | 300492699.0000 | | 5/2008 |
| KR | 20090074289 | A | 7/2009 |
| KR | 100921297 | B1 | 10/2009 |
| KR | 101267451 | B1 | 5/2013 |
| KR | 300740505.0000 | | 4/2014 |
| KR | 300887228.0000 | | 12/2016 |
| KR | 300908948.0000 | | 6/2017 |
| KR | 300908949.0000 | | 6/2017 |
| KR | 300915252.0000 | | 7/2017 |
| KR | 20180037090 | A | 4/2018 |
| KR | 300968949.0000 | | 8/2018 |
| KR | 300982867.0000 | | 11/2018 |
| KR | 300983257.0000 | | 12/2018 |
| KR | 300990244.0000 | | 1/2019 |
| KR | 300990253.0000 | | 1/2019 |
| KR | 300996066.0000 | | 3/2019 |
| KR | 102054504 | B1 | 12/2019 |

(56) References Cited

FOREIGN PATENT DOCUMENTS

| | | | |
|---|---|---|---|
| KR | 301037245.0000 | | 12/2019 |
| KR | 301037251.0000 | | 12/2019 |
| KR | 301050842.0000 | | 3/2020 |
| NL | 7504291 | A | 10/1975 |
| NL | 8903105 | A | 7/1991 |
| NL | 1032860 | C1 | 11/2006 |
| RU | 00100422 | U1 | 12/2010 |
| TR | 201708307-0001 | | 2/2018 |
| TW | M310869 | U | 5/2007 |
| WO | 9400034 | A1 | 1/1994 |
| WO | D032061-005 | | 4/1995 |
| WO | D035637-003 | | 2/1996 |
| WO | D036648-008 | | 6/1996 |
| WO | 9631140 | A1 | 10/1996 |
| WO | 9748613 | A1 | 12/1997 |
| WO | 0041937 | A1 | 7/2000 |
| WO | 0168477 | A1 | 9/2001 |
| WO | 02064445 | A1 | 8/2002 |
| WO | 03041529 | A1 | 5/2003 |
| WO | 04076291 | A2 | 9/2004 |
| WO | 06019314 | A1 | 2/2006 |
| WO | 06037302 | A1 | 4/2006 |
| WO | 08001029 | A1 | 1/2008 |
| WO | 2008034603 | A1 | 3/2008 |
| WO | 09028960 | A1 | 3/2009 |
| WO | 1135559 | A1 | 3/2011 |
| WO | 11135559 | A1 | 11/2011 |
| WO | 12000497 | A1 | 1/2012 |
| WO | 2012029119 | A1 | 3/2012 |
| WO | D078390-004 | | 11/2012 |
| WO | 13014670 | A1 | 1/2013 |
| WO | D080557-001 | | 4/2013 |
| WO | 2013126851 | A1 | 8/2013 |
| WO | 14131214 | A1 | 9/2014 |
| WO | 14193073 | A1 | 12/2014 |
| WO | 2015040526 | | 3/2015 |
| WO | 15087357 | A1 | 6/2015 |
| WO | 16072912 | A1 | 5/2016 |
| WO | 16091570 | A1 | 6/2016 |
| WO | 2017034992 | A1 | 3/2017 |
| WO | 17088278 | A1 | 6/2017 |
| WO | 17091899 | A1 | 6/2017 |
| WO | 17192694 | A1 | 11/2017 |
| WO | 2017191628 | A1 | 11/2017 |
| WO | 2018012675 | A1 | 1/2018 |
| WO | 18169478 | A1 | 9/2018 |
| WO | 2019238228 | A1 | 12/2019 |
| WO | 2020030766 | A1 | 2/2020 |

OTHER PUBLICATIONS

Home Depot, "Husky 37 in. Rolling Tool Box Utility Cart Black," <https://www.homedepot.com/p/Husky-37-in-Rolling-Tool-Box-Utility-Cart-Black-209261/203668066>.

B&H, "Nanuk 960 Protective Rolling Case with Dividers and Organizer (Black)," <https://www.bhphotovideo.com/c/product/1504703-REG/nanuk_960_6001_960_waterproof_hard_case.html.

yeti.com, Images of Loadout Bucket Web Page visited on Mar. 17, 2020, at https://www.yeti.com/en_US/buckets/loadout-5-gallon-bucket/YLOB5.html?dwvar_YLOB5_color=white&cgid=buckets#start=1 <https://www.yeti.com/en_US/buckets/loadout-5-gallon-bucket/YLOB5.html?dwvar_YLOB5_color=white&cgid=buckets>.

amazon.com, "Top Shelf Custom Injection Molded ABS Saddlebag Organizer Tray, 2014—Current H-D ABS Hard Bags, LFT by Advanced Accessory Conceprts LLC," visited Oct. 16, 2019 and revisited Jan. 6, 2020 at https://www.amazon.com/Custom-Injection-Molded-Saddlebag-Organizer/dp/B01MQWBM40/ref=sr_1_38?keywords=luggage+hard+removable+liner&qid=1571270714&sr=8-38.

amazon.com, "Pelican Air 1615 Travel Case—Suitcase Luggage (Blue) by Pelican," visited Oct. 16, 2019 and revisited Jan. 6, 2020 at https://www.amazon.com/Pelican-Air-1615-Travel-Case/dp/B07XGHDK66?ref_=ast_sto_dp.

amazon.com, "Pelican 015100-0050-110 Protector Carry-On Case Black w/TrekPak Insert: Camera & Photo," visited Oct. 16, 2019 and revisited Jan. 6, 2020 at https://www.amazon.com/Pelican-1510TP-Carry-TrekPak-Divider/dp/B01E4E1BFK/ref=sr_1_48?crid=3CJLVWN9DJ62R&keywords=carry+on+organizer+insert&qid=1571270299&sprefix=carry+on+organizer%2Caps%2C143&sr=8-48.

amazon.com, "Samsonite F'Lite GT 31" Hardside Wheeled Luggage (Vivid Blue), visited Dec. 16, 2019 and revisited Jan. 7, 2020 at <https://www.amazon.com/Samsonite-Flite-Spinner-Black-Size/dp/B01LTG2XVC?th=1> Samsonite F'Lite GT 31 Hardside Wheeled Luggage (Vivid Blue).

alibaba.com, "Removable Spinner Wheels for Suitcase Replaceement Suitcase Luggage," visited Dec. 16, 2019 and revisited Jan. 7, 2020 at https://www.alibaba.com/product-detail/Removable-Spinner-Wheels-For-Suitcase-Replacement_605641600.

amazon.com, "Lockable Tackle Box Fishing Waterproof Fly Fishing Box Double Sided Ice Fishing Tackle Case Box Storage Waterproof:360 Degree Rubber Gasket, Durable Plastic Construction Double Sided Triangle-Cut For," visited Dec. 16, 22019 and revisited Jan. 7, 2020 at <https://www.amazon.com/Lockable-Tackle-Fishing-Waterproof-Storage/dp/B07MFF6S6N>.

yankodesign.com, "Vacuum Packed Suitcase," visited Dec. 16, 2019 and revisited Jan. 7, 2020 at <https://www/yankodesign.com/2011/11/28/vacuum-packed-suitcase/>.

alibaba.com, "Portable Luggage Wheels for Luggage Trolley Bags & Suitcase," visited Dec. 16, 2019 and revisited Jan. 7, 2020 at https://www.alibaba.com/product-detail/Portable-Luggage-Wheels-for-luggage-Trolley_1854722793.html.

northerntool.com, "Dewalt 28in. Wheeled Toolbox, Model# DWST28100," visited on Apr. 6, 2020 at https://www.northerntool.com/shop/tools/product_200726534_200726534.

walmart.com, "Sterilite 151L Black Wheeled Industrial Tote," visited on Apr. 6, 2020 at https://www.walmart.ca/en/ip/sterilite-151l-black-wheeled-industrial-tote/6000195957310.

globalindustrial.com, "Contico UK3725-4 Rolling Pro Tuff Work Box," visited on Apr. 6, 2020 at https://www.globalindustrial.com/p/tools/tool-storage/Jo-Site/rolling-pro-tuff-work-box?infoParam.campaignId=T9F.

amazon.com, "Grey: Akro-Mils 33105 Akro-Grid Slotted Divider Plastic Tote Box," visited on Apr. 6, 2020 at https://www.amazon.in/Grey-Akro-Mils-Akro-Grid-Slotted-Divider/dp/B004C044VU.

globalindustrial.com, "Global Industrial™ Plastic Dividable Grid Container," visited on Apr. 6, 2020 at https://www.globalindustrial.com/p/storage/bins-totes-containers/dividable-grid/grid-wall-bin-stackable-1.

globalindustrial.com, "Straight Wall Container Solid," visited on Apr. 6, 2020 at https://www.globalindustrial.com/p/storage/bins-totes-containers/stacking-containers/straight-wall-container-12x7-2-5x5.

Pelican Elite 50 Quart Cooler, available Nov. 9, 2016, [online], [site visited Mar. 31, 2018]. Available from internet, <URL: https://www.amazon.com/Pelican-Elite-Quart-Cooler-White/product-reviews/B01G7KG5PA/ref=cm_cr_getr_d_paging_btm_5?ie=UTF8&reviewerType=all_reviews&sortBy=recent&pageNumber=5 (Year:2016).

Pelican Storm Waterproof Case, available Jul. 27, 2009, [online], [site visited Mar. 31, 2018]. Available from internet, <URL: https://www.amazon.com/dp/B002JB07D8?aaxitk=EqSpVoa9QpKAGqst7rmxMA&pd_rd_i=B002JB07D8&pf_rd_m=ATVPDKIKX0DER&pf (Year: 2009).

Outdoor Products Small Watertight Dry Box, Blue, available May 31, 2016, [online], [site visited Mar. 31, 2018]. Available from internet, <URL: https://www.walmart.com/ip/Outdoor-Products-Small-Watertight-Dry-Box-Blue/26674162 (Year: 2016).

Apr. 7, 2021—(CN) First Office Action—App. No. 202030815015.X.

May 12, 2020—(WO) Partial International Search—PCT/US2020/012404.

Jul. 6, 2020—(WO) International Search Report & Written Opinion—PCT/US2020/012404.

(56) References Cited

OTHER PUBLICATIONS

Aug. 13, 2020—(WO) Partial International Search—PCT/US2020/026655.
Oct. 7, 2020—(WO) ISR & WO—PCT/US2020/026655.
Dec. 2, 2020—(CN) First Office Action—App. No. 201880036572.1.
Sep. 20, 2018—(WO) International Search Report and Written Opinion—App. PCT/US2018/037100.
Amazon.com, "TCMT Matt Black Chopped Tour Pack Trunk w/Backrest Fits For Harley Street Road Glide 2014-2020 (Style B) by TCMT," visited Oct. 16, 2019 and revisited Jan. 6, 2020 at https://www.amazon.com.
Amazon.com, "HardBagger Top Shelf Hard Saddlebag Organizer—Right or Left TS100HD by HardBagger," visited Oct. 16, 2019 and revisited Jan. 6, 2020 at https://www.amazon.com/HardBagger-Shelf-Hard-Saddlebag-Organizer.
Toolguyd, "Milwaukee Packout Tool Boxes and Storage System, in Photos," https://toolguyd.com/milwaukee-packout-tool-boxes-photo-introduction/.

* cited by examiner

24B

CONTAINER AND LATCHING SYSTEM

CROSS-REFERENCE TO RELATED APPLICATION

This application claims priority to U.S. Provisional Patent Application No. 62/518,358 filed on Jun. 12, 2017. The above referenced application is incorporated by reference in its entirety.

BACKGROUND

Various types of containers and latching systems exist. Containers may be used for food, beverages, and other materials or items. Latching systems exist to lock the containers in a closed configuration. However, conventional containers and latching systems are often not very durable and may not be easy to use. For instance, containers may not be strong enough to hold certain items and may not be strong enough to hold items on top of the container. Additionally, some latching systems may engage when a user does not want the system engaged and in other cases may not provide a sufficient lock between for the container. In such arrangements these and other deficiencies may render the container and/or latching system virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

According to one aspect a container is disclosed. The container may comprise a molded base that includes a sidewall structure having a first side, a second side opposite the first side, a third side extending between an edge of the first side and an edge of the second side, and a fourth side opposite the third side, the sidewall structure having a first end and a second end; a bottom portion connected to a first end of the sidewall structure and configured to support the container on a surface, and an opening formed at a second end of the sidewall structure, opposite the first end, the opening being configured to allow access to an interior void of the container formed by the sidewall structure and the bottom portion. The base may further include a latch keeper extending from the sidewall structure, where the latch keeper has an upper surface, an inner surface and a lower surface. The container may also include a lid that is pivotal between an open configuration and a closed configuration, where the lid has a shape corresponding to a shape of the base and is configured to cover the opening formed at the second end of the sidewall structure when the container is in the closed configuration. A hinge may be configured to connect the lid to the base where the lid is rotatable from the closed configuration to the open configuration. The container may further include a latch assembly, where the latch assembly having a locked position and an unlocked position.

The latch assembly may include a latch body that is pivotally engaged with the lid and where the latch body having at least one engagement lug. The latch assembly may further include a locking member that is slidably engaged with the latch body, where the locking member is slidable between at least a downward position and an upward position. The locking member may be configured to lock the lid in the closed configuration when the locking member is in the downward position and configured to unlock the lid when the locking member is in the upward position. Still the latch assembly further includes a biasing member engaged with the latch body and the locking member, where the biasing member biases the locking member in a downward position; and an activating member pivotally engaged with the latch body and engaged with the locking member, where the activating member configured to move the locking member from the downward position to the upward position. The latch assembly may only be moved from the unlocked position to the locked position when the locking member is in the upward position. Another aspect of the latch assembly is that the at least one engagement lug of the latch body may be engaged to the lower surface of latch keeper when the latch assembly is in the locked position; and that a hook portion of the locking member may engage the upper surface of the latch keeper when the latch assembly is in the locked position.

Other aspects of this disclosure may relate to the lid of the container being rotated from the closed configuration to the open configuration may include rotating the lid 90 degrees from the closed configuration. In addition, the latch keeper may further include a support rib that extends from an exterior surface of the base to the inner surface of the latch keeper, where the support rib may be centrally located relative to the upper surface of the latch keeper. The locking member may further comprise at least two hook portions, such that when the latch assembly is in the locked position, the support rib is positioned between the at least two hook portions of the locking member. The base may further comprise at least one ramped surface adjacent the latch keeper, such that the ramped surface extends downwardly at an angle away from an interface surface of the base. The at least one ramped surface forms an angle between 30 degrees and 60 degrees relative to the interface surface of the base. A gasket may be arranged in a recess formed in at least one of the base and the lid. As another feature, the base may further comprise a handle on each of the sides of the container, where each handle is integrally molded with the base. The handles may have a curved profile underneath an exterior surface of the handle, and wherein the curved profile is formed by a plurality of ribs extending from one of the sides of the sidewall structure to an interior surface of the handle.

Other aspects of this disclosure may relate to a container comprising: a base that includes a sidewall structure having at least a first side and a second side opposite the first side, the sidewall structure having a first end and a second end; a bottom portion connected to a first end of the sidewall structure and configured to support the container on a surface; and an opening formed at a second end of the sidewall structure, opposite the first end, the opening being configured to allow access to an interior void of the container formed by the sidewall structure and the bottom portion. The base may also include a latch keeper extending from the sidewall structure, the latch keeper having an upper surface, an inner surface and a lower surface. The container may also comprise a lid that is pivotal between an open configuration and a closed configuration, where the lid has a shape corresponding to a shape of the base and is configured to cover the opening formed at the second end of the sidewall structure when the container is in the closed configuration. A hinge may be configured to connect the lid to the base and about which the lid is rotatable from the closed configuration to the open configuration, and a latch assembly that has a locked position and an unlocked position. The latch assembly may comprise a latch body pivotally engaged with the lid, where the latch body has an at least one engagement lug, a locking member that is engaged with the latch body, where the locking member is movable between a downward position and an upward position. The locking member may be configured to lock the lid in the closed configuration when the locking member is in the downward position and configured to unlock the lid when the locking member is in the upward position. The latch assembly may also have a biasing member engaged with the latch body and the locking member, where the biasing member biases the locking member in a downward position; and an activating member pivotally engaged with the latch body and engaged with the locking member, where the activating member is configured to move the locking member from the downward position to the upward position.

Additional aspects of this disclosure may relate to a base portion of the container that includes a plurality of tabs positioned along interior surfaces of the interior void. Each tab of the plurality of tabs may extend from one of the interior surfaces and comprise an upper support surface and an opening, where the opening of each tab has an elongated shape. The upper support surface may be located in an upper region of the interior void of the base or at a height that is greater than fifty percent of a height of the interior void. In addition, the base may include a pair of tracks are positioned on at least an interior surface of at least one sidewall, where the pair of tracks are positioned on at least an interior surface of at least two sidewalls. Similarly, the lid may comprise a plurality of clips positioned along an interior surface of the lid, where each clip includes an engaging member and an elongated opening, where the elongated opening of each tab of the plurality of tabs may have substantially the same width as the elongated opening of each clip. The container may also have a gasket arranged in a recess formed in at least one of the base and the lid and a channel integrally molded with an exterior surface of the base, wherein the channel extends around an entire exterior surface of the base.

Still other aspects of this disclosure may relate to a container that includes a base having a sidewall structure with at least a first side and a second side opposite the first side, the sidewall structure having a first end and a second end, a bottom portion connected to a first end of the sidewall structure and configured to support the container on a surface; and an opening formed at a second end of the sidewall structure, opposite the first end, where the opening being allows access to an interior void of the container formed by the sidewall structure and the bottom portion. The container may also have a lid that is pivotal between an open configuration and a closed configuration, where the lid has a shape corresponding to a shape of the base and is configured to cover the opening formed at the second end of the sidewall structure when the container is in the closed configuration. The container may also include a latch assembly that has a locked position and an unlocked position, where the latch assembly includes a latch body pivotally engaged with the lid, a locking member engaged with the latch body, where the locking member is movable between a downward position and an upward position. The locking member is configured to lock the lid in the closed configuration when the locking member is in the downward position and configured to unlock the lid when the locking member is in the upward position. An activating member may be pivotally engaged with the latch body and also engaged with the locking member, where the activating member moves the locking member from the downward position to the upward position.

Other aspects of the container described within this disclosure may include the latch assembly having a biasing member engaged with the latch body and the locking member, where the biasing member biases the locking member in a downward position. The locking member may be slidable between the downward position and the upward position, where the latch assembly may only be moved from the unlocked position to the locked position when the locking member is in the upward position. The latch body may include an inner surface and at least one engagement lug, where the base includes a latch keeper that comprises an upper surface, an inner surface and a lower surface. The at least one engagement lug of the latch body may engage the lower surface of latch keeper when the latch assembly is in the locked position; and where a lower surface of a hook portion of the locking member engages the upper surface of the latch keeper when the latch assembly is in the locked position.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of this invention relate to a containers and latching assemblies for containers. According to various aspects and embodiments, the containers and latching assemblies described herein may be formed of one or more of a variety of materials, such as metals (including metal alloys), polymers, and composites, and may be formed in one of a variety of configurations, without departing from the scope of the invention. It is understood that the containers and latching assemblies may contain components made of several different materials. Additionally, the components may be formed by various forming methods. For example, metal components, may be formed by forging, molding, casting, stamping, machining, and/or other known techniques. Additionally, polymer components, such as elastomers, can be manufactured by polymer processing techniques, such as various molding and casting techniques and/or other known techniques.

The various figures in this application illustrate examples of containers and latching assemblies according to this invention. When the same reference number appears in more than one drawing, that reference number is used consistently in this specification and the drawings refer to the same or similar parts throughout.

Figure 1A:
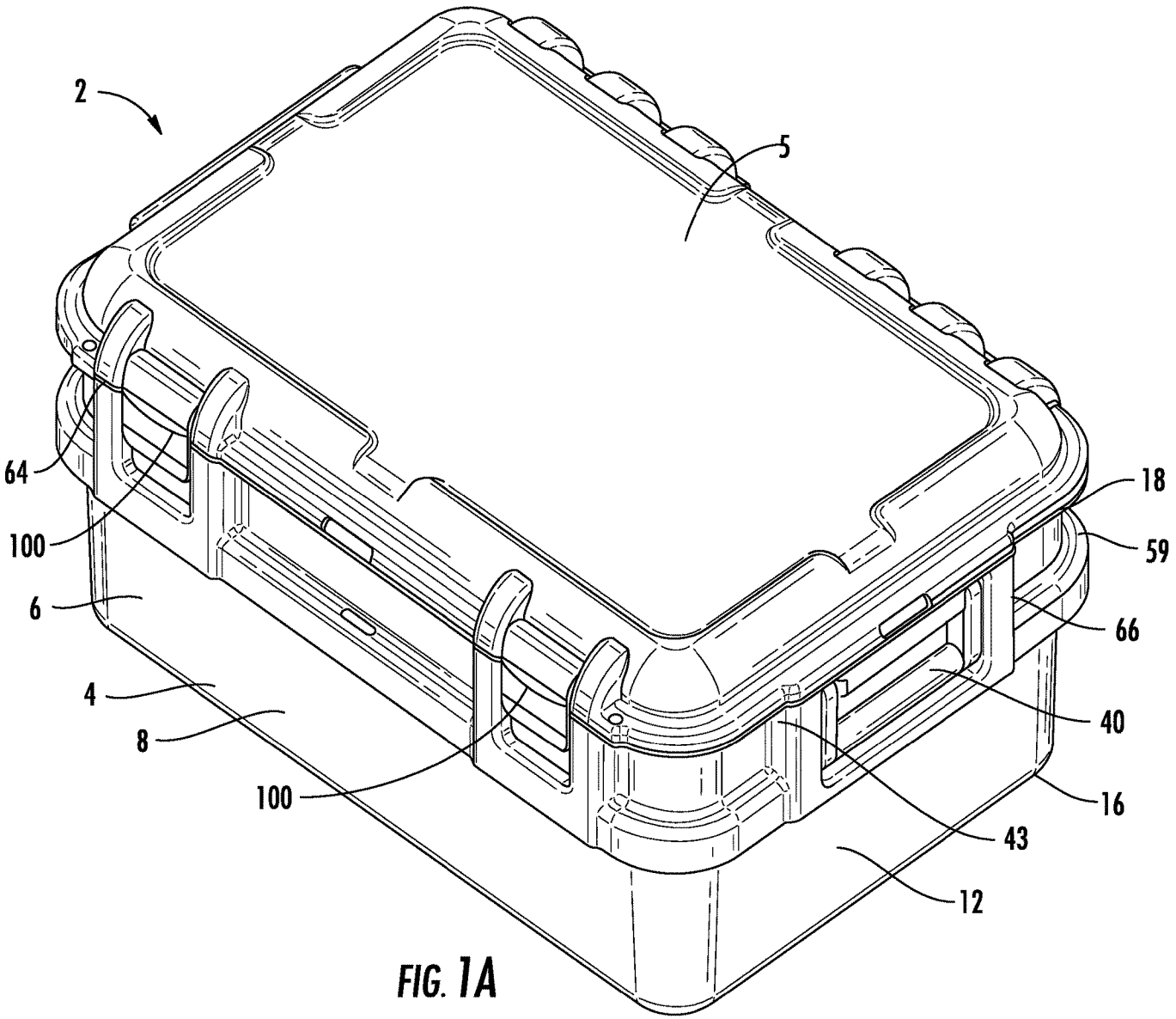
FIG. 1A is a top perspective view of a container according to one or more aspects described herein.
Figure 1B:
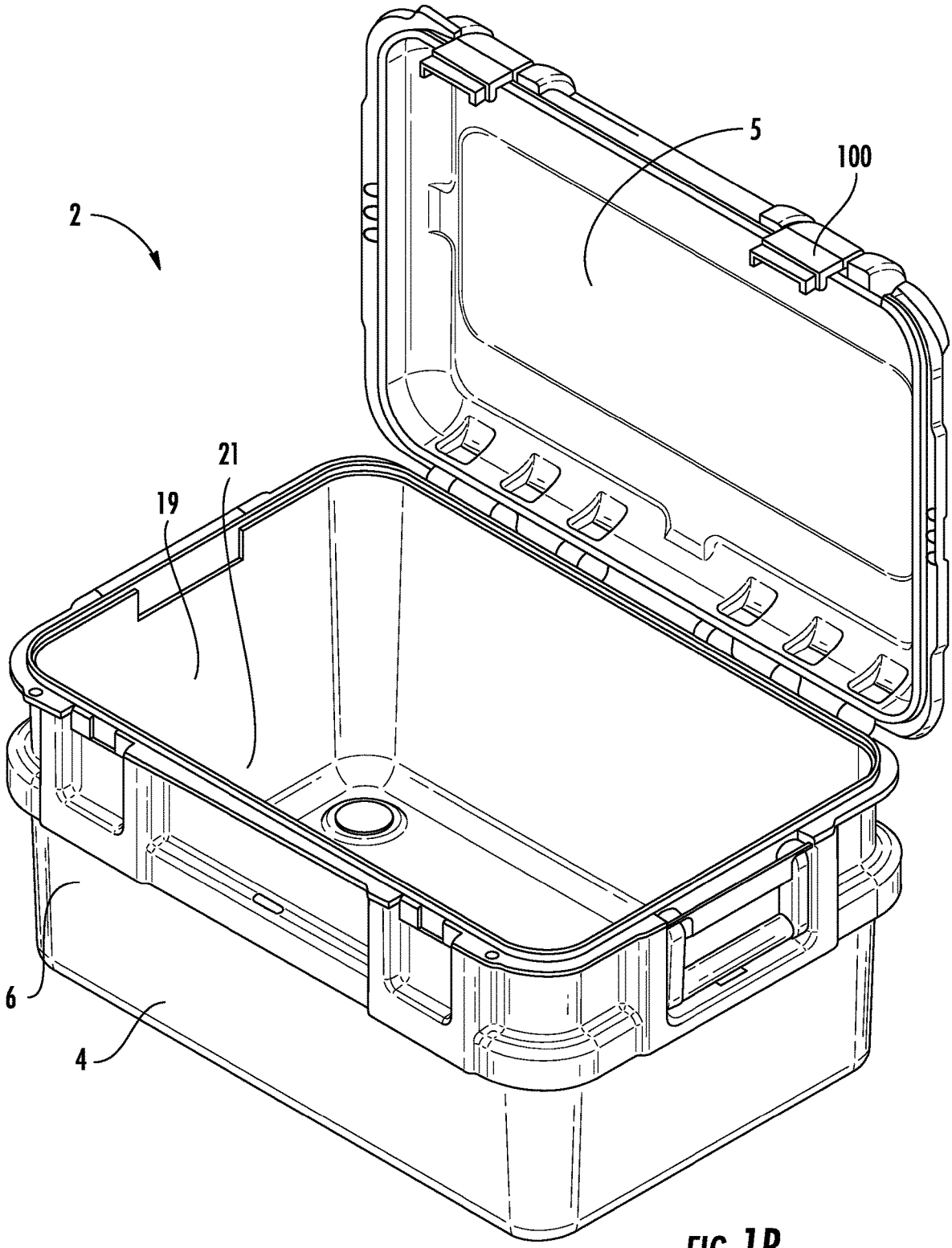
FIG. 1B is a top perspective view of the container of FIG. 1A with the lid in an open position according to one or more aspects described herein
Figure 2A:
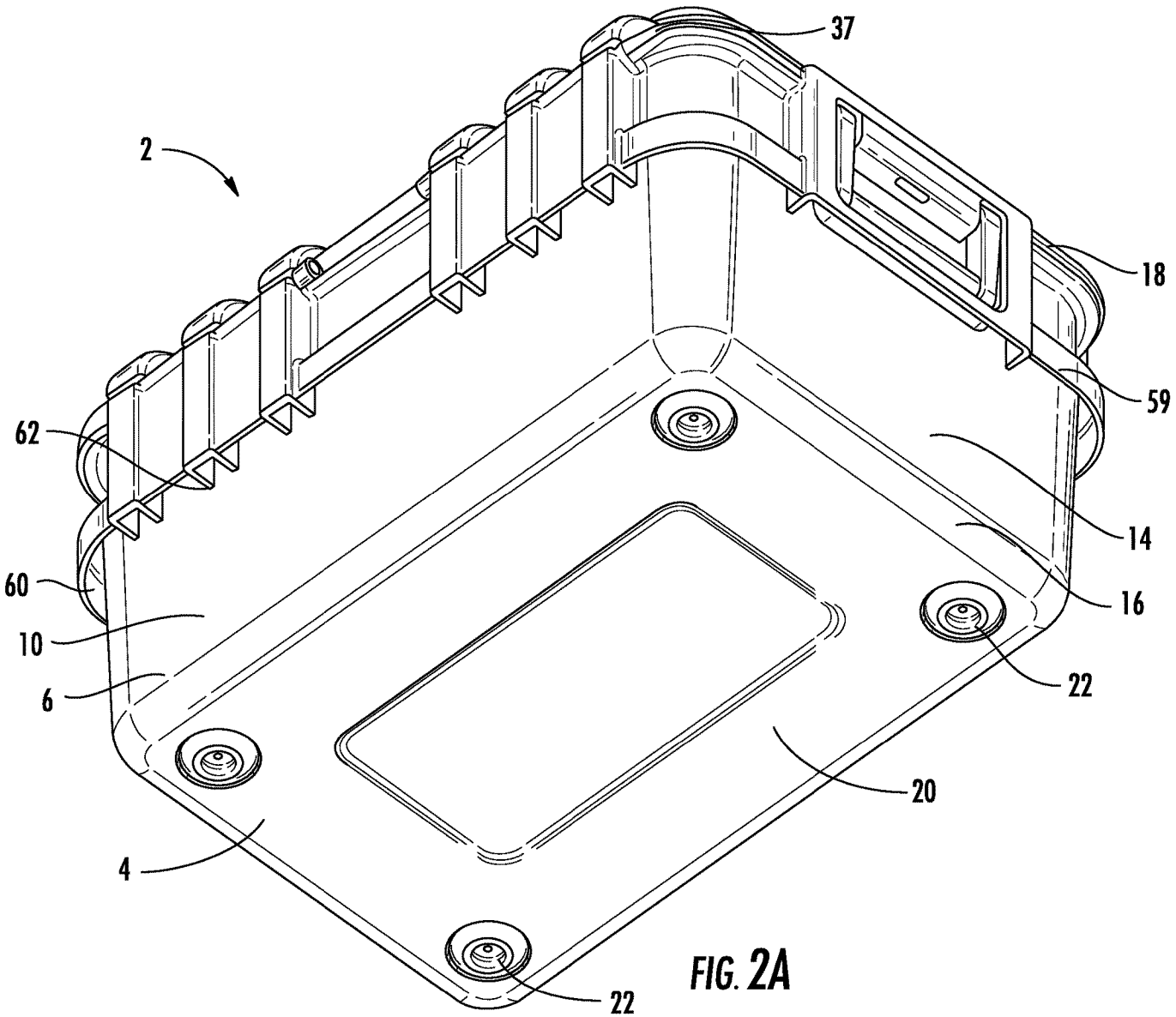
FIG. 2A is a bottom perspective view of the container of FIG. 1A according to one or more aspects described herein.
Figure 2B:
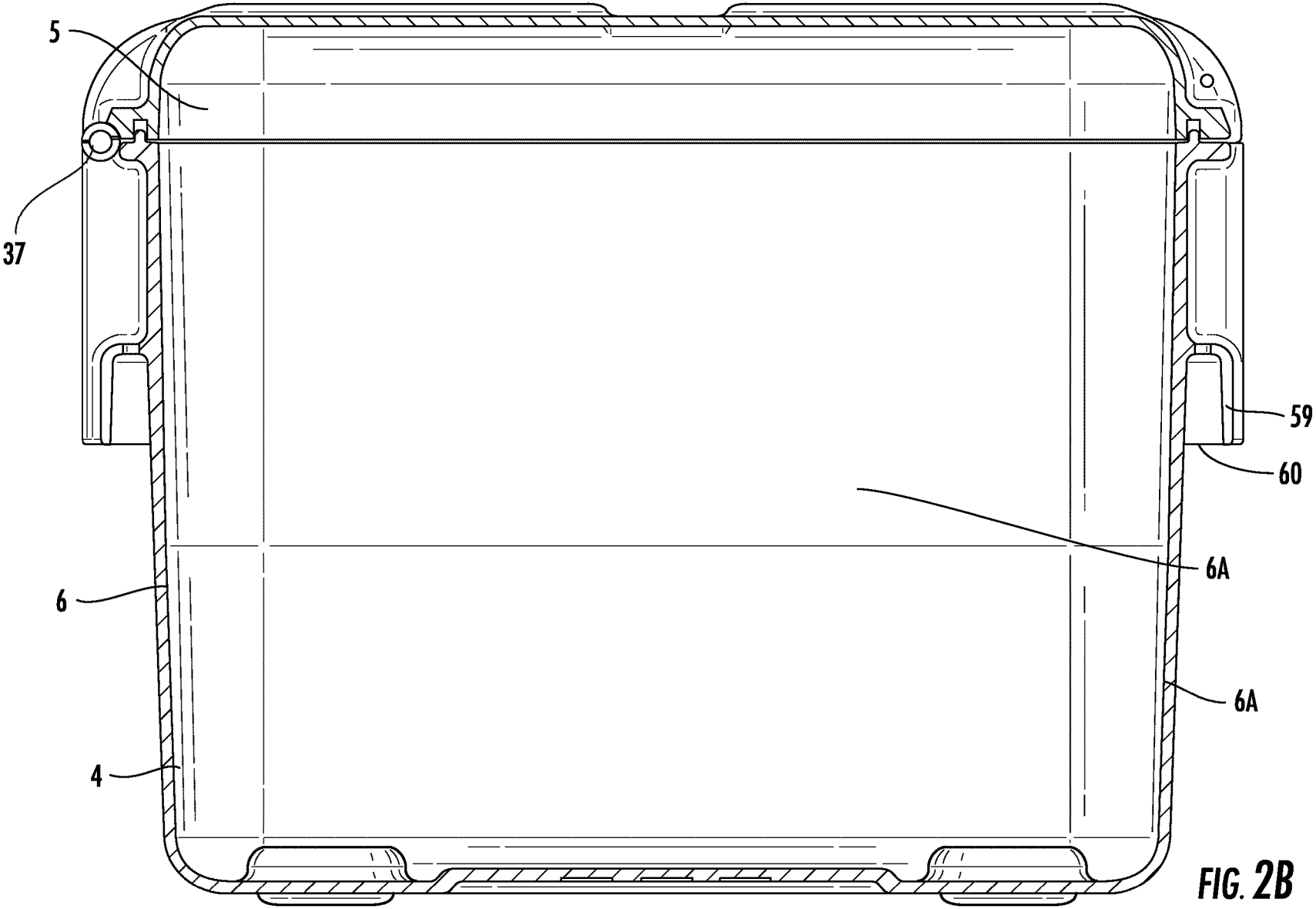
FIG. 2B is a side cross-sectional view of the container of FIG. 1A according to one or more aspects described herein.

FIGS. 1A, 1B, and 2A depict perspective views of a container 2. In one example, the container 2 may comprise a base portion 4 and a lid 5 that, in some examples, may be coupled, or in some examples may be non-destructively, removably coupled, thereto. The base portion 4 may be a structure forming a void for containing articles, as will be discussed more fully herein. In some examples, the base portion 4 may be cuboidal or substantially cuboidal in shape. In other examples, the base portion 4 may be prismoidal or substantially prismoidal (e.g., a pentagonal prism, hexagonal prism, heptagonal prism, or the like) in shape. In still other examples, the base portion 4 may be substantially cylindrical in shape or may have a substantially trapezoidal cross section. Various other shapes may be used without departing from the invention.

The base portion 4 may include a sidewall structure 6 having a first side 8, a second side 10 opposite the first side, a third side 12 extending between an edge of the first side and an edge of the second side, and a fourth side 14 opposite the third side. The sidewall structure 6 may also have a first end 16 and a second end 18. The sidewall structure 6 may also include a bottom portion 20 connected to a first end 16 of the sidewall structure 6 and configured to support the container on a surface such as a table, the ground, a vehicle bed, or the like. In some embodiments, the bottom portion 20 may also and/or alternatively include one or more feet 22 which may support the container 2 on a surface such as a table, the ground, a vehicle bed, or the like. The feet 22 may be integrally formed with the base 4 or may be attached to the base 4 after the base has been formed.

Figure 3:
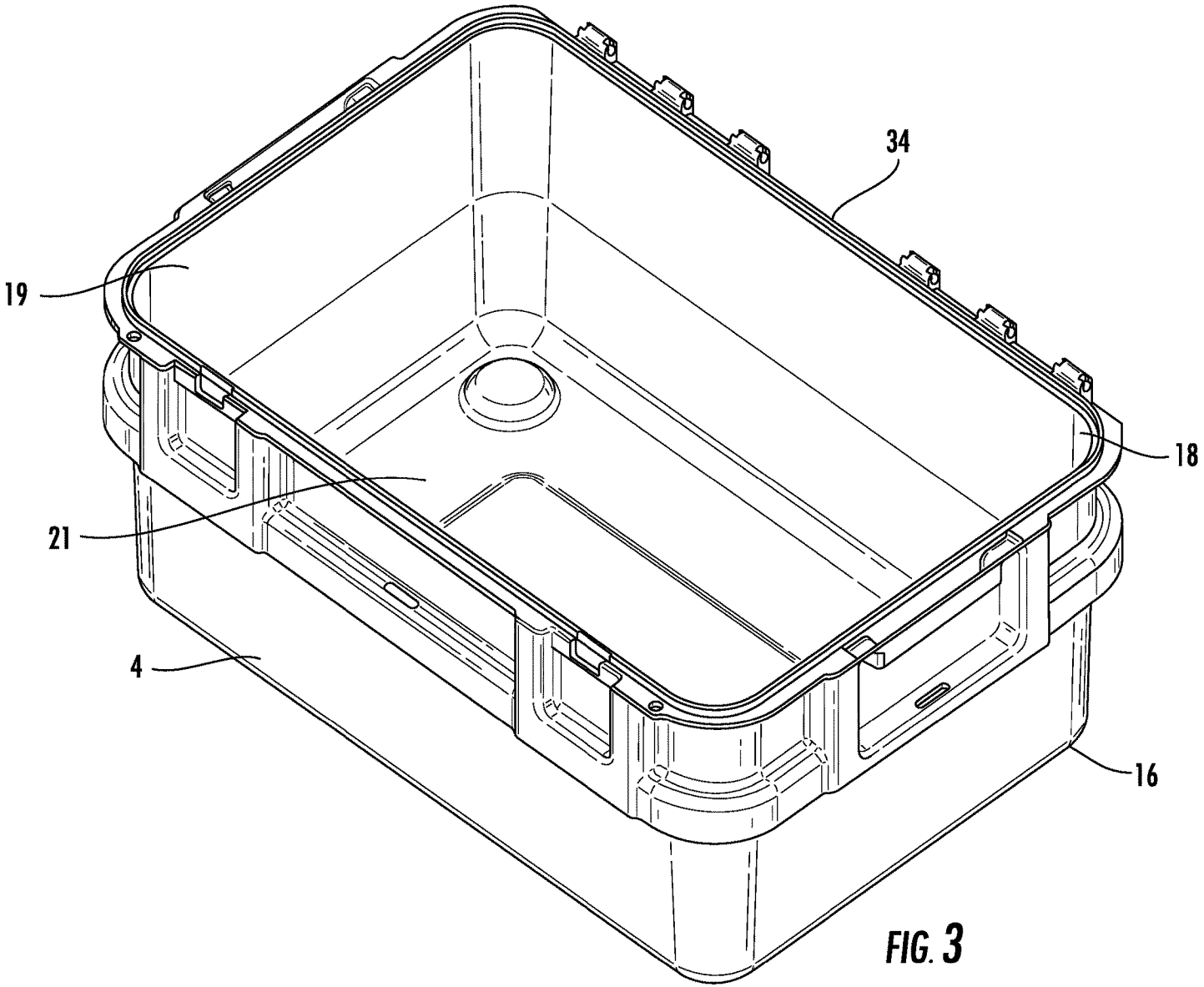
FIG. 3 is a top perspective view of the base portion of the container of FIG. 1A according to one or more aspects described herein.

The base portion 4 further includes a second end 18 defining an opening 19 (shown in FIG. 3). The opening 19 is configured to allow access to an interior void 21 of the container 2 formed by the sidewall structure 6 and the bottom portion 20.

The container 2 may include a lid 5. The lid 5 is pivotable between an open configuration and closed configuration. In some embodiments rotating the lid from the closed configuration to the open configuration includes rotating the lid about 90° from the closed configuration, or about 180° from the closed configuration, or about 270° from the closed configuration. As shown in FIG. 1, the opening 19 may be covered by lid 5, when the container is in use (e.g., when the container is in a closed configuration). In some arrangements, the lid 5 may connect to the base 4 in a closed configuration using a press fit. Additionally, or alternatively, other securing systems or devices may be used to secure the lid 5 to the base 4, as will be discussed more fully herein.

In some examples, the lid 5 may be hinged such that it is connected to (either removably or permanently) the base 4 at a hinge 37 and may be rotated about the hinge 37. The hinge 37 may be one of various types of hinges, including a continuous piano hinge, double hinge, ball joint hinge, living hinge, and the like. These and various other hinge arrangements may be discussed more fully herein. The hinge 37 may permit the lid 5 to be opened and rotated away from the base portion 4, to allow access to the void defined by the base portion 4 (e.g., via opening 19). That is, the hinge 37 may facilitate rotation of the lid 5 from a closed configuration of the container (e.g., when the lid is in place covering the void 21 formed by the base 4, as shown in FIG. 1A) to an open configuration (e.g., when the lid is not covering the void 21 formed by the base 4, as shown in FIG. 1B), and vice versa.

In addition, in some arrangements, the container 2 may include a gasket 30 or other sealing device. The gasket 30 may be arranged in either the lid 5 or the base 4 and may aid in sealing the lid 5 and base 4 when the lid 5 is in a closed configuration. For example, in one embodiment, the container 2 may be manufactured such that it is dust tight when tested for 8 hours and/or waterproof when tested for 30 minutes under 1 meter of water. In some embodiments, the container 2 may be capable of achieving an IP67 (as set forth by International Electrotechnical Commission) rating which specifies that there is no ingress of dust or complete protection from dust when tested for 8 hours and ingress of water in harmful quantities is not possible when the enclosure is immersed in water under defined conditions of pressure and time (up to 1 m of submersion). The IP67 dust test is 8 hours long and the enclosure is tested in a vacuum. The IP67 water test is 30 minutes long and the enclosure is tested with the lowest point of the enclosure 1000 mm below the surface of the water, or the highest point 150 mm below the surface whichever is deeper In some examples, (and as best shown in FIGS. 10A-11C) the gasket 30 may be seated in a recess 32 formed in at least one of the base 4 and the lid 5 and extending around a perimeter of the at least one of the base 4 or the lid 5. Additionally, in some example, the container 2 may include a ridge 34 in the opposite of the base 4 or the lid 5 and extending around a perimeter of the base 4 or the lid 5. The gasket 30 may be placed between the recess 32 and the ridge 34. The gasket 30 may aid in maintaining a seal between the interior of the container 2 and the outside environment, and in some examples may aid in maintaining the temperature of the articles contained within the container 2. One example gasket arrangement is shown in FIGS. 10A-11C, although this and various other gasket arrangements may be used with any of the containers described herein.

As shown, the gasket 30 is arranged in a recess or channel 32 in the lid 5. Alternatively, the gasket 30 may be arranged in a recess or channel formed in the base 4. When the lid 5 is in a closed configuration, the ridge 34 having a shape corresponding to recess 32 may contact the gasket 30 and compress the gasket 30 and aid in sealing the lid 5 and base 4 in the closed configuration. In some examples, the gasket 30 may be a traditional gasket having a substantially circular cross section. In other arrangements, the gasket 30 may include strategically placed cut-outs that may reduce or eliminate a need for a vent (e.g., a vent to prevent lid lock).

Figure 4B:
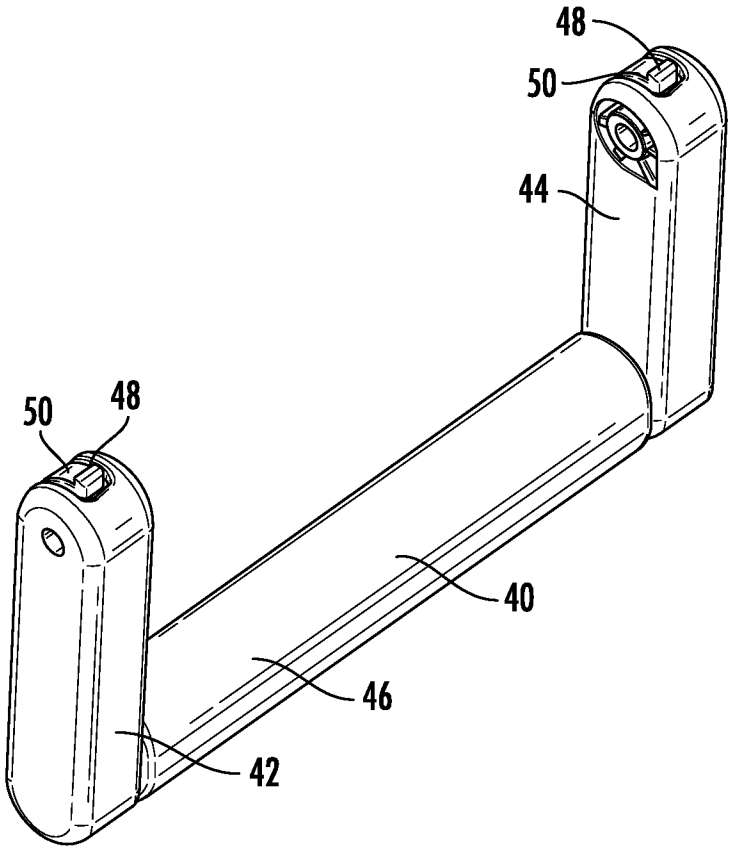
FIG. 4B is a top perspective view of a handle of the container of FIG. 1A according to one or more aspects described herein.
Figure 4A:
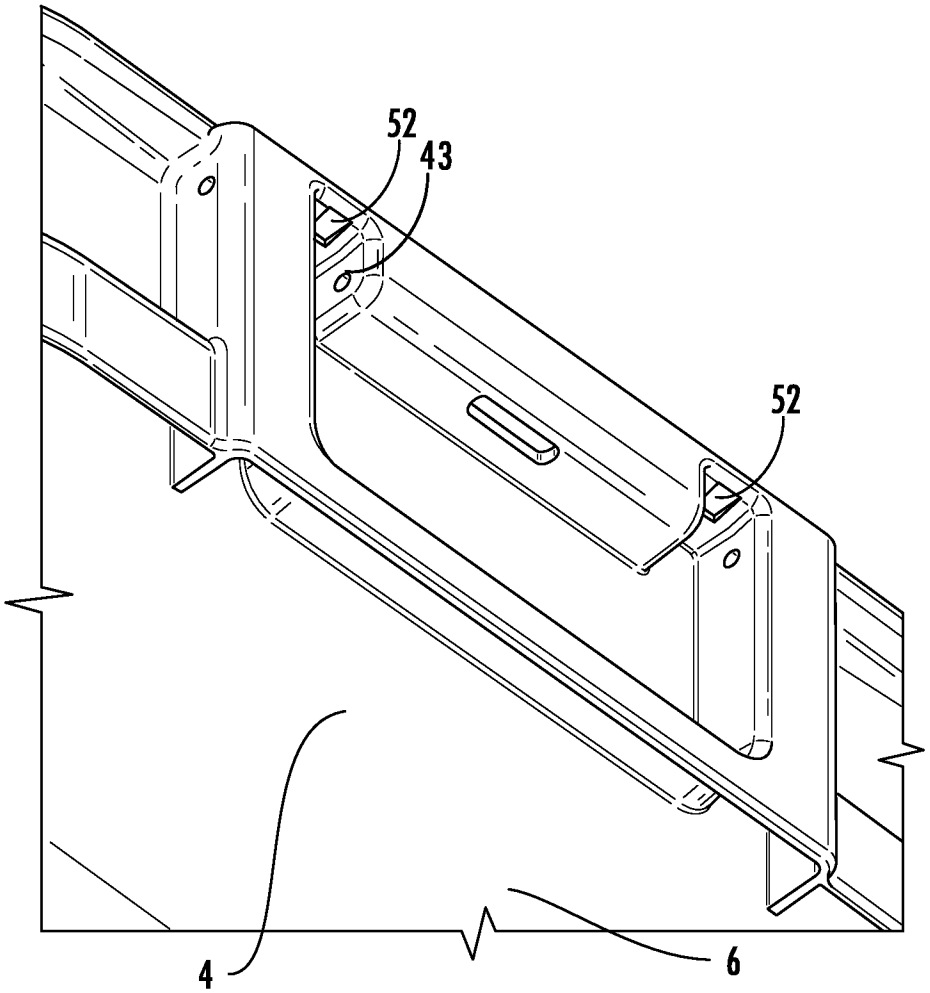
FIG. 4A is a bottom perspective view of a portion of the base portion of the container of FIG. 1A according to one or more aspects described herein.
Figure 4D:
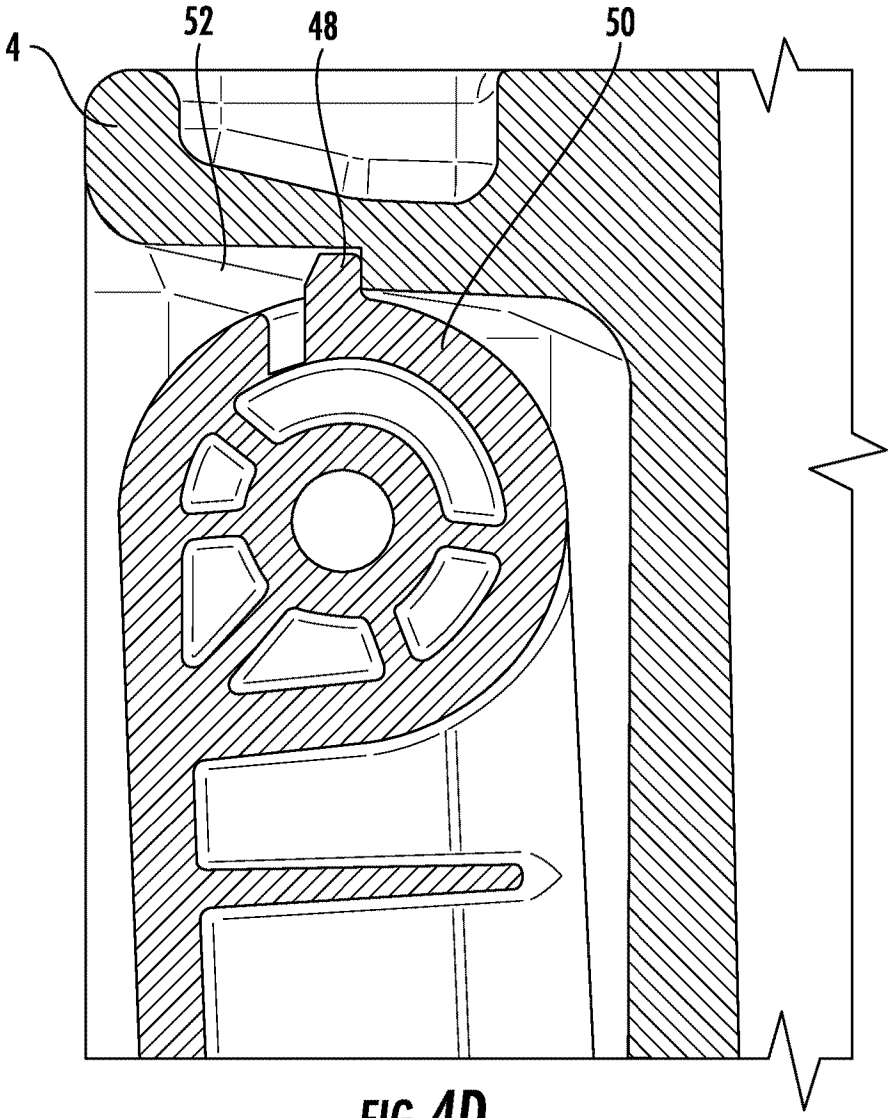
FIG. 4D is a side cross-sectional view of a portion of a handle and a container according to one or more aspects described herein.
Figure 4C:
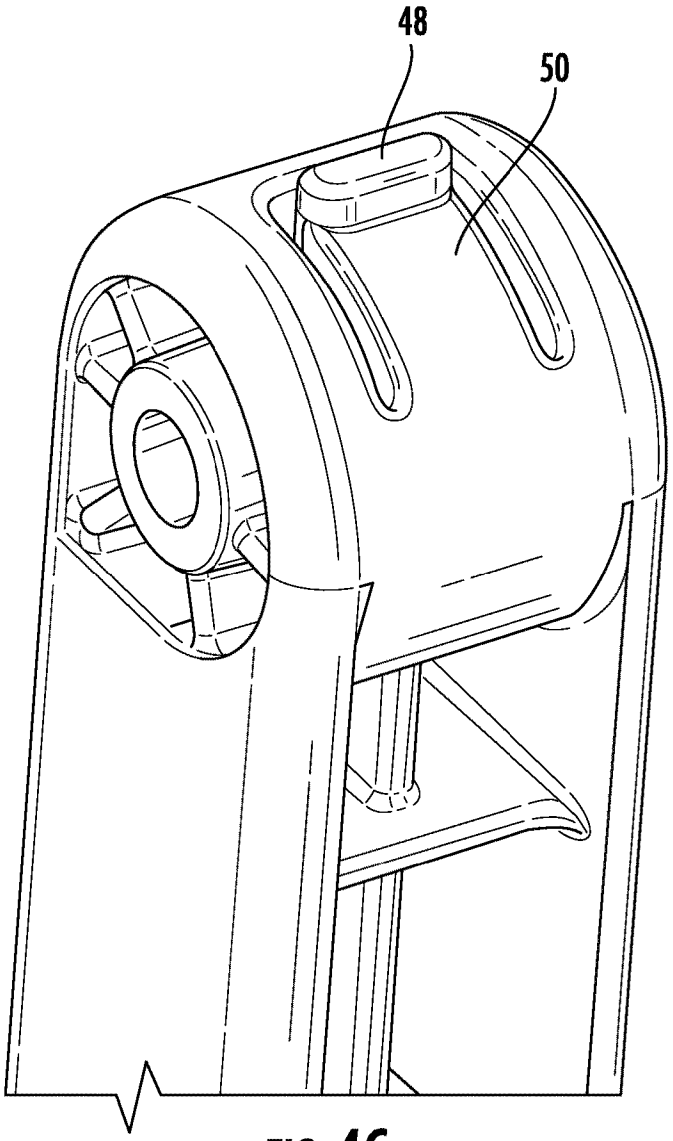
FIG. 4C is a top perspective view of portion of a handle according to one or more aspects described herein.

In some arrangements the container 2 may include additional features, such as one or more handles 40. The handles may be arranged on one or more portions of the sidewall structure 6, including on opposing sides, such as sides 12 and 14, as shown. As best shown in FIGS. 4A-4D the handles 40 may be constructed of first and second arms 42, 44 connected by a gripping member 46. The handle 40 may be pivotable about a hinge 43 passing through a portion of the sidewall structure 6 and through each of the first and second arms 42, 44. The handle 40 may also include features to reduce movement of, and possible rattling noise associated with, the handle when the handle is not in use. As shown in FIGS. 4A-4D, one or both of the arms 42, 44 may include a raised portion 48 at a distal end of the arm. In some embodiments the raised portion 48 may be attached to a resilient member 50. As best shown in FIGS. 4A and 4D, the container 2 may include a recessed portion 52. The raised portion 48 may be configured to be located within the recessed portion 52 of the sidewall structure 6 when the handle 40 is not in use. This may reduce movement of the handle 40 when the handle is not in use. However, when a user moves the handle 40 for use, the resilient member 50 may retract and allow the user to rotate the handle outward.

In other examples, as shown in FIGS. 14-16B and as will be discussed in more detail below, the handles 240 may be integrally molded with the base portion 204 and in some examples may generally be an undercut formed in the sidewall structure of the base 204. In some examples, the undercut forming the handle may include a recess extending along substantially all or a majority of the sidewall structure 6. This may provide ease of manufacturing the base 204 with the integrally molded handles 240. In some examples, the integrally molded handles 240 may be flush with an exterior surface of the base 204 in order to reduce the risk of breakage.

Figure 5B:
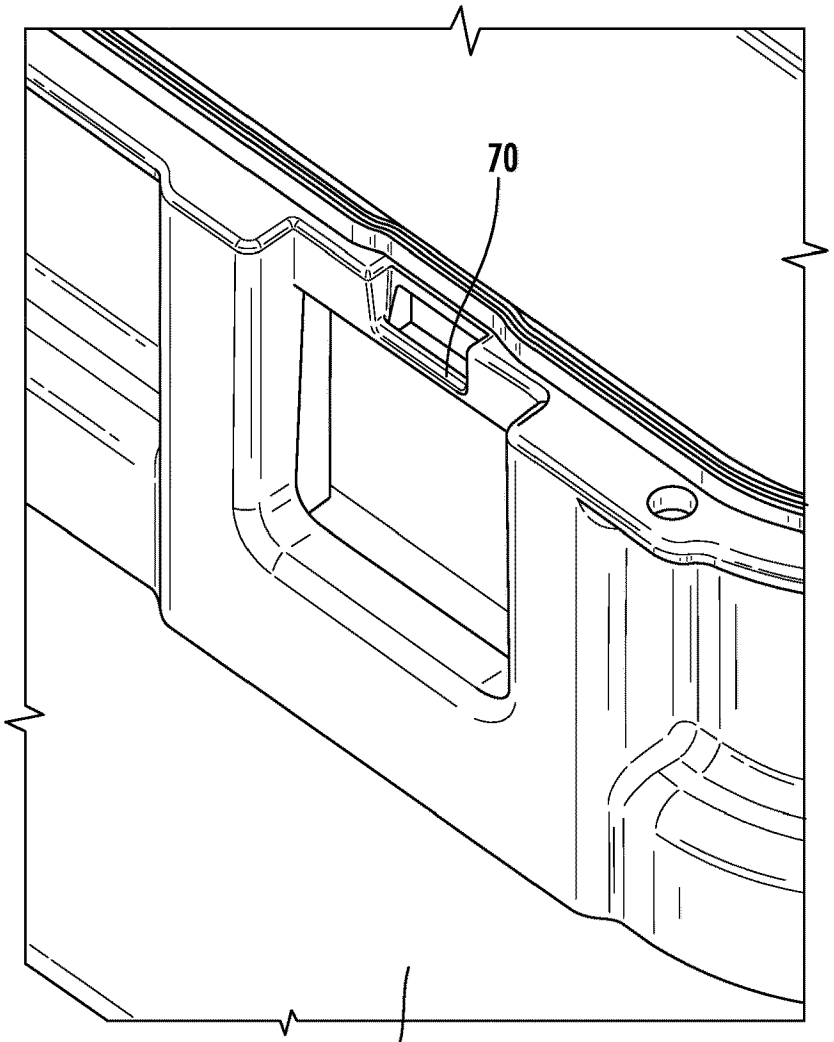
FIG. 5B is a top perspective view of a portion of the base portion of the container of FIG. 1A according to one or more aspects described herein.
Figure 5A:
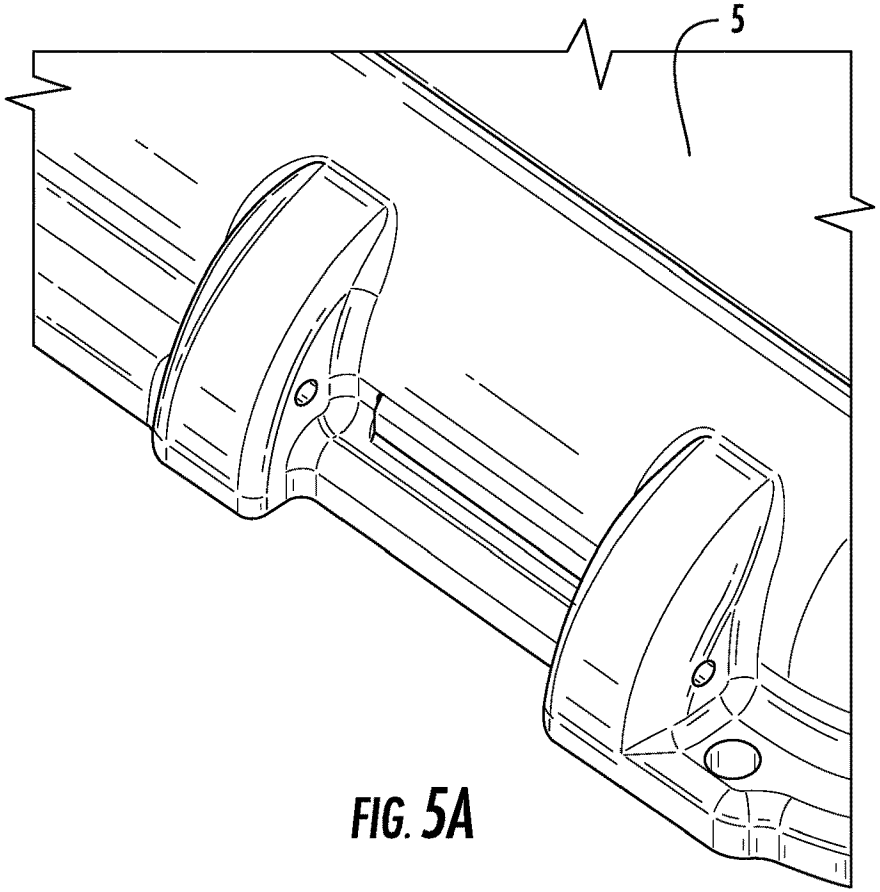
FIG. 5A is a top perspective view of a portion of the lid of the container of FIG. 1A according to one or more aspects described herein.
Figure 6B:
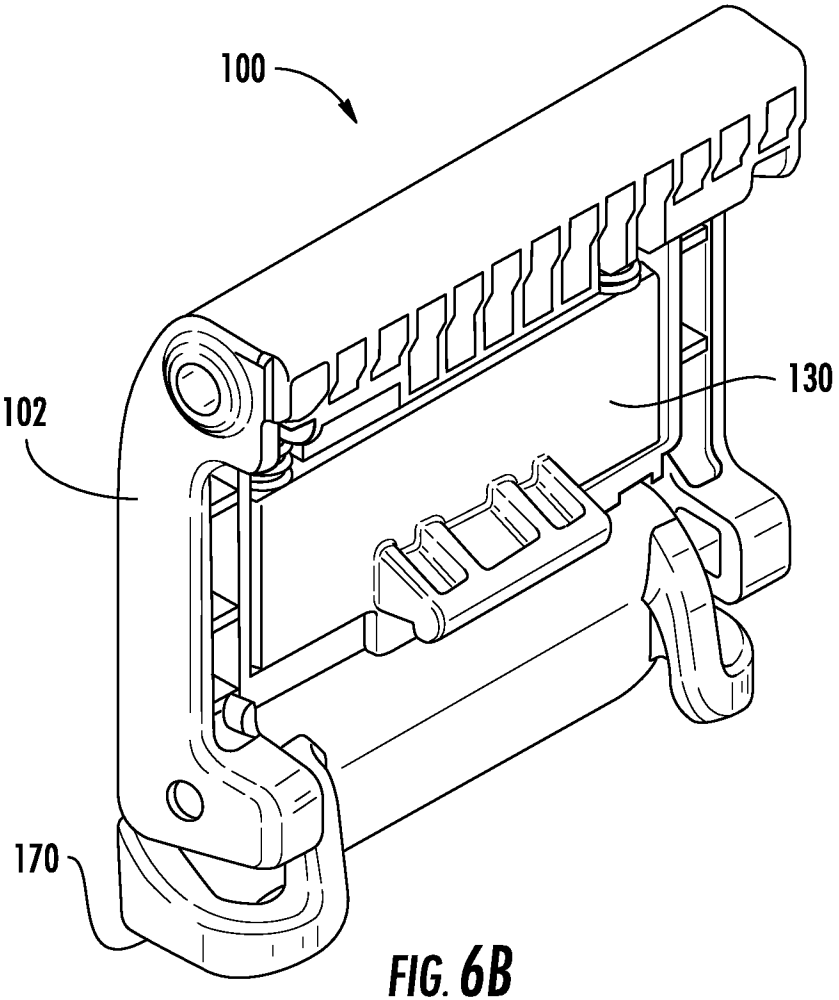
FIG. 6B is a top rear perspective view of a latch assembly according to one or more aspects described herein.
Figure 6A:
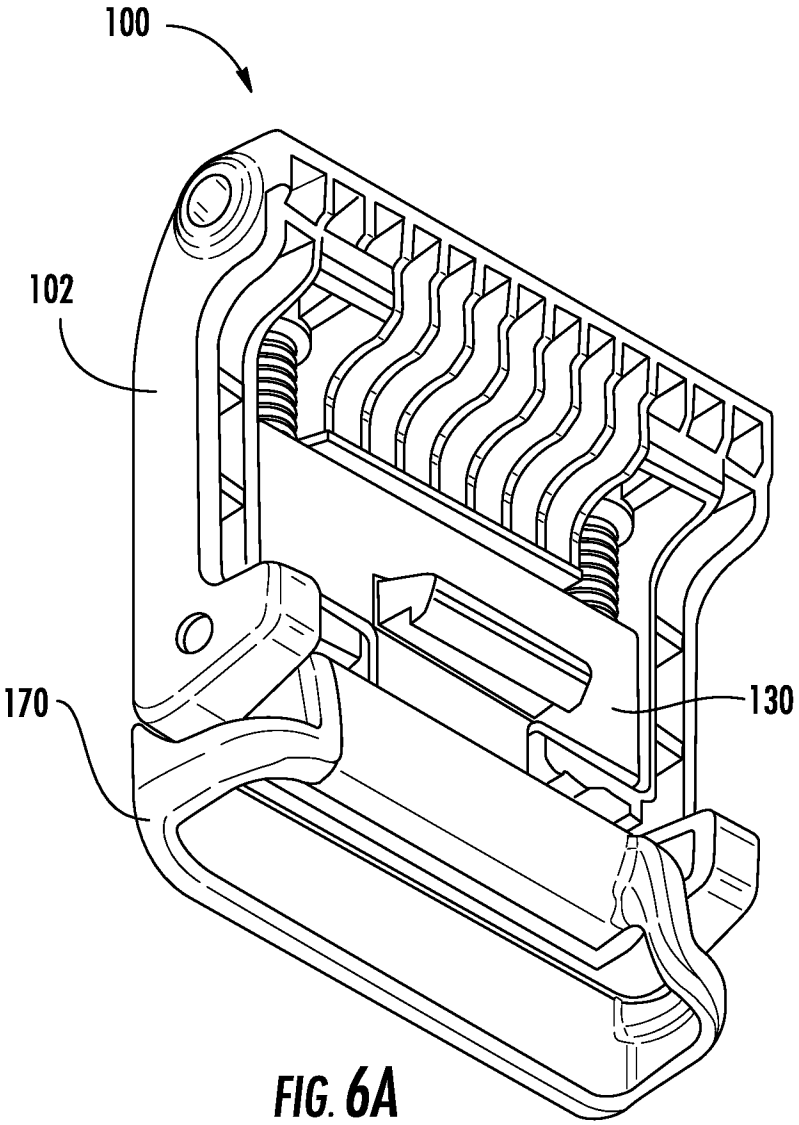
FIG. 6A is a bottom rear perspective view of a latch assembly according to one or more aspects described herein.
Figure 7B:
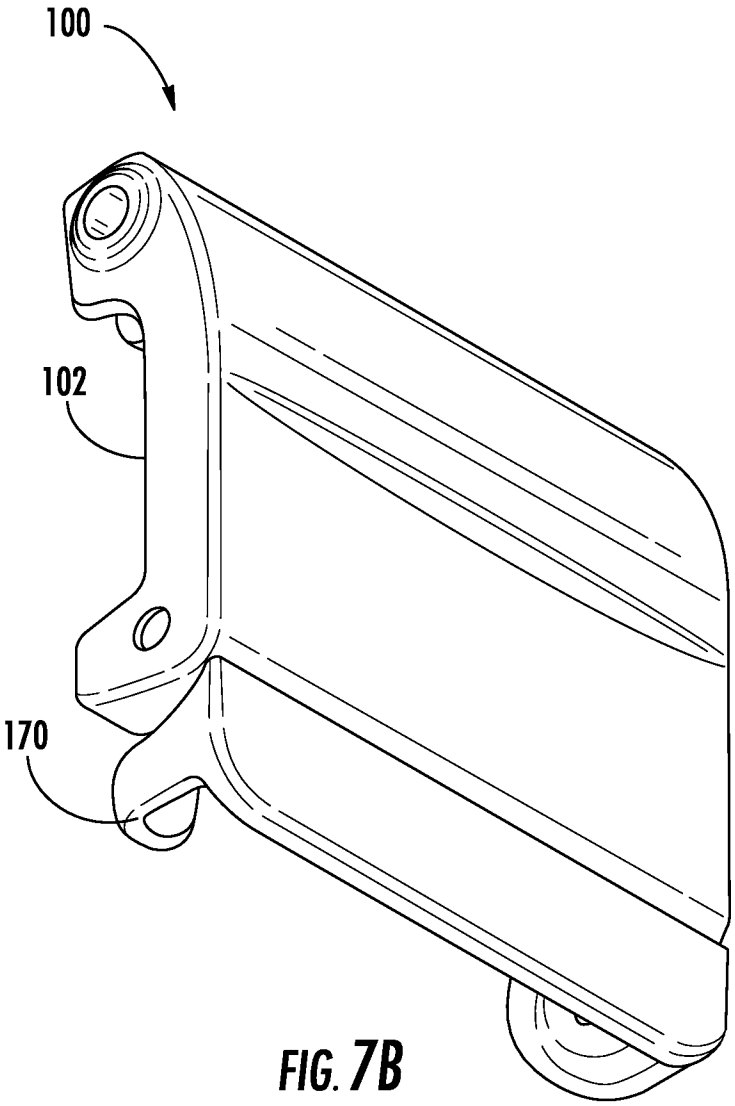
FIG. 7B is a bottom front perspective view of a latch assembly according to one or more aspects described herein.
Figure 7A:
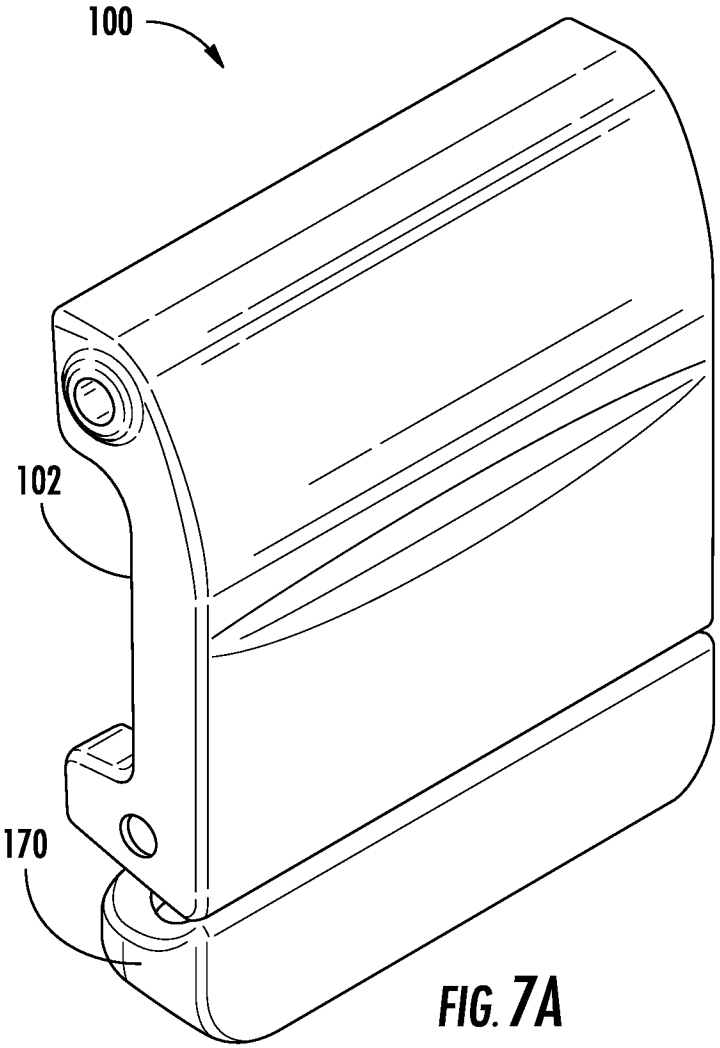
FIG. 7A is a top front perspective view of a latch assembly according to one or more aspects described herein.
Figure 9:
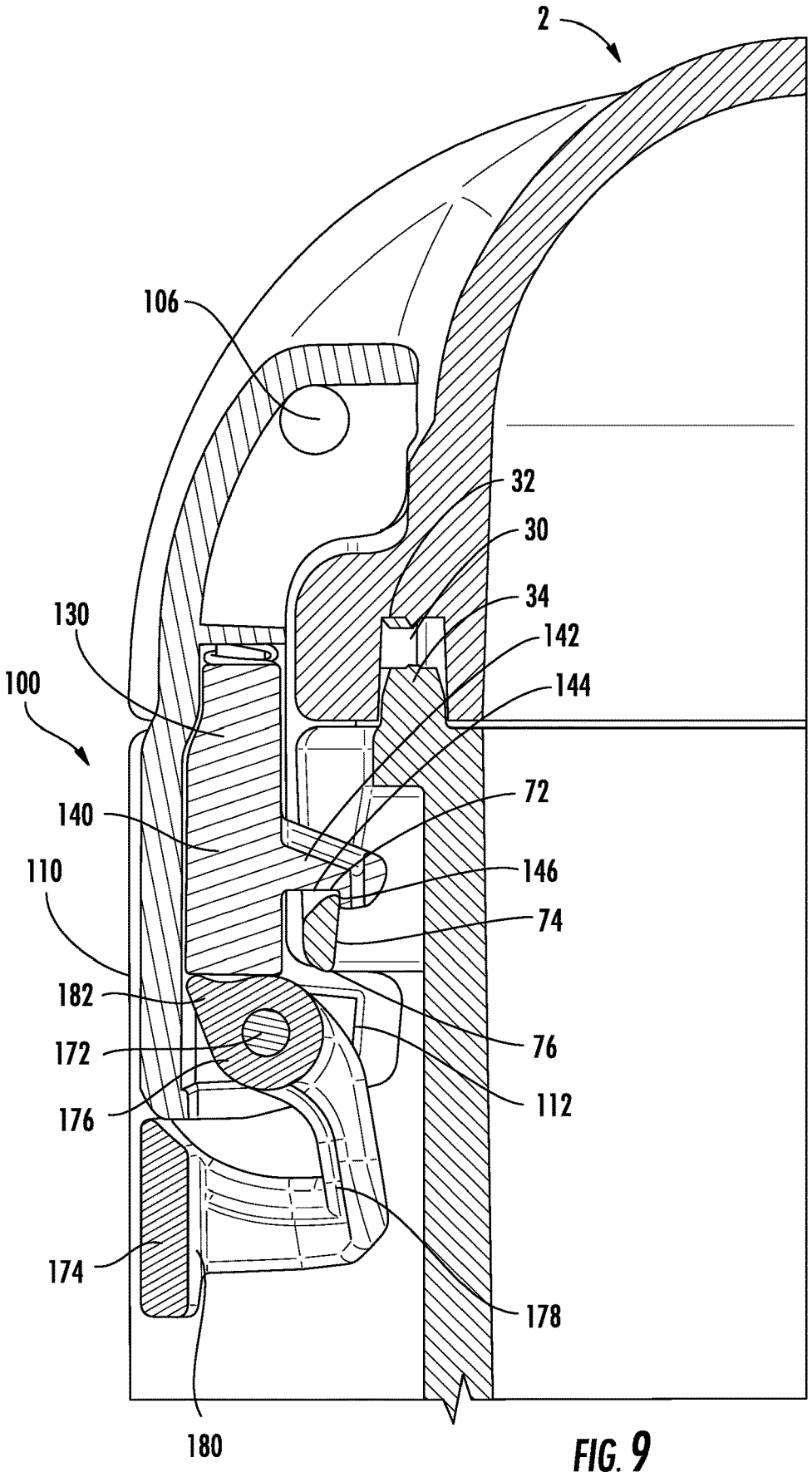
FIG. 9 is a side cross-sectional view of a latch assembly according to one or more aspects described herein.

In some arrangements, the container 2 may also include one or more latch assemblies 100. The latch assemblies 100 may have a locked position and an unlocked position and may be configured to lock the lid 5 when the lid 5 is in a closed configuration. The latch assemblies 100 may include one or more portions integrally formed with or otherwise attached to the container 2. As shown in FIGS. 5B and 9, the container 2 may include a latch keeper 70. The latch keeper 70 may extend from the sidewall structure 6 and may form a pocket within the container 2. The latch keeper 70 pocket has a shape configured to receive a portion of the locking member 130 as will be discussed in more detail below. The latch keeper may have an upper surface 72, an inner surface 74 and a lower surface 76. As will be discussed in greater detail below, the latch assemblies 100 may engage the latch keeper 70 to lock the lid 5 to the base 4 when the container 2 is in a closed configuration.

The container 2 may also include various features to improve the strength and/or functioning of the container 2. For example, the container may include various raised portions wherein certain portions of the base 4 and/or lid 5 extend further outward than other parts of the base 4 and/or lid. As best shown in FIGS. 1A, 1B, 2A, and 2B, the base 4 may include a J-shaped raised portion or wall 59 forming a channel 60, the raised wall 59 engaged with the sidewall structure 6. The channel 60 may surround the entire perimeter of the container 2. The channel 60 may also include strengthening members 62 at various locations within the channel. The channel 60 formed by the J-shaped wall 59 may increase the strength of the container 2, or the base 4. In some embodiments, and as shown for example in FIG. 2B, the J-shaped wall 59 may allow for the base 4 to be constructed such that the interior surfaces 6A of the sidewall structure 6 are substantially smooth throughout the interior portion of the container 2. Thus, for example, substantially all or all of the interior surface 6A of sidewall structure 6, including one or all of the first side 8, a second side 10 opposite the first side, a third side 12, may be substantially flat and/or smooth.

The container 2 may also include raised portions 64, 66 surrounding the latching assemblies 100 and handles 40 respectively. As shown in FIG. 4, the raised portions 64, 66 may exist on one or both of the base 4 or lid 5. The raised portions 64, 66 may be raised equal to or greater than the height of the latching assemblies 100 and handles 40 respectively, such that that latching assemblies 100 and/or handles 40 do not extend outward beyond the raised portions 64, 66 of the container 2. This may protect the latching assemblies 100 and/or handles 40 and reduce breakage of these components during use.

The container 2 may be configured to contain, store, carry, etc., items including food, beverages, or any other items. Additionally or alternatively, the container 2 may be configured to store materials in a solid or a gaseous state, or combinations thereof, without departing from the scope of the disclosure described herein.

The container 2 including the base 4 and lid 5 may be formed from various materials, such as one or more metals, alloys, polymers, ceramics, or fiber-reinforced materials. In some examples, the base 4 and lid 5 may be formed of a plastic material, such as polyethylene, that is molded to form both the base 4 and lid 5 portions. In some arrangements, the outer shells of the base 4 and lid 5 portions are formed using injection molding or roto-molding/rotational molding processes as would be understood by one of ordinary skill in the art (not shown). However, various other types of molding or other manufacturing processes (e.g., stamping, casting, forging, and the like) may be used to form the container 2 without departing from the invention.

In some arrangements herein, the base 4 and lid 5 may include an exterior surface or outer shell surrounding and enclosing an insulating portion (not shown), thus forming an insulating container. The outer shell may be typically formed from various materials, such as one or more metals, alloys, polymers, ceramics, or fiber-reinforced materials. In some examples, the outer shell may be formed of a plastic material, such as polyethylene, that is molded to form both the base 4 and lid 5 portions. In some examples, the insulating portion (not shown) may be formed of an insulating material that exhibits low thermal conductivity. For instance, the insulating portion may be formed of (or filled with) a polymer foam, such as polyurethane foam. Additional or other insulating materials may be used without departing from the invention, including for example, vacuum insulated panels. In some arrangements, the outer shells of the base 4 and lid 5 portions may be formed using an injection molding or roto-molding/rotational molding processes as would be understood by one of ordinary skill in the art (not shown). However, various other types of molding or other manufacturing processes (e.g., stamping, casting, forging, and the like) may be used to form the container without departing from the invention.

Figure 8:
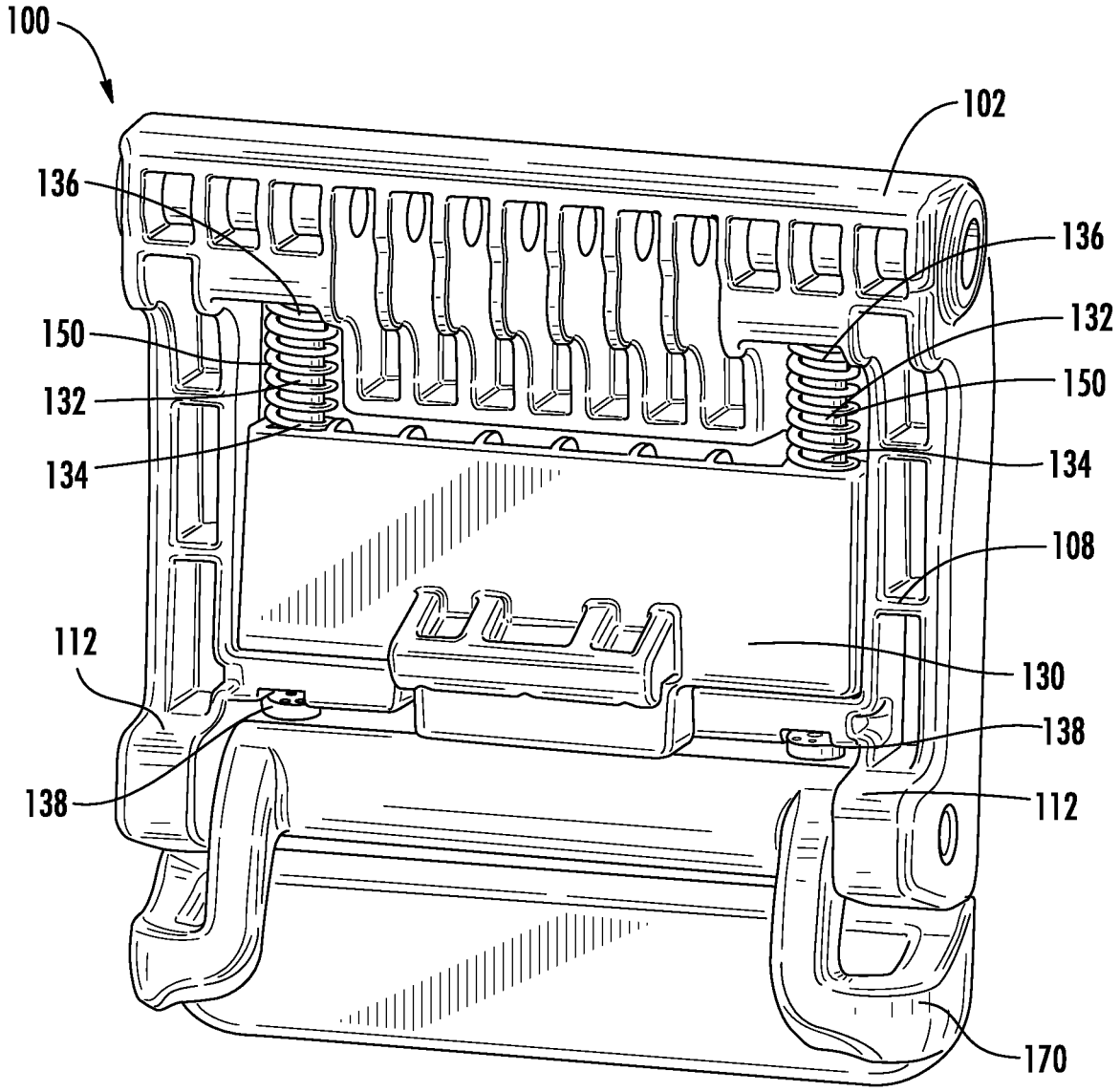
FIG. 8 is a rear perspective view of a latch assembly according to one or more aspects described herein.

Referring now more specifically to the latch assembly 100, as best shown in FIG. 8 and FIG. 9, the latch assembly 100 may include multiple components including a latch body 102, a locking member 130, a biasing member 150, and an activating member 170. As discussed above, the latch assembly 100 may include a locked position and an unlocked position.

The latch body 102 may be pivotally engaged with the lid 5. As shown in FIG. 9, the latch body may be pivotally engaged with the lid 5 using hinge 106, however, any suitable pivotal engagement may be used. In some embodiments, the hinge 106 may be removably engaged with the container 2. This hinge 106 may allow a user to easily remove and replace the latch assembly 100 if it becomes damaged. The latch body 102 may include an inner surface 108 and an outer surface 110. The outer surface may be curved and may generally follow the curve of the sidewall structure 6 of the container 2. As discussed above the outer surface 110 of the latch body 102 may, in some examples, not extend outward of the outer edge of the sidewall structure 6 of the container 2. The inner surface 108 may also be curved and may also include a number of different features. One exemplary feature that may be included on the latch body 102 may be one or more engagement lugs 112. As will be discussed in more detail below the engagement lugs 112 may engage the container base 4, or latch keeper 70, and may assist in compressing the lid 5 against the base 4 of the container 2.

The latch body 102 may also be engaged with the locking member 130. As shown in FIG. 8, the locking member 130 may be slidably engaged with the latch body 102 such that the locking member 130 may move between an upward position and a downward position in a substantially linear path. The locking member 130 may be configured to lock the lid 5 in a closed configuration when the locking member 130 is in the downward position and unlock the lid 5 when the locking member 130 is in the upward position.

As shown primarily in FIG. 8, the locking member 130 may be movably engaged with one or more guide members 132 such that the locking member 130 may slide up and down the guide members 132. In one embodiment, the locking member 130 may include apertures 134 passing through the locking member 130 and through which the guide members 132 may also pass. The guide members 132 may be engaged with the latch body 102 at a top end 136 and at a bottom end 138. As shown in FIG. 8 the guide members 132 are cylindrical rods but any suitable shape may be used that permits upward and downward movement of the locking member 130. For example, guide members 132 may be prismoidal or substantially prismoidal (e.g., a pentagonal prism, hexagonal prism, heptagonal prism, or the like) in shape. In still other examples, the latching assembly 100 may include other devices suitable for allowing generally linear movement between the locking member 130 and the latch body 102, including for example, rails.

As shown in FIG. 8, the latch assembly 100 may also include at least one biasing member 150 engaged with the latch body 102 and the locking member 130. As will be discussed in more detail below, the biasing member 150 is configured to bias the locking member 130 in a downward position. The biasing member 150 may be a compression spring as shown in FIG. 8, but may in alternative embodiments be any suitable device for biasing the locking member 130 in the downward position.

The locking member 130 may include a base portion 140 and a hook portion 142 extending inwards from the base portion 140. The hook portion 142 may include a lower surface 144 and an inward facing surface 146. As shown in FIG. 9, when the latch assembly 100 is in the locked position, the lower surface 144 of hook portion 142 of the locking member 130 may engage the upper surface 72 of the latch keeper 70 and the inward facing surface 146 of the hook portion 142 may engage the inner surface 74 of the latch keeper 70. Additionally, when the latch assembly 100 is in the locked position the upper surface of the engagement lugs 112 may engage the lower surface 76 of the latch keeper 70.

The latch body 102 may also be pivotally engaged with an activating member 170. The activating member 170 may also be engaged with the locking member 130 and may be configured to move the locking member 130 from the downward position to the upward position. As shown in FIGS. 8 and 9, the activating member 170 may be pivotally engaged to the latch body 102 by a hinge 172 extending through the latch body 102 and the activating member 170. The activating member 170 may include a grip portion 174, an activating barrel 176, and one or more arms 178 connecting the grip portion 174 and the activating barrel 176. As shown in FIG. 9, the grip portion 174 is spaced a distance from the sidewall structure 6 of the container 2. This distance may allow a user grip the back surface 180 of the grip portion 174 with their fingers placed between the sidewall structure 6 and the grip portion 174. As shown in FIG. 9, the activating barrel 176 of the activating member 170 may engage the locking member 130. The activating barrel 176 may include a raised portion 182. As will be discussed in greater detail below, a user may pull the grip portion 174 of the activating member 170 forward causing the raised portion 182 of the activating barrel 176 to rotate and lift up the locking member 130. This movement causes the latch assembly 100 to unlock and allows the lid 5 to be moved from the closed configuration to an open configuration.

Figure 10B:
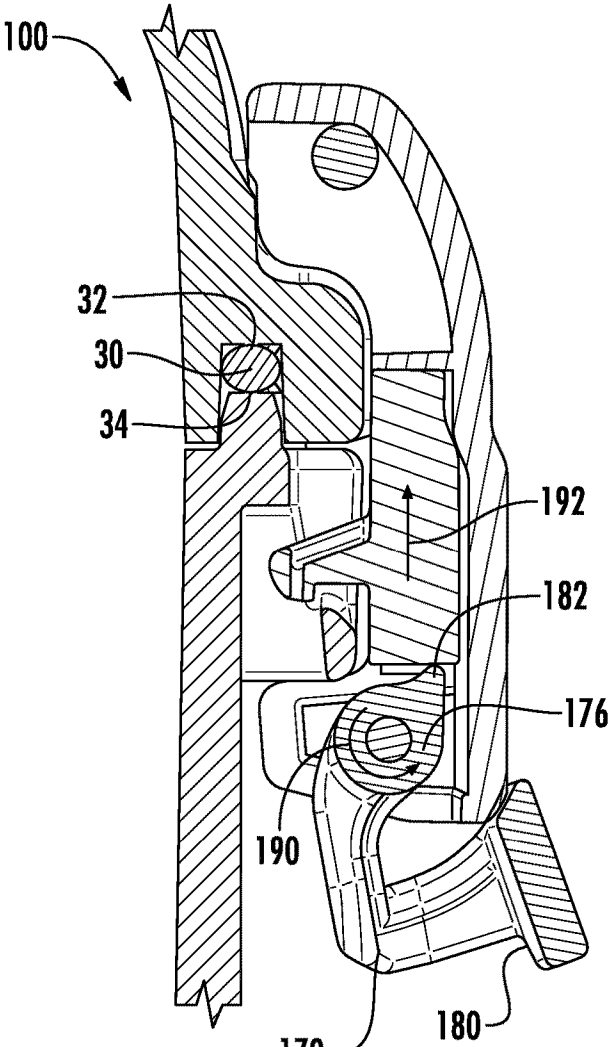
FIGS. 10A-10D illustrate side cross-sectional views of movement of a latch assembly from a locked position to an unlocked position according to one or more aspects described herein.
Figure 10A:
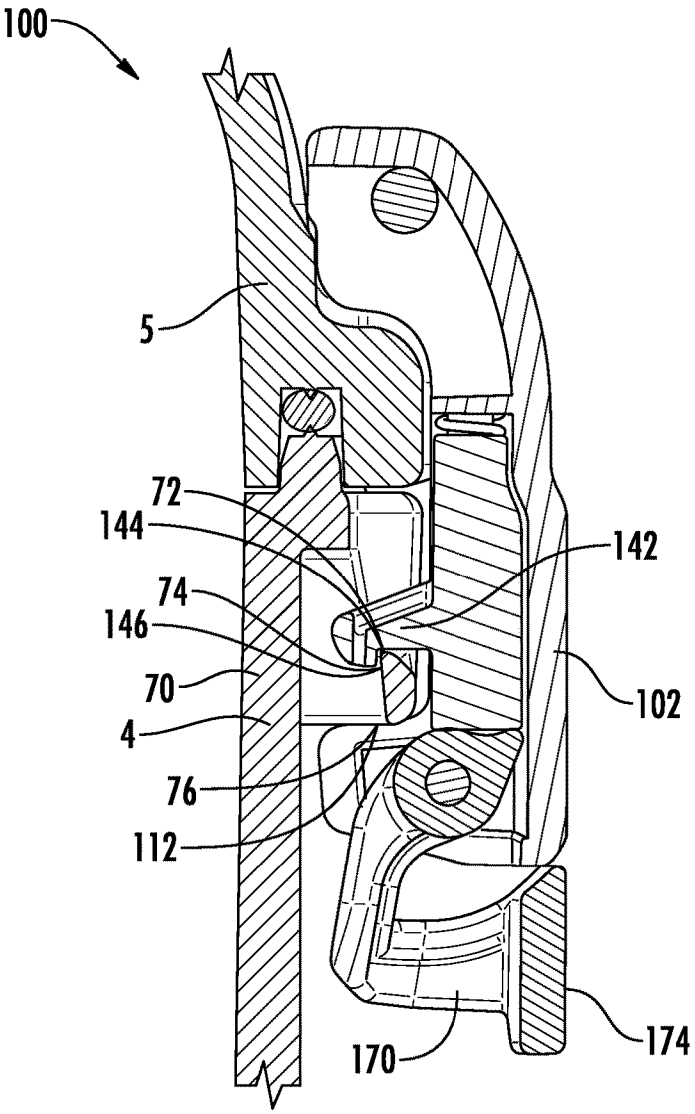
Figure 10D:
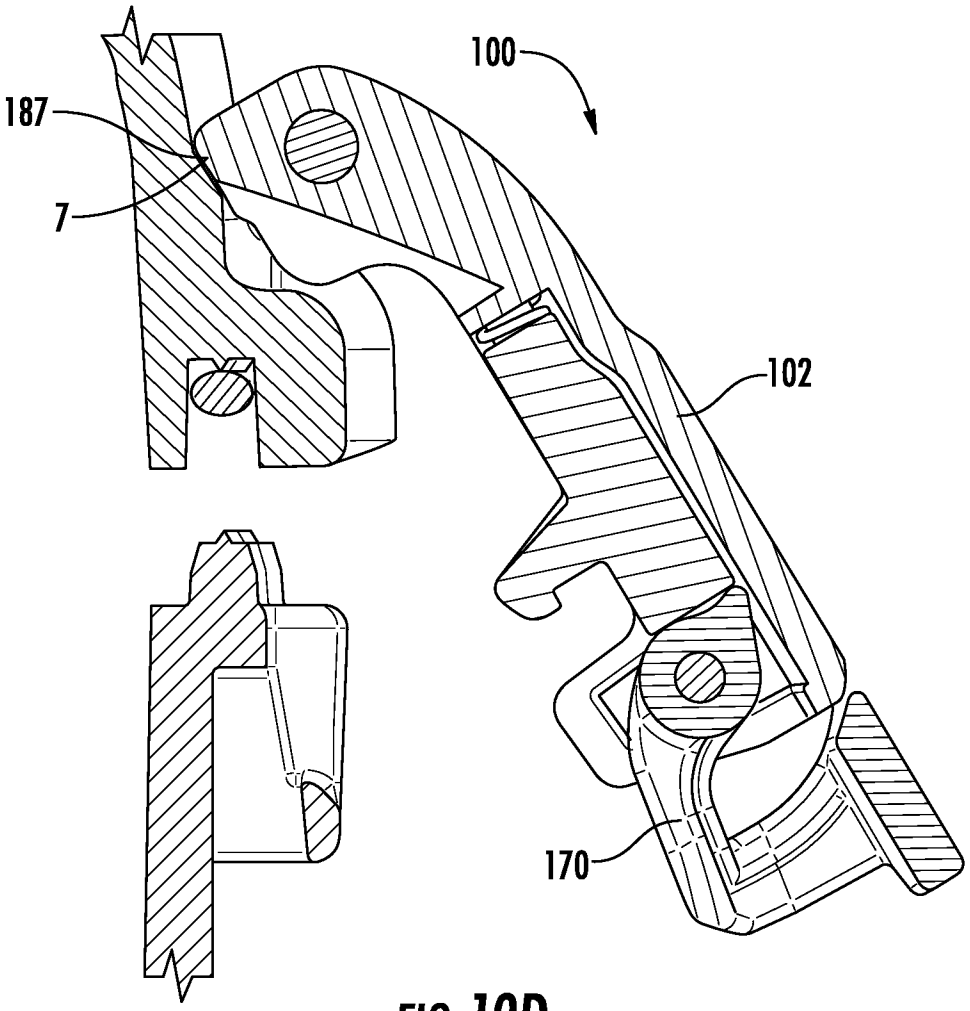
Figure 10C:
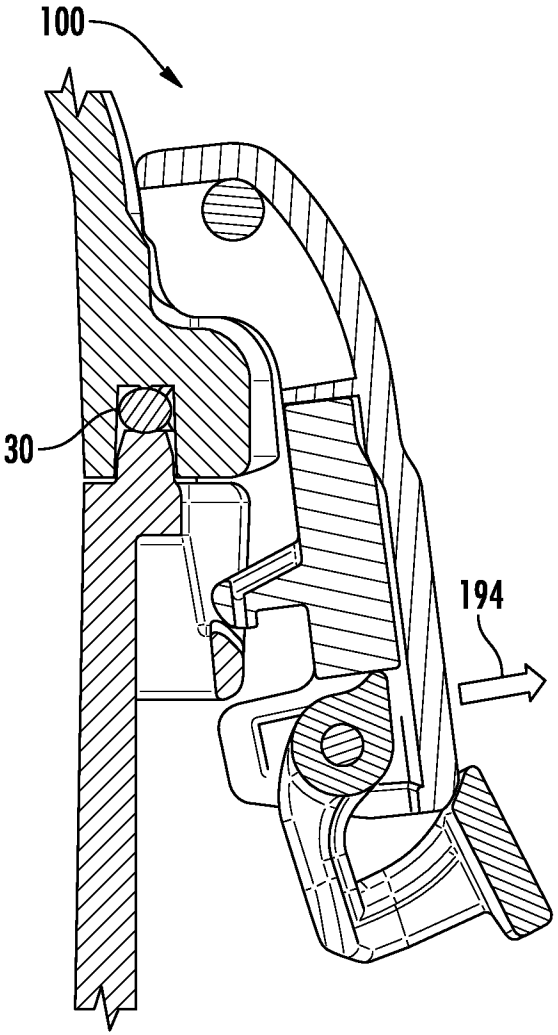

Referring now to FIGS. 10A-10D, a procedure for moving an embodiment of the latch assembly 100 from the locked position to an unlocked position is shown with side cross-sectional views of the latch assembly 100 and portions of the base 4 and lid 5. FIG. 10A depicts the latch assembly 100 in the locked position, FIG. 10B depicts the latch assembly 100 unlocking, FIG. 10C depicts the latch assembly 100 in an unlocked position, and FIG. 10D depicts the latch assembly 100 in an unlocked position and demonstrates an anti-rotation feature. As shown in FIG. 10A, in the locked position, the lower surface 144 of hook portion 142 is engaged with the upper surface 72 of the latch keeper 70; the inward facing surface 146 of the hook portion 142 is engaged with the inner surface 74 of the latch keeper 70; and the engagement lugs 112 are engaged with the lower surface 76 of the latch keeper 70.

As shown in FIG. 10B, the latching assembly 100 may be moved to the unlocked position by rotating the activating member 170 as shown with arrow 190. This rotation may be accomplished by a user pulling forward on back surface 180. As shown in FIG. 10B, as the activating barrel 176 rotates, the raised portion 182 engages the locking member 130 and raises the locking member 130. As shown in FIG. 10C, the latching assembly 100 is in an unlocked position. As the locking member 130 raises above latch keeper 70, the latch assembly 100 becomes unlocked and the latch body 102, including the locking member 130 and the activating member 170, may rotate forward as indicated by arrow 194.

FIG. 10D depicts an anti-rotation feature of the latch assembly 100 and container 2. As shown in FIG. 10D the latch assembly 100 is in the unlocked position and has been rotated further outward from the position shown in FIG. 10C. To restrict the rotation of the latch assembly 100, the latch body 102 may include a back surface 187 configured to engage an anti-rotation surface 7 of the lid once a user has rotated the latch assembly 100 a certain rotation away from the locked position. For example, the back surface 187 may be configured to engage the anti-rotation surface 7 when a user has rotated the latch assembly 100 at least 20 degrees from the locked position, or at least 30 degrees from the locked position, or at least 45 degrees from the locked position, or at least 90 degrees from the locked position. Advantageously this anti-rotation feature may also allow a user to utilize the latch assembly 100 as a handle to open the container 2.

Figure 11C:
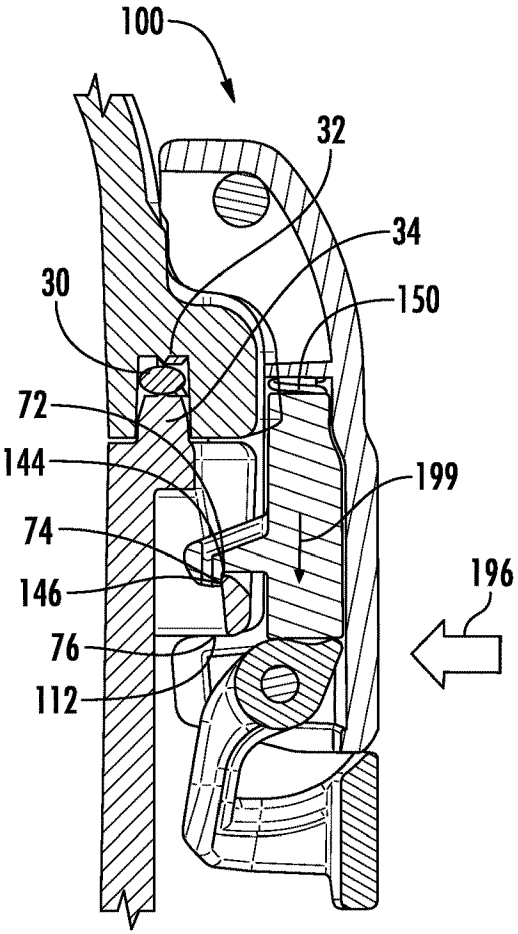
FIGS. 11A-11C illustrate side cross-sectional views of movement of the latch assembly of FIGS. 10A-10D from an unlocked position to a locked position according to one or more aspects described herein.
Figure 11B:
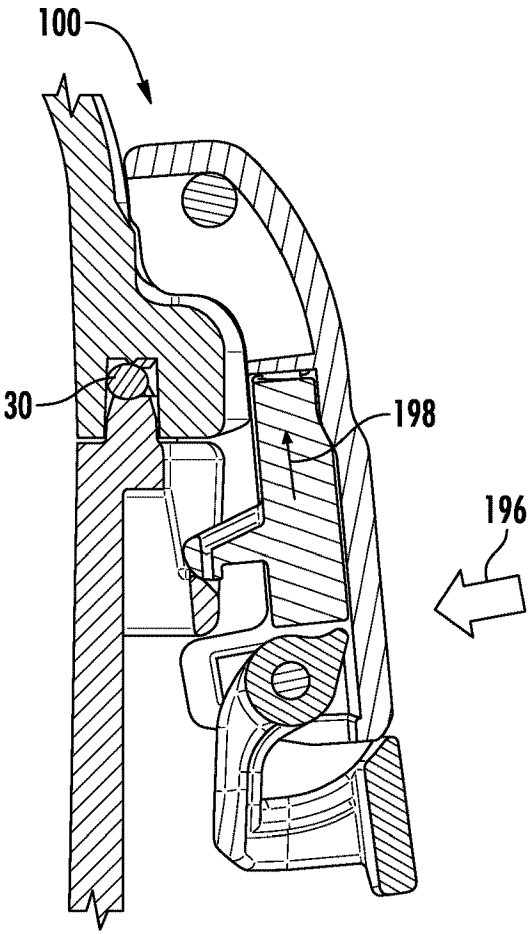
Figure 11A:
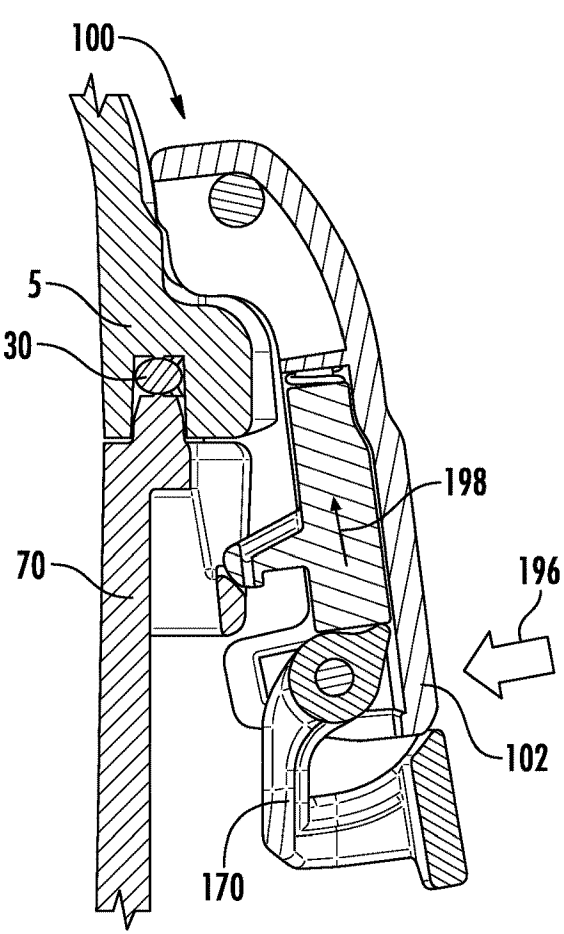

Referring now to FIGS. 11A-11C, a procedure for moving the latch assembly 100 from an unlocked position to locked position is shown with side cross-sectional views of the latch assembly 100 and portions of the base 4 and lid 5. FIG. 11A depicts the latch assembly 100 in an unlocked position, FIG. 11B depicts the latch assembly 100 locking, and FIG. 11C depicts the latch assembly 100 in locked position.

As shown in FIG. 11A, and as indicated by arrow 196, in one embodiment a user may return the latching assembly 100 to the locked position by pressing on latch body 102. As shown in FIG. 11B, as the latch body 102 is pressed inward, the locking member 130 may contact the latch keeper 70 which may cause the locking member 130 to raise upward as indicated by arrow 198. In other examples, in addition to pushing the latch body 102 inward, a user must also pull activating member 170 outward to move the latch assembly 100 to the locked position. In such an embodiment, the latch assembly 100 may advantageously only be moved from the unlocked position to the locked position when the locking member 130 is moved in the upward position by the activating member 170. This may reduce the possibility of accidently locking the container 2.

As shown in FIG. 11C, once the hook portion 142 has moved behind the raised portion of the latch keeper 70, the biasing members 150 may push the locking member 130 in a downward direction. As shown in FIG. 11C, the latch assembly 100 is in the locked position and the lower surface 144 of hook portion 142 is engaged with the upper surface 72 of the latch keeper 70; the inward facing surface 146 of the hook portion 142 is engaged with the inner surface 74 of the latch keeper 70; and the engagement lugs 112 are engaged with the lower surface 76 of the latch keeper 70. When in a closed position, the latching assembly 100 is positioned such that the lid 5 abuts the base 4 of the container 2, thus closing, securing, and/or sealing the container 2. Additionally, as the latch assembly moves from the unlocked position (FIG. 11A) to the locked position (FIG. 11C) the gasket 30 is compressed between the lid 5 and the base 4 of the container 2. Thus, when the latch assembly 100 is in a locked position the gasket 30 is more compressed than when the latch assembly 100 is in an unlocked position.

Figure 12C:
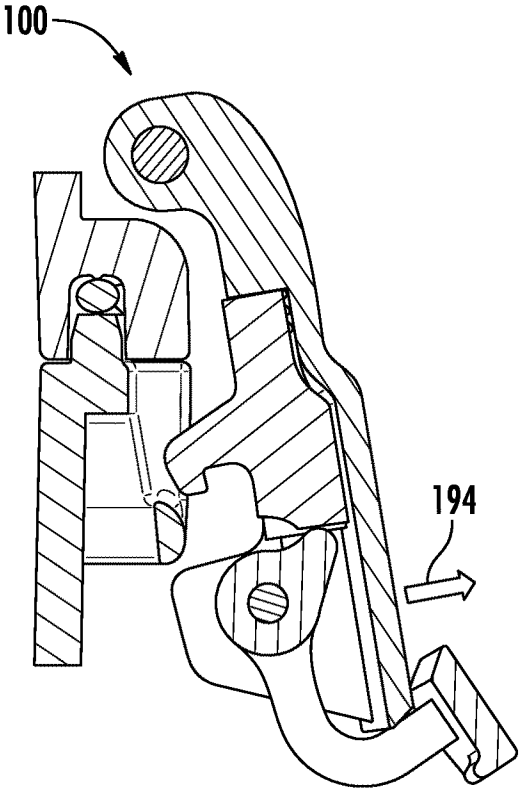
FIGS. 12A-12C illustrate side cross-sectional views of movement of a latch assembly from a locked position to an unlocked position according to one or more aspects described herein.
Figure 12B:
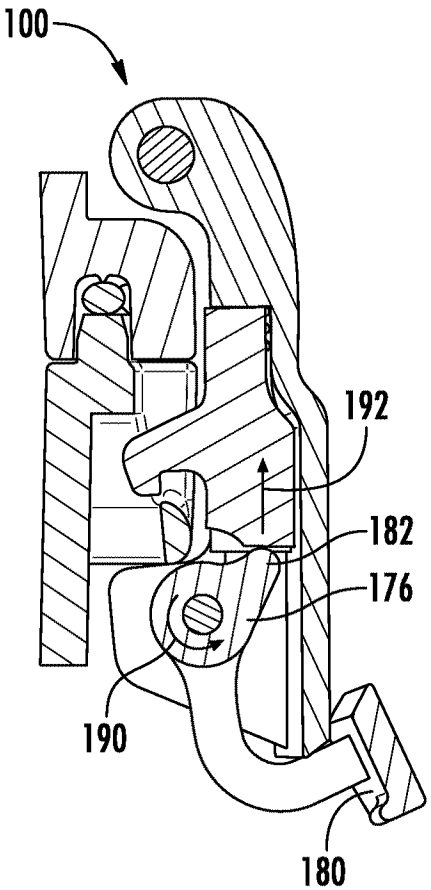
Figure 12A:
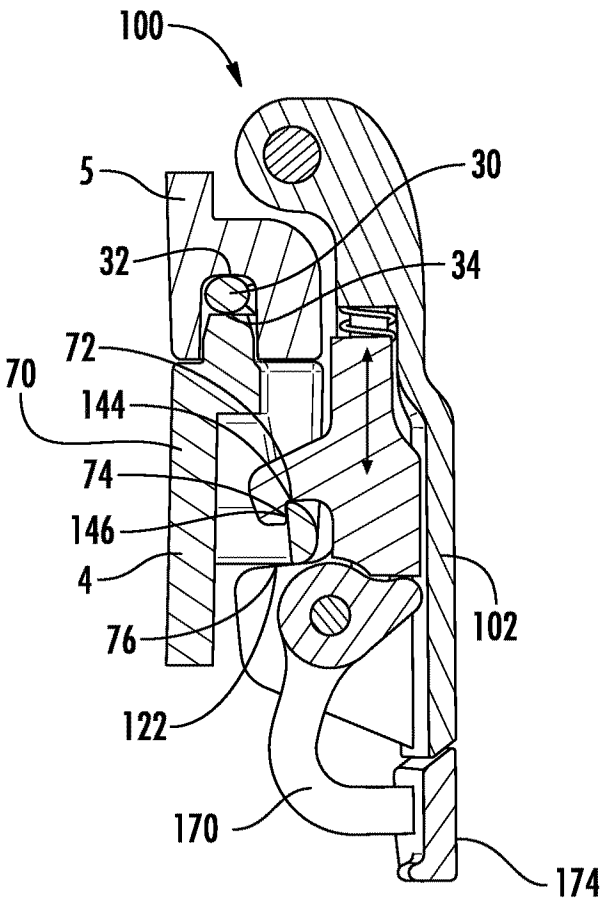
Figure 13C:
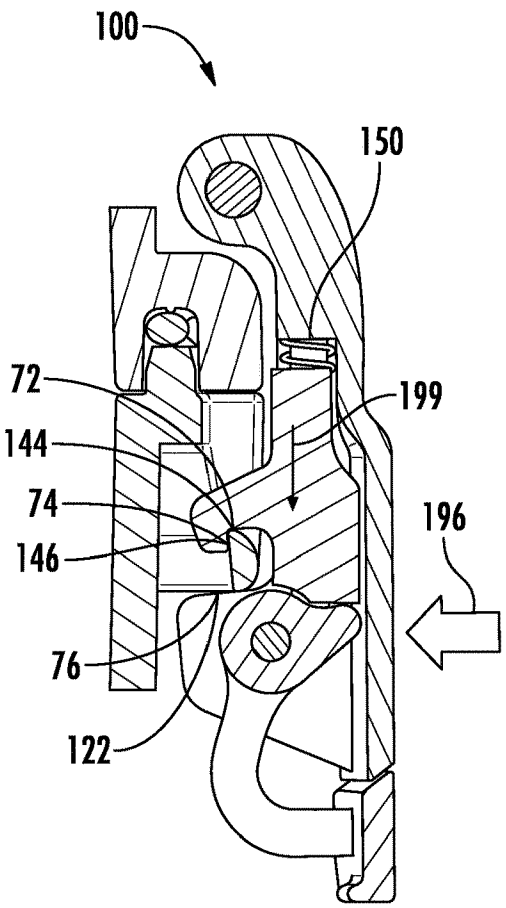
FIGS. 13A-13C illustrate side cross-sectional views of movement of the latch assembly of FIGS. 13A-13C from an unlocked position to a locked position according to one or more aspects described herein.
Figure 13B:
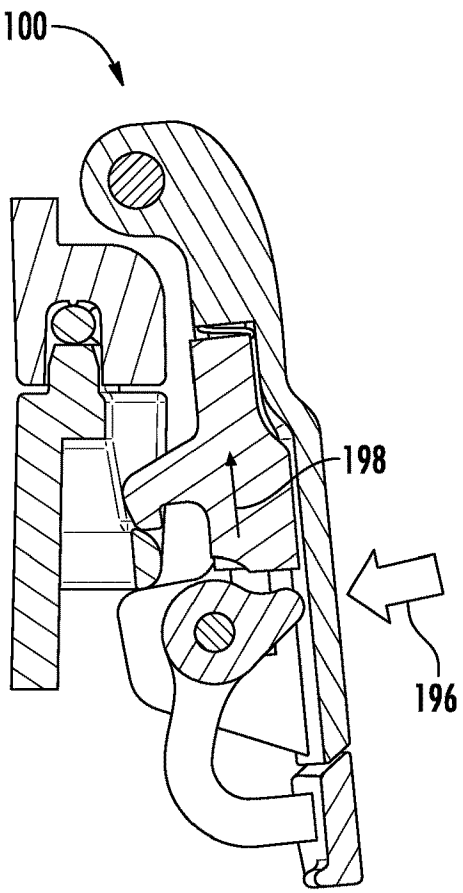
Figure 13A:
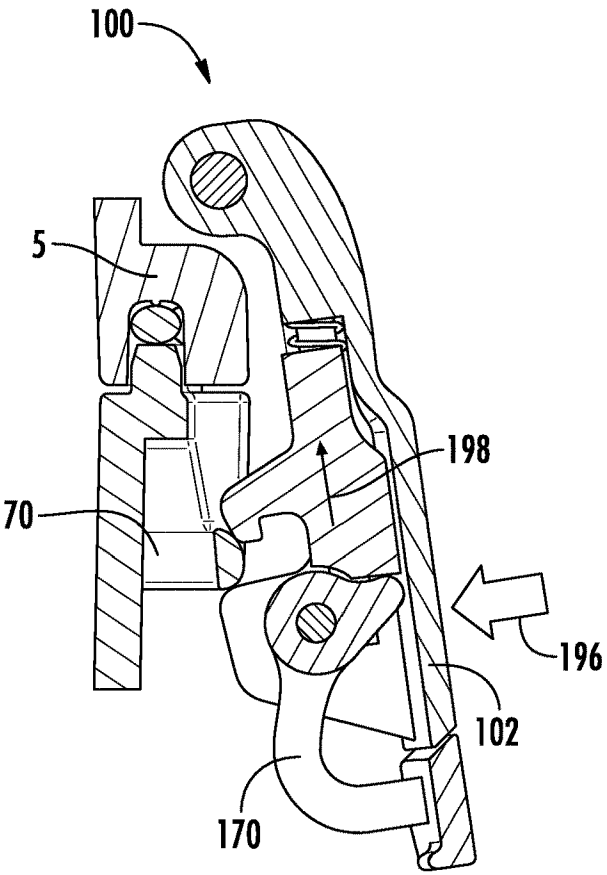
Figure 14:
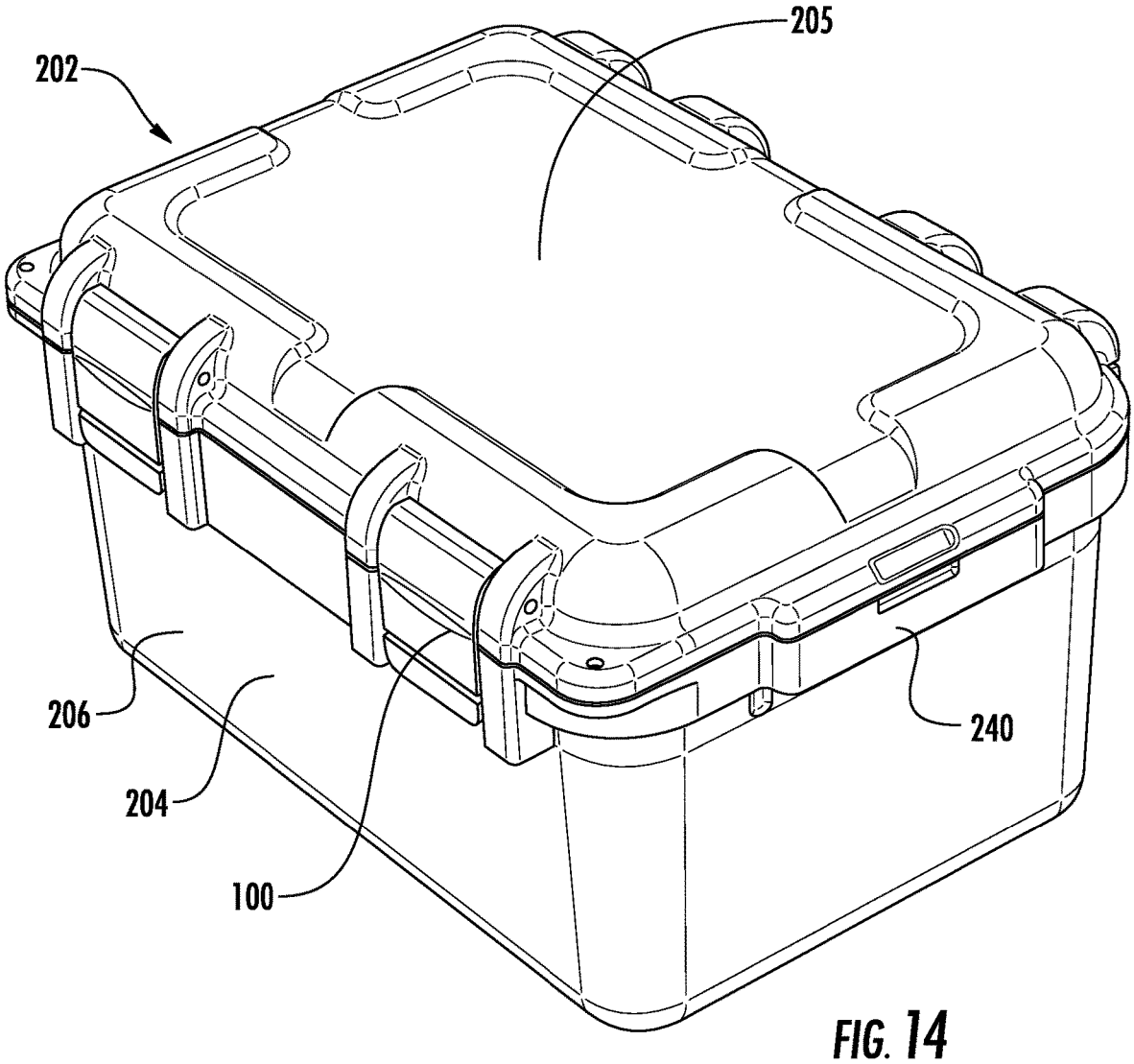
FIG. 14 is a top perspective view of a container according to one or more aspects described herein.
Figure 15:
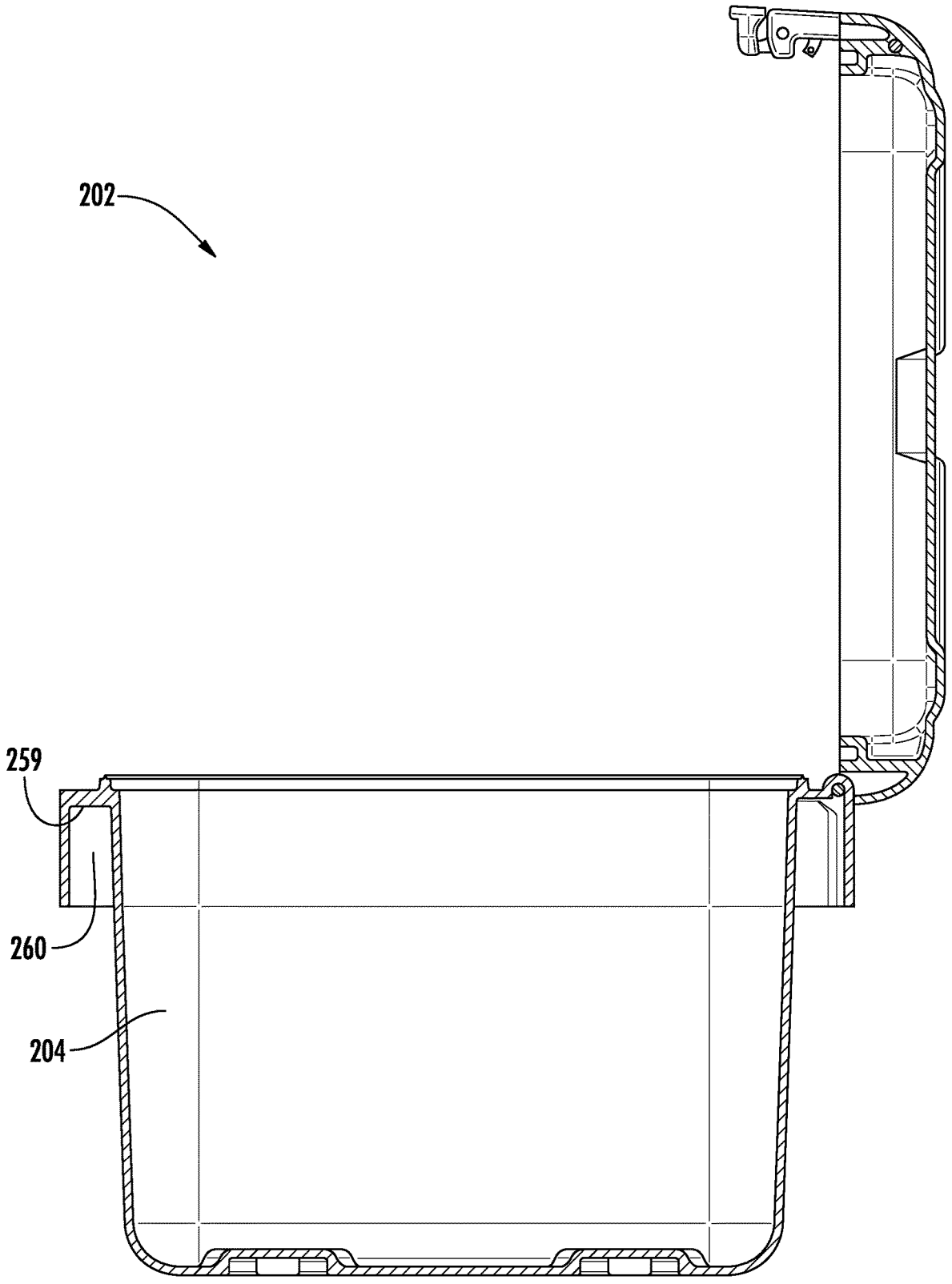
FIG. 15 is a side cross-sectional view of the container of FIG. 14 according to one or more aspects described herein.
Figure 16A:
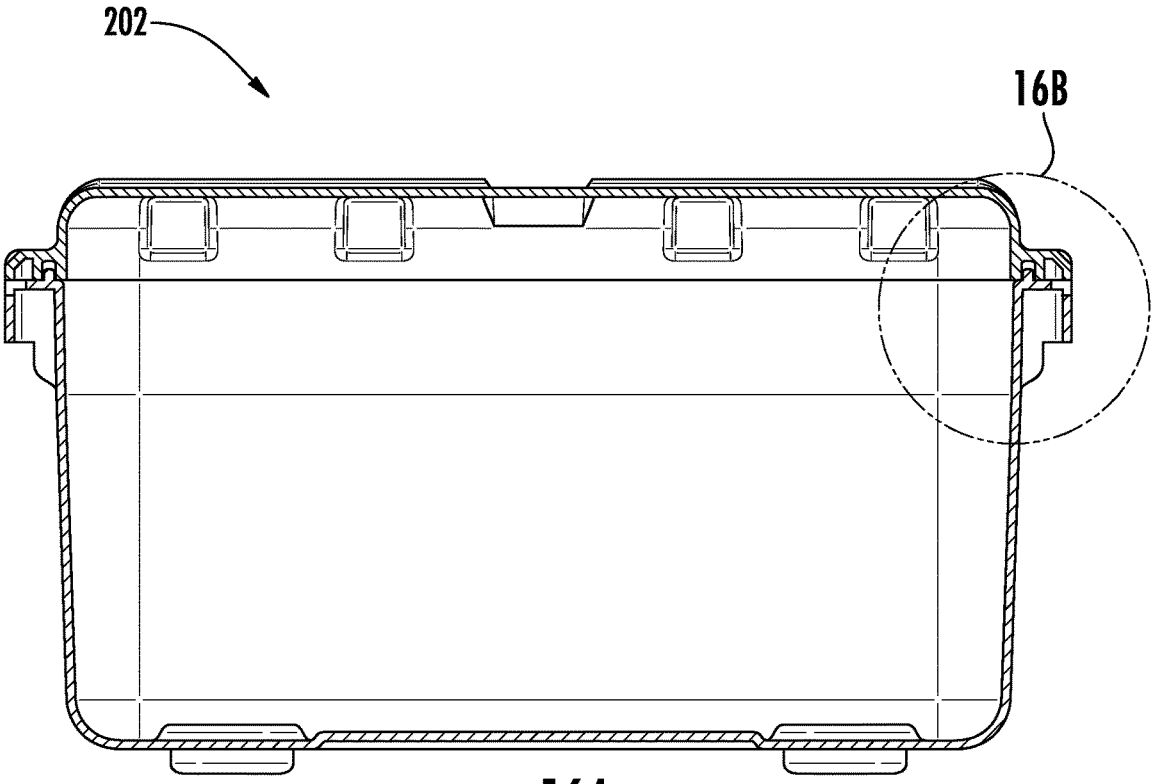
FIG. 16A is a side cross-sectional view of the container of FIG. 14 according to one or more aspects described herein.
Figure 16B:
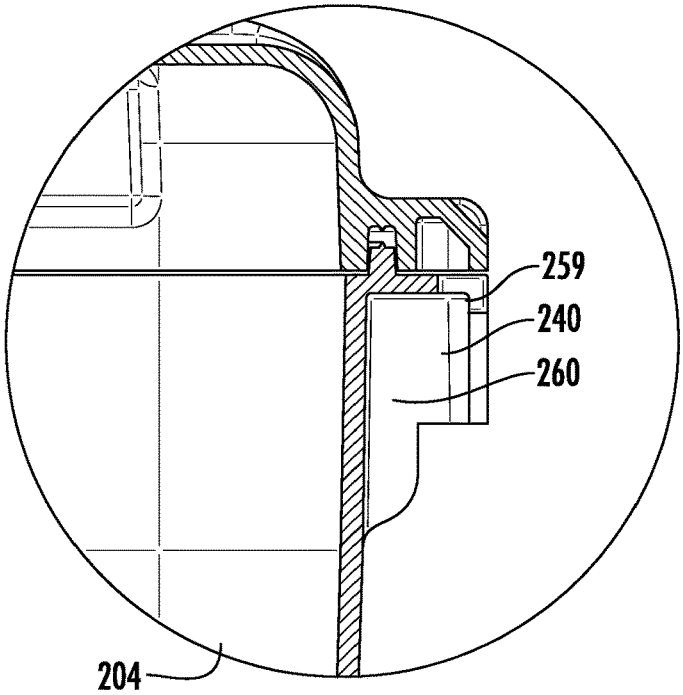
FIG. 16B is an enlarged view of a portion of the container shown in FIG. 16A according to one or more aspects described herein.

FIGS. 12A-12C depict a similar procedure to that shown in FIGS. 10A-10C for moving an embodiment of the latch assembly 100 from the locked position to an unlocked position and FIGS. 13A-13C depict a similar procedure to that shown in FIGS. 11A-11C for moving an embodiment of the latch assembly 100 from the locked position to an unlocked position. In some embodiments, as shown for example in FIGS. 10A-11C, the activating member 170 may automatically return to a downward position as shown in FIG. 10A after it has been rotated outward by a user. However, in other embodiments, the activating member 170 may only move to the downward position if it is manually pushed inward by a user. Additionally, in some embodiments, the activating member may extend further outward than the latch body 102 when the activating member is in the downward position.

The latch assembly 100, including the latch body 102, locking member 130, and activating member 170, may each be separately formed and may be formed of materials such as plastic materials or another suitable material which can be formed or molded into the desired shape. The latch assembly 100 may be made of sufficient size, thickness and materials of construction to withstand repeated cycles of stress as the latch is engage/disengaged with the latch keeper 70 over time. The containers described herein include various features that ensure easy and efficient manufacture of the containers, while providing durability and wear resistance.

FIGS. 14-16B depict another example container 202 having a latch assembly 100, wherein like reference numerals refer to the same or similar elements in container 2 but include 200 series reference numerals. Container 202 is substantially similar to container 2 and therefore similar aspects of container 202 are not discussed again herein. Container 202, however, may include some differences from container 2. Container 202, for example, includes handles 240 which may be integrally molded with the base portion 204 in the sidewall structure of the base 4. As shown in FIGS. 14-16B the integrally molded handles 240 may be formed of the J-shaped wall 259 and/or may comprise a portion of the J-shaped wall 259. Thus the integrally molded handles 240 may comprise a portion of the channel 260 extending around a perimeter of the container 202.

FIGS. 17A-26D depict another example container 302 having a latch assembly 400 discussed below, wherein like reference numerals refer to the same or similar elements in containers 2 and 202 but include 300 series reference numerals. Container 302 is substantially similar to containers 2 and 202 and therefore similar aspects of container 302 are not discussed again herein. Container 302, however, may include some differences from containers 2 and 202. Container 302, for example, includes handles 340 which may be integrally molded with the base portion 304 on each side 308, 310, 312, 314 of the sidewall structure 306 of base 304. In addition, container 302 may comprise a plurality of attachment points for locating and supporting various accessories that may connect to container 302. These attachment points will be described in more detail below.

Figure 17A:
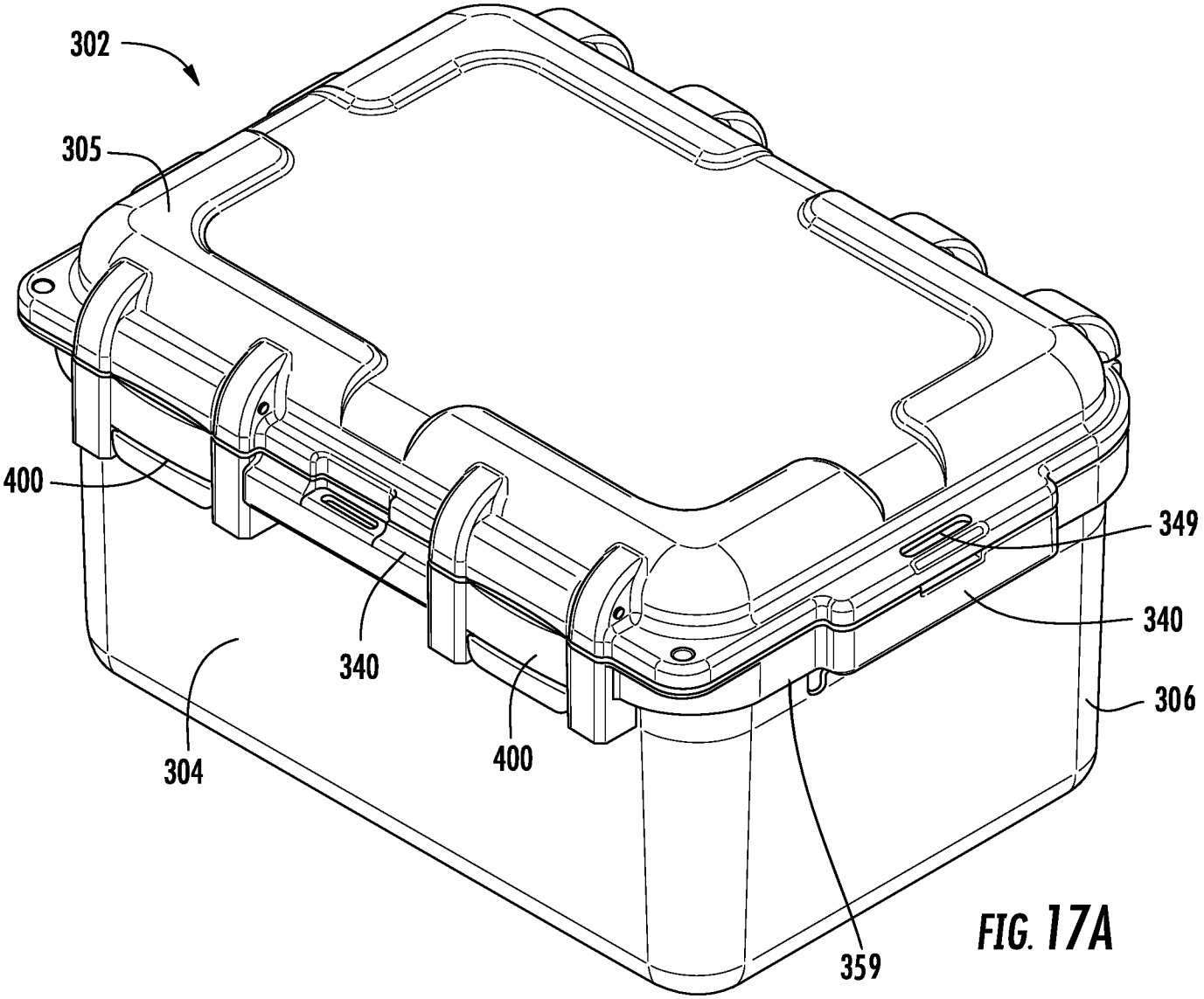
FIG. 17A illustrates a top perspective view of an alternate embodiment of the container of FIG. 1 with the lid in a closed position according to one or more aspects described herein.
Figure 17B:
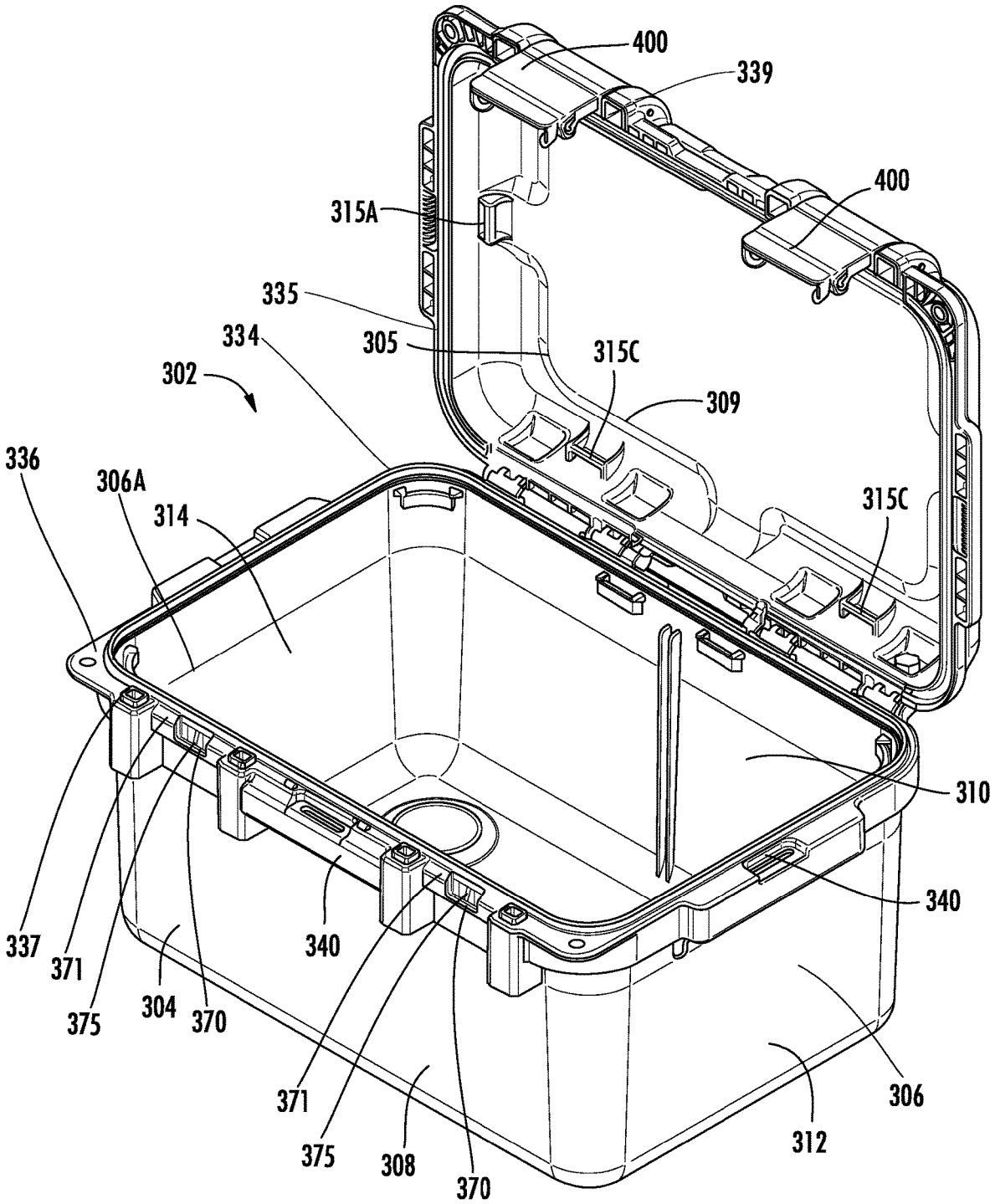
FIG. 17B illustrates a top perspective view of the container of FIG. 17A with the lid in an open position according to one or more aspects described herein.
Figure 18A:
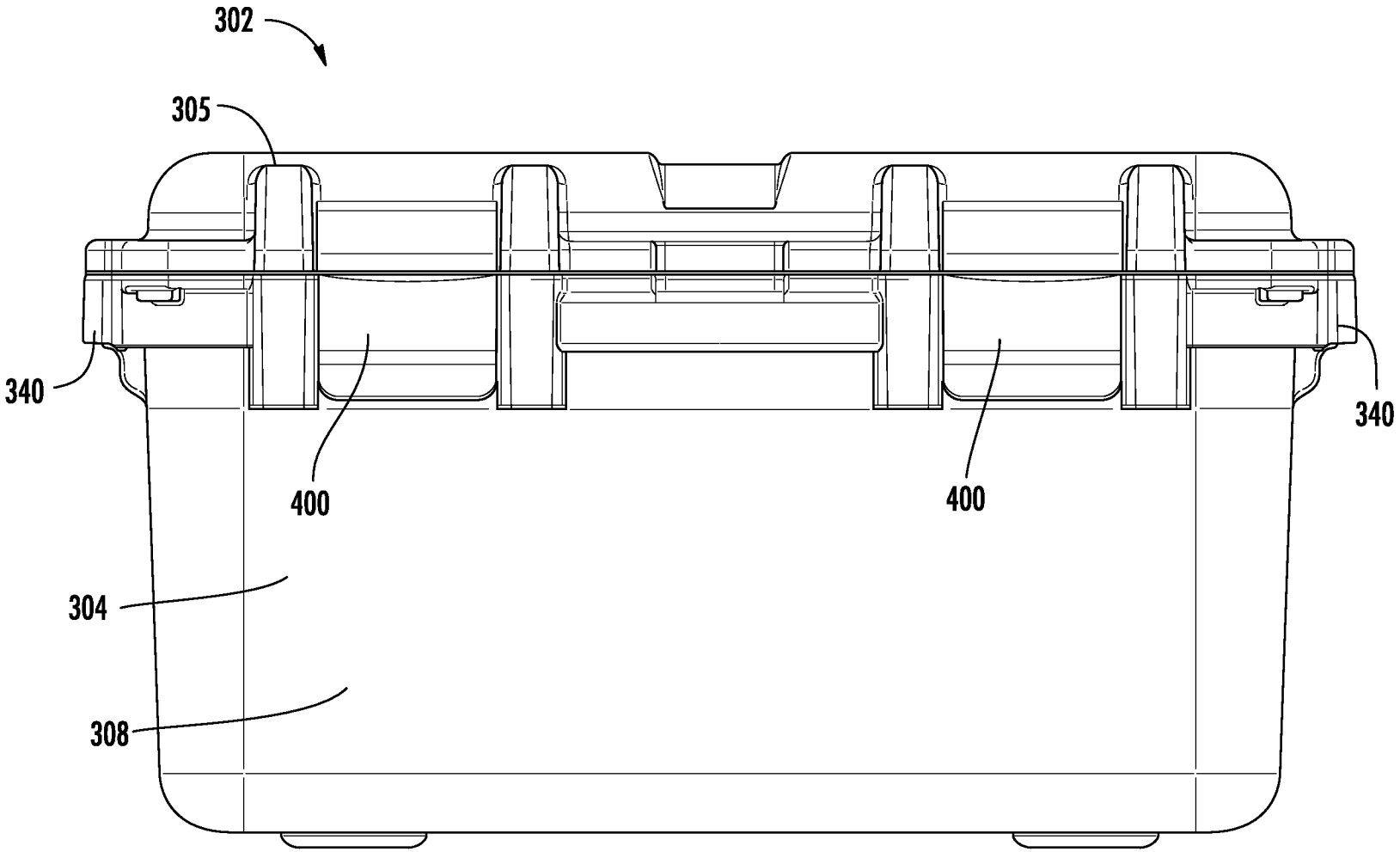
FIG. 18A illustrates a front view of the container of FIG. 17A with the lid in a closed position according to one or more aspects described herein.
Figure 18B:
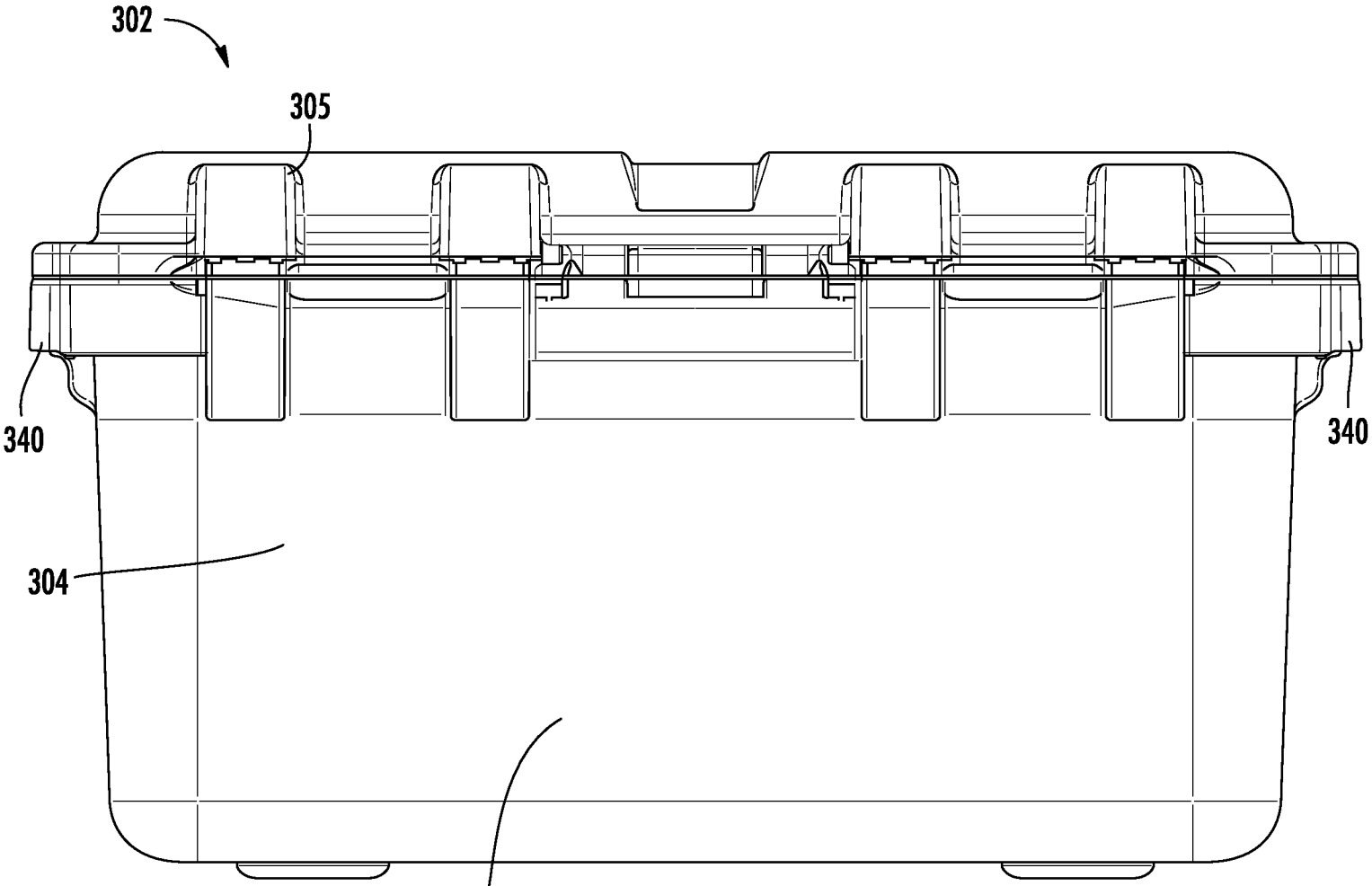
FIG. 18B illustrates a rear view of the container of FIG. 17A with the lid in a closed position according to one or more aspects described herein.
Figure 18C:
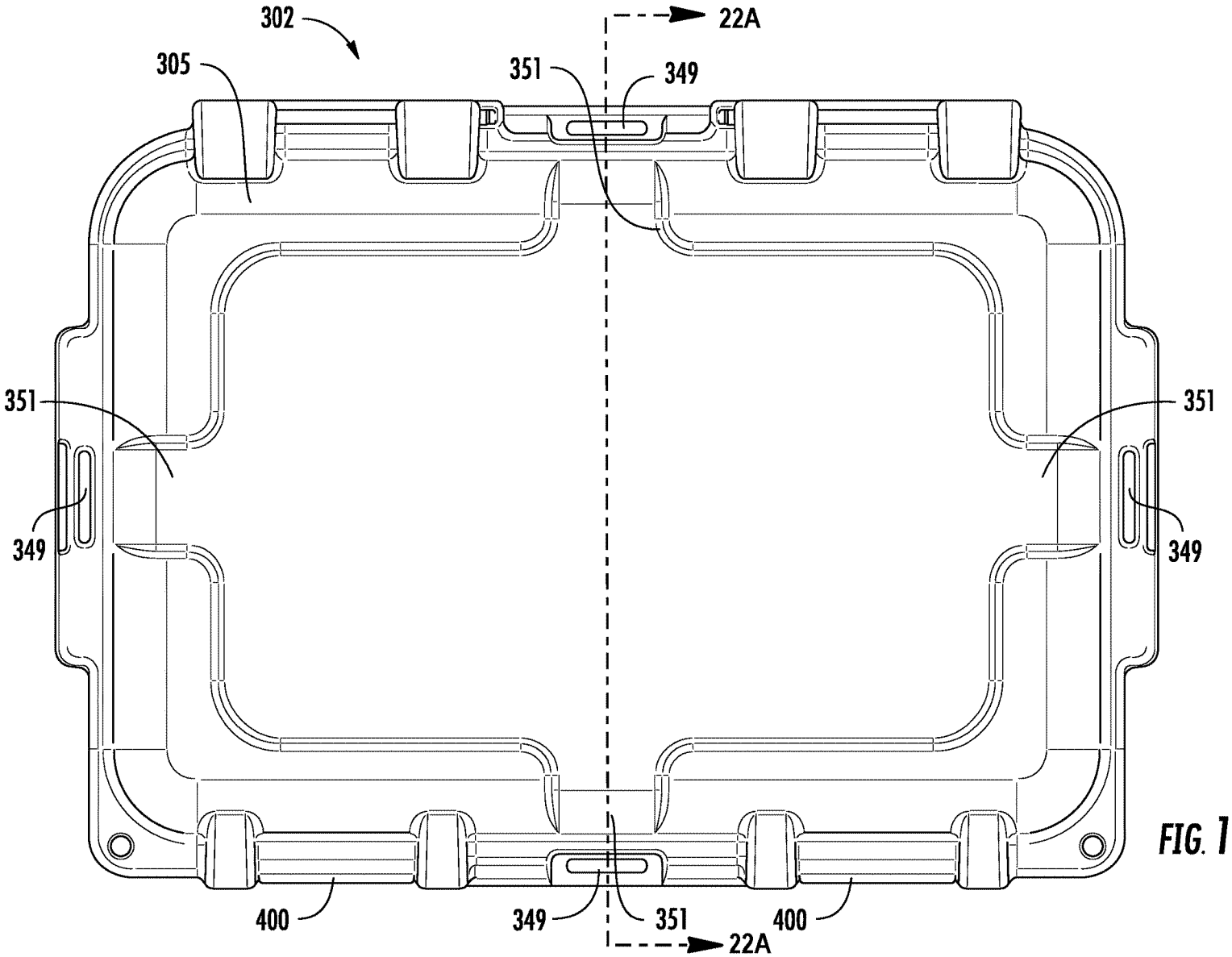
FIG. 18C illustrates a top view of the container of FIG. 17A with the lid in a closed position according to one or more aspects described herein.
Figure 18D:
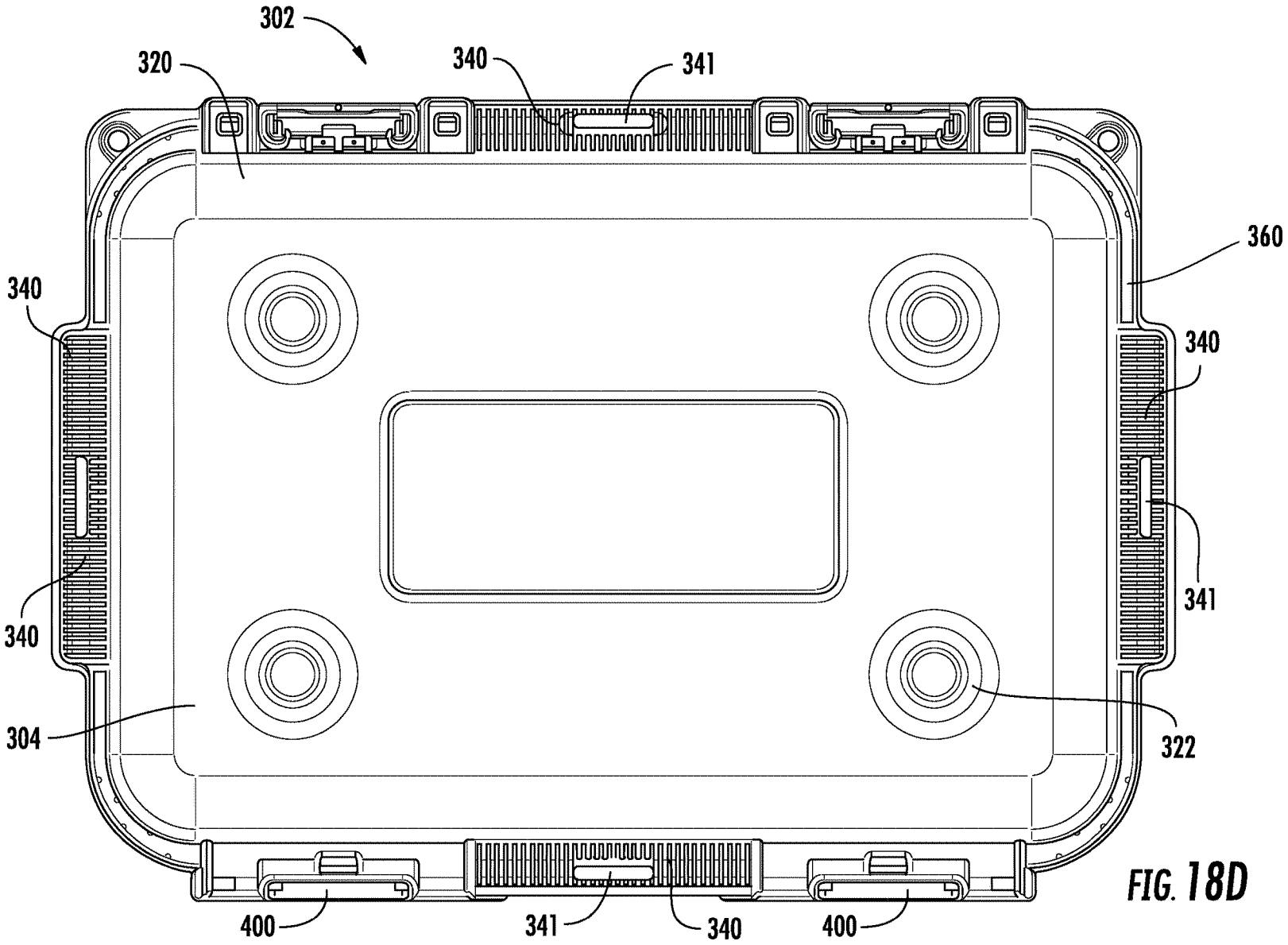
FIG. 18D illustrates a bottom view of the container of FIG. 17A with the lid in a closed position according to one or more aspects described herein.
Figure 18E:
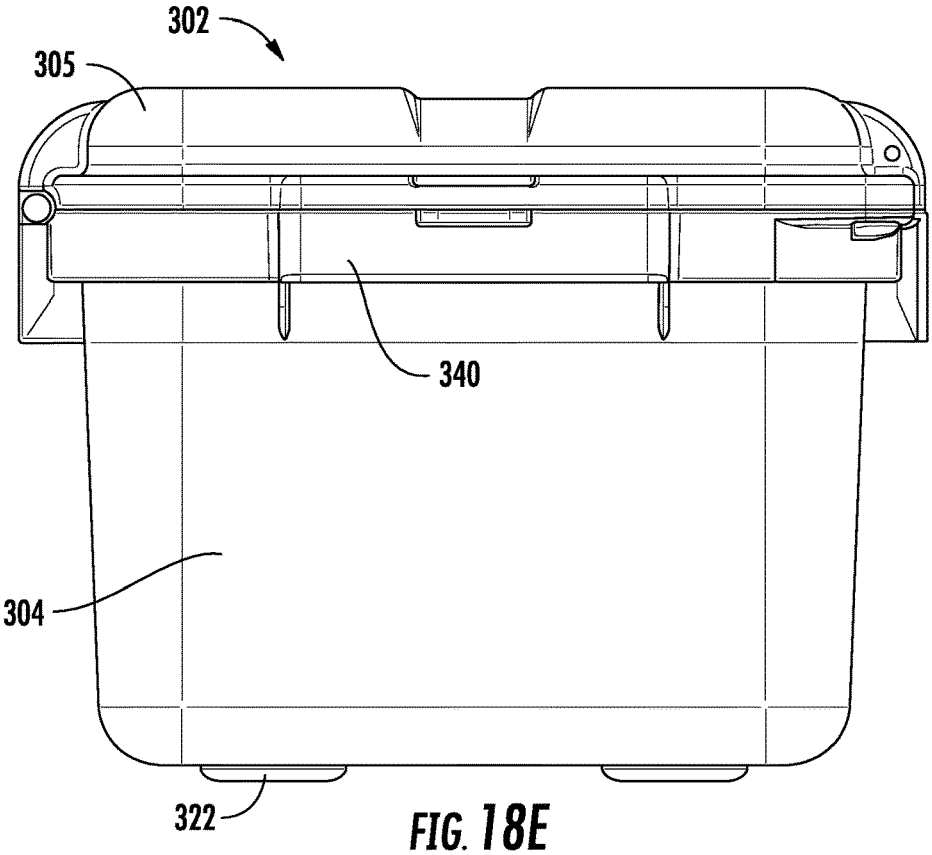
FIG. 18E illustrates a left side view of the container of FIG. 17A a closed position according to one or more aspects described herein.
Figure 18F:
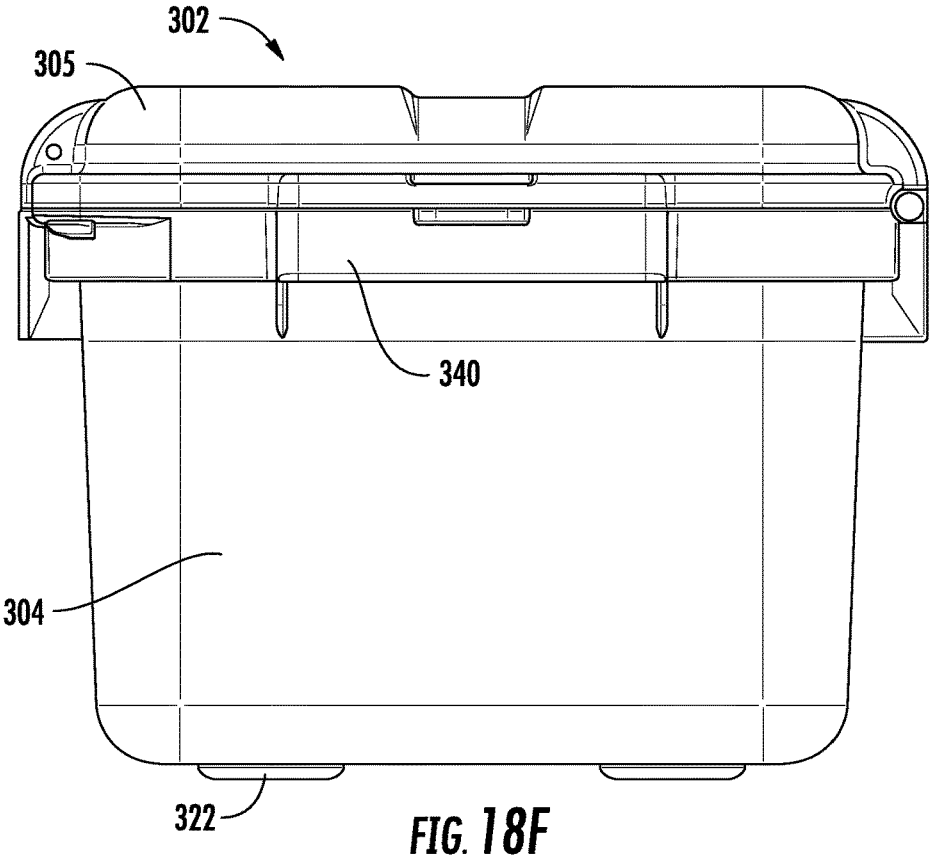
FIG. 18F illustrates a right side view of the container of FIG. 17A a closed position according to one or more aspects described herein.

As shown in FIG. 17B, along with 19A and 19B, the base 304 may include a latch keeper 370. The latch keeper 370 may extend from the sidewall structure 306 and may form a pocket within the base 304. The latch keeper 370 may have a shape configured to receive a portion of the locking member 430 as will be discussed in more detail below. The latch keeper 370 may have an upper surface 372, an inner surface 374, a rib 375, and a lower surface 376. The rib 375 may extend from the sidewall structure 306 to the lower surface 376 of the latch keeper 370. Optionally, the rib 375 may also connect to the upper surface 372 and the lower surface 376 or the inner surface 374 of the latch keeper 370. The rib 375 may be substantially centrally located along the latch keeper 370. The rib 375 may add structural support to the latch keeper 370 to improve the durability. As another option, the latch keeper 370 may include multiple ribs 375 that may be positioned one either side of the pocket formed by the latch keeper 370 to provide additional support to the latch keeper 370. As will be discussed in greater detail below, the latch assembly 400 may engage the latch keeper 370 to lock the lid 305 to the base 304 when the container 302 is in a closed configuration.

Figure 21:
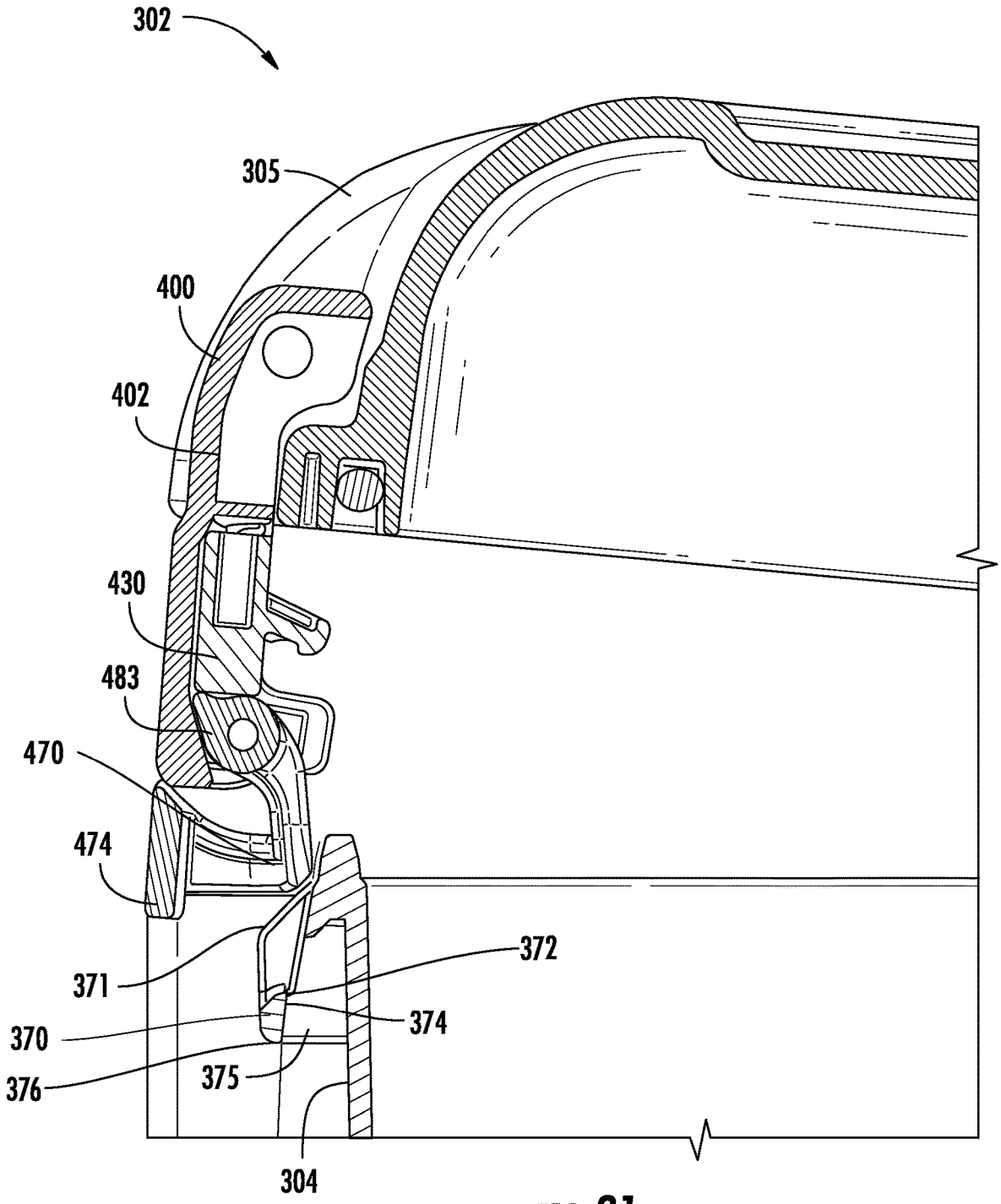
FIG. 21 illustrates a partial cross-sectional view of the latch assembly of FIG. 20A in an unlocked position according to one or more aspects described herein.

In addition, the base 304 may include a plurality of ramped or tapered surfaces 371 positioned on either side of the latch keeper 370. The ramped surfaces 371 may angle downward from the interface surface 336 of the base 304, where the interface surface 336 may be substantially flat and extend around on at least three sides of the perimeter of the base 304. The interface surface 336 of the base 304 may contact the interface surface 335 of the lid 305 when the container 302 is in the closed position. The ramped surface 371 may angle downward from the interface surface 336 approximately 45 degrees or within a range of 30 and 60 degrees, or within a range of 20 to 80 degrees. The ramped surface 371 may prevent the latch assembly 400 from getting stuck on the base 304 when closing the container 302 and may also contact the lower portion of the latch assembly 400 as the lid 305 is closed to push the latch assembly 400 out of the way of the base when the lid 305 is closed as shown in FIG. 21.

The base 304 may further include a plurality of engaging members 337 that extend from the interface surface 336 of the base 304. The engaging members 337 may be positioned outward of the ridge 334. The engaging members 337 may extend into recesses or cavities 339 on the lid 305. The interaction between the engaging members 337 and the recesses 339 may provide additional structural support to strengthen the joint between the lid 305 and the base 304 when the container 302 is in a closed position and when multiple containers are stacked or additional items are placed on top of the container 302. The base 304 may have any number of engaging members 337. For example, the exemplary embodiment illustrates four engaging members 337, but the base 304 may comprise two engaging members, three engaging members, five engaging members or greater. The number of recesses 339 on the lid 305 may be equal to the number of engaging members 337 and located on the lid 305 at a location that corresponds with each engaging member 337 of the base 304. The engaging members 337 in the exemplary embodiment have a substantially square cross-sectional shape, but may have any cross-sectional shape, like a circle, triangle, or other polygon. Each engaging member 337 may have a height that is less than or equal to the width of the engaging member 337. Additionally, while the engaging members 337 and the recesses 339 of the exemplary embodiment are located on the first side 308 of the container 302, the engaging members 337 and the recesses 339 may be on any side and may have embodiments where they are positioned on multiple sides.

Figure 19A:
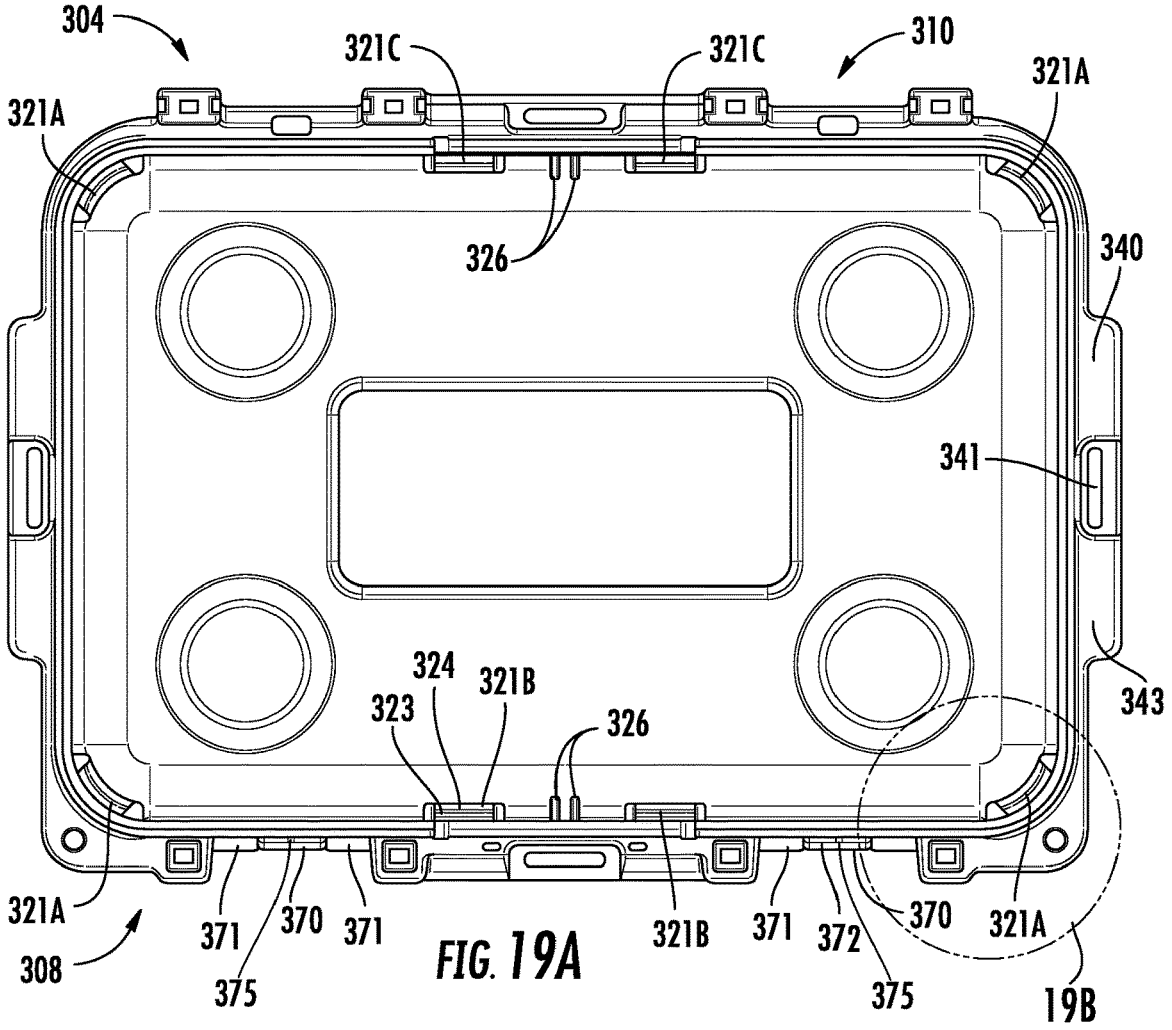
FIG. 19A illustrates a top view of the base portion of the container of FIG. 17A with the lid removed according to one or more aspects described herein.
Figure 19B:
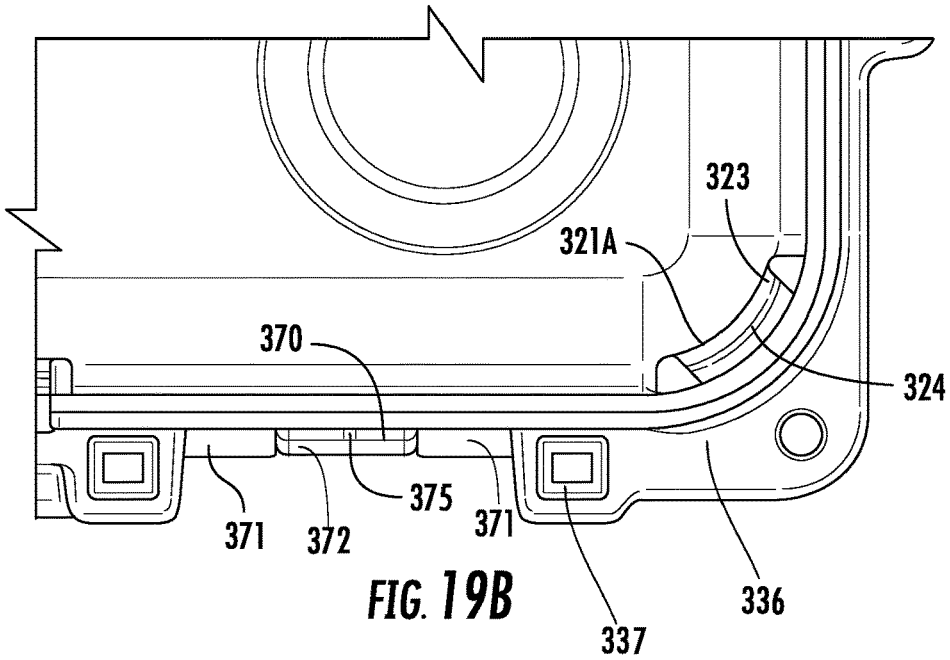
FIG. 19B illustrates an enlarged view of the base portion of the container shown in FIG. 19A according to one or more aspects described herein.

As another feature, base 304 may have a plurality of tabs 321 positioned along the interior surfaces 306A of the sidewall structure 306 of the base 304. For example, as shown in FIGS. 17B and 19A, the tabs 321A may be positioned in each of the corners of the sidewall structure 306. In addition, tabs 321B and 321C may be positioned along the interior surface of first side 308 and second side 310. Tabs 321B and 321C may be located opposite one another as illustrated in FIG. 19A such that they are aligned along a length of the first side 308. As shown in the exemplary embodiment of FIG. 19A, the interior portion may comprise eight tabs 321, with tabs 321A being located in each of the corners and tabs 321B and 321C being located along the interior surface of the sidewalls 308, 310. Tabs 321B and 321C may be generally centrally located such that at least one tab 321B, 321C may be placed on near a centerline of the container 302, but preferably located on either side of the centerline. As another option, the plurality of tabs 321 may not be aligned with a tab 321 on the opposite interior surface, but have a staggered arrangement. The tabs 321 may provide attachment locations for various accessories as discussed further below.

Each tab 321 may extend from the interior surfaces 306A of the sidewall structure 306 and include an upper support surface 323, an opening 324 extending through the upper support surface 323, and a pair of side surfaces on either end of the tab 321. The upper support surface 323 of each tab may provide an engaging surface to support various accessories within the interior of the container 302, like a tray 500 as discussed further below. The upper support surfaces 323 of the plurality of tabs 321 may be substantially coplanar with each other to allow the support surfaces 323 to hold an accessory that may extend across the base 304 and be supported by multiple tabs 321. The upper support surfaces 323 of the tabs 321 may be positioned in an upper region of the interior surfaces 306A at a height that is greater than fifty percent of the height of the interior portion of the base portion. As another option, the upper support surfaces 323 of the tabs 321 may be positioned at a height that is greater than sixty percent of the height of the interior portion of the base portion, or even greater than seventy percent of the height of the interior portion of the base portion. In order to minimize the impact to the interior space, each tab 321 may have a low profile such that each tab 321 may extend a distance of less than one inch from the interior surface, or less than 0.5 inches, or even less than 0.25 inches. Additionally, the openings 324 may have any shape, but may be preferably elongated in shape. The openings 324 may provide attachment points for straps or other attachment means to further support different accessories.

As another option a pair of tracks 326 may be positioned along at least two of the interior surfaces 306A of the sidewall structure 306. As shown in the exemplary embodiment, a pair of tracks may be positioned on each of the interior surfaces of first and second sides 308, 310. Each of the pair of tracks 326 may be centrally located such that they are aligned with the pair of tracks 326 on the opposing interior surface. Each of the tracks 326 may extend from the interior surfaces of the base 304 and have a height that extends along a majority of the height of the interior portion. In order to minimize the impact to the interior space, each track 326 may have a low profile such that each track 326 may extend a distance of less than one inch from the interior surface 306A, or less than 0.5 inches, or even less than 0.25 inches. The pairs of tracks 326 may support a removable divider wall 510, which may also serve as a cutting board, to separate the interior of the container into two portions to better organize the items being stored. Each of the tracks 326 may have a plurality of détentes or protrusions to securely hold the divider wall 510 to prevent it from moving and limit any vibration.

Similar to the example container 302 discussed above, the embodiment of FIGS. 17-26D may have integrally molded handles 340 that are positioned along each of the sidewalls 308, 310, 312, 314. Each of the integrally molded handles 340 may be formed of the J-shaped wall 359 and/or may comprise a portion of the J-shaped wall 359. Thus the integrally molded handles 340 may comprise a portion of the channel 360 extending around a perimeter of the container 302. Thus, the example container 302 may comprise four handles 340. The handles 340 may be integrally molded with the base portion 304. In some examples, each handle 340 may be formed with an undercut and include a recess extending along substantially all or a majority of the sidewall structure 306. This integrally molded handle 340 may simplify the manufacturing process for the base 304. In some examples, the integrally molded handles may be flush with an exterior surface of the base 304 in order to reduce the risk of breakage.

Figure 22A:
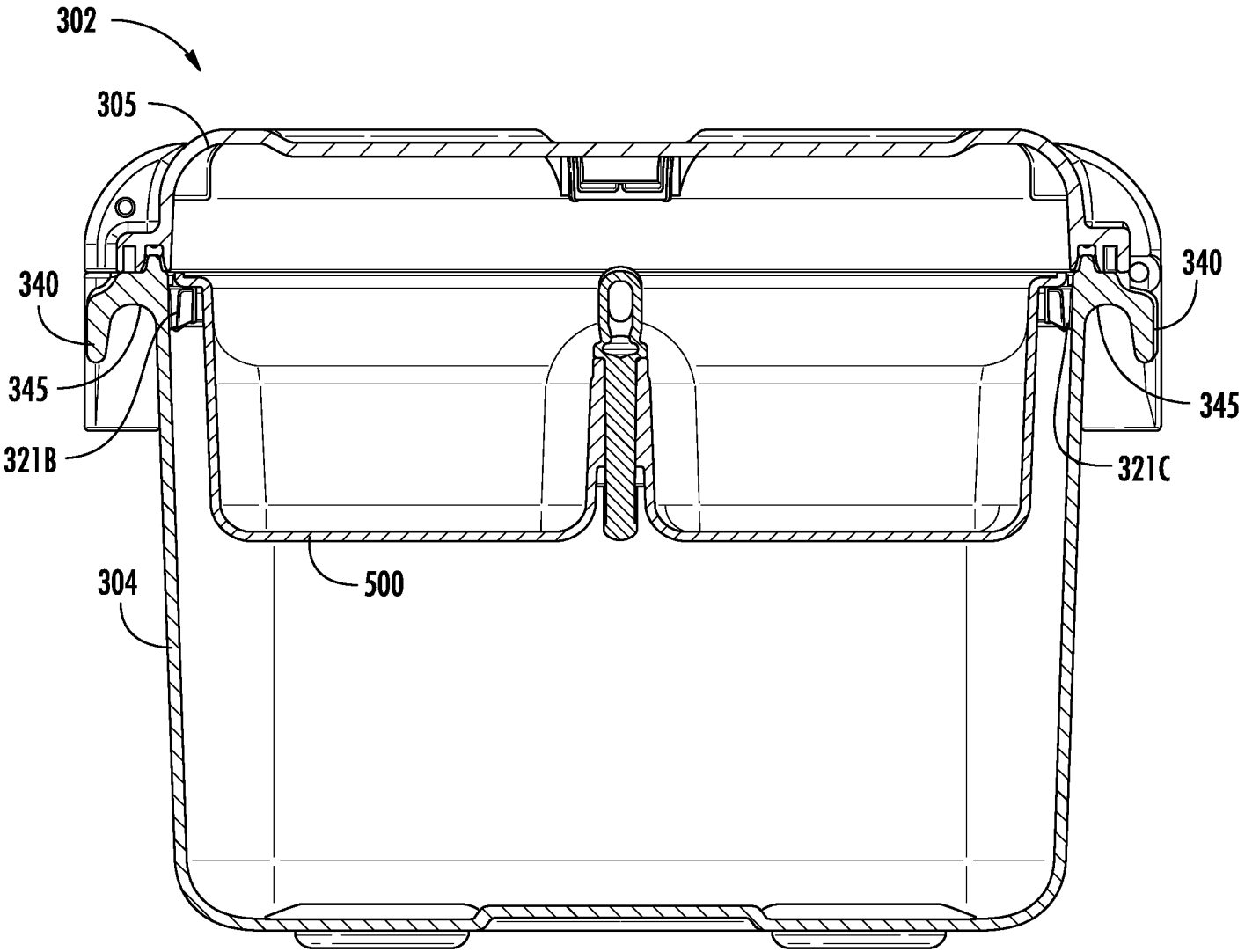
FIG. 22A illustrates a side cross-sectional view of the container of FIG. 17A according to one or more aspects described herein.
Figure 22C:
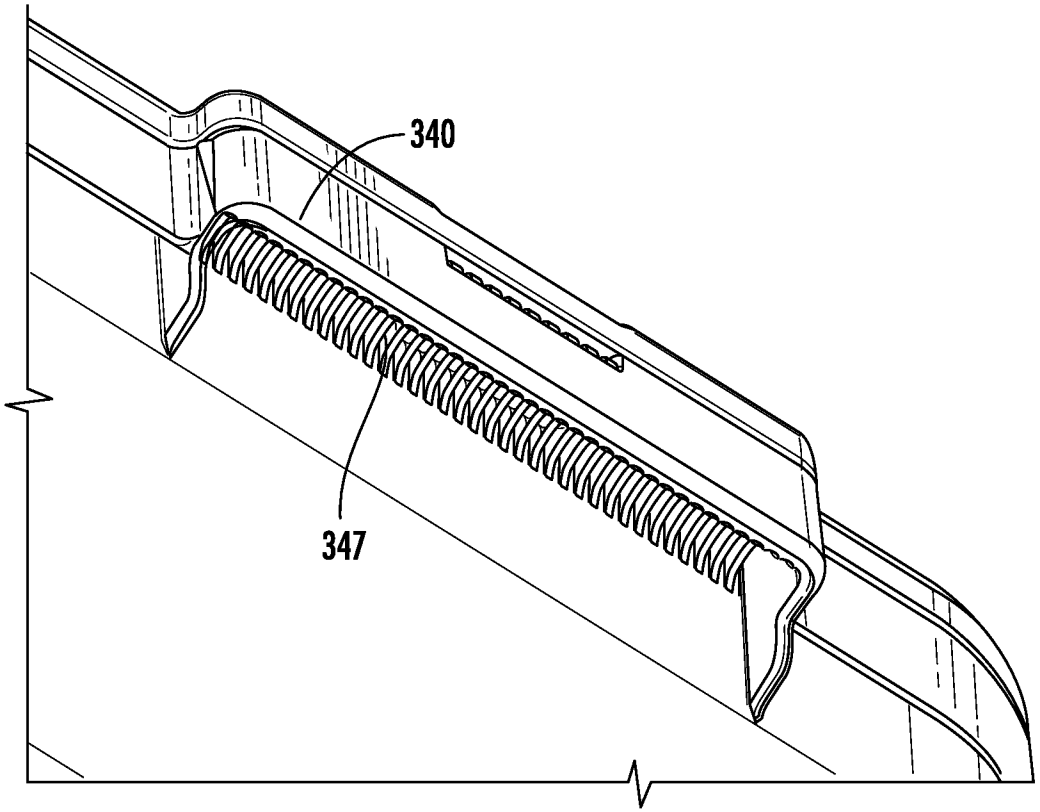
FIG. 22C illustrates a partial view of a bottom perspective view of the handle of the container of FIG. 17A according to one or more aspects described herein.
Figure 22B:
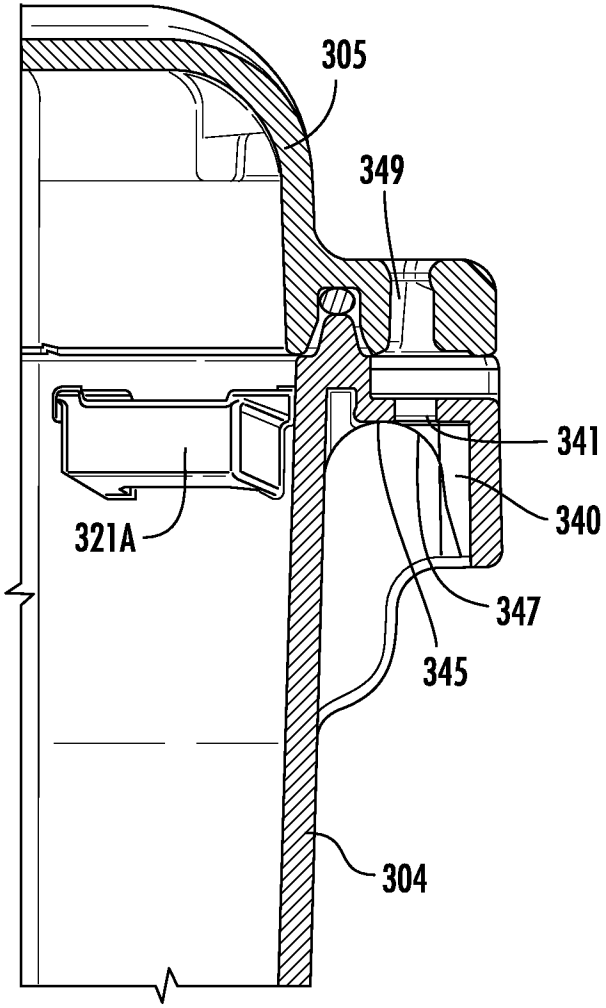
FIG. 22B illustrates enlarged side cross-sectional view through a handle of the container of FIG. 17A according to one or more aspects described herein.

As shown in FIGS. 22A through 22C, each handle 340 may have a curved interior profile 345 to provide an ergonomic and comfortable gripping surface for the user. The interior profile 345 of the handle may comprise a plurality of handle ribs 347 that extend from the sidewall to an interior surface of the handle 340, where each handle rib 347 may have a curved profile such that the plurality of ribs 347 that are spaced apart from each other form the curved interior profile 345 of the handle 340. Each rib 347 may have a spacing between the ribs 347 that is less than the width of each rib 347. Alternatively, each rib 347 may have a spacing between the ribs 347 that is equal to or greater than the width of each 347.

Figure 23A:
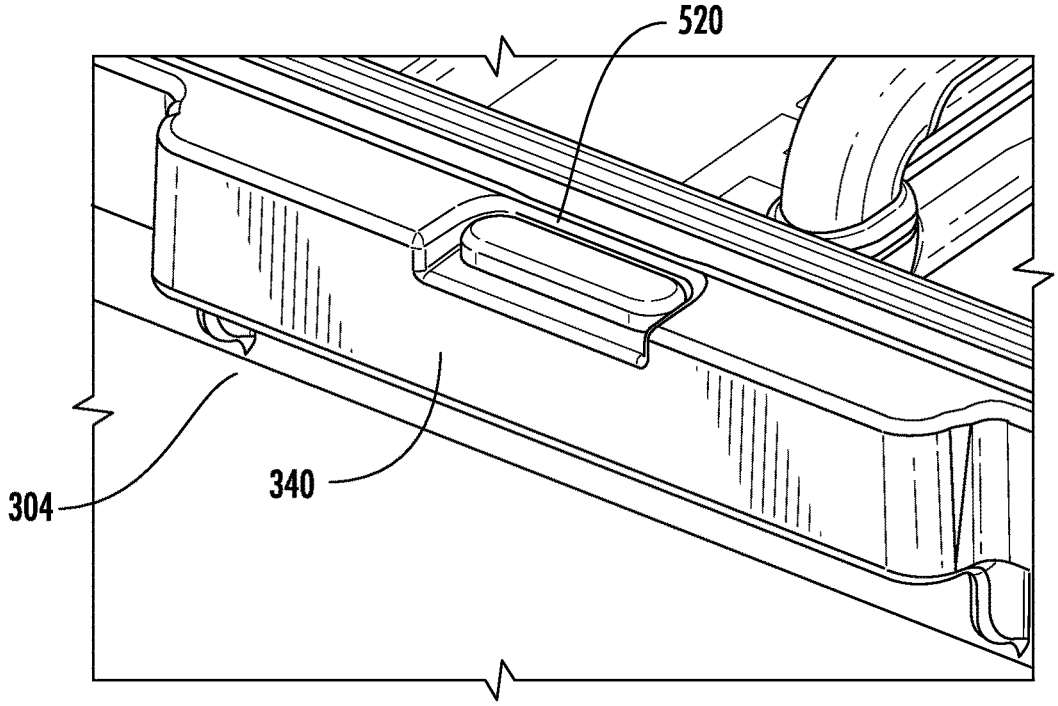
FIG. 23A illustrates a partial top perspective view of the base portion of the container of FIG. 17A according to one or more aspects described herein.
Figure 23B:
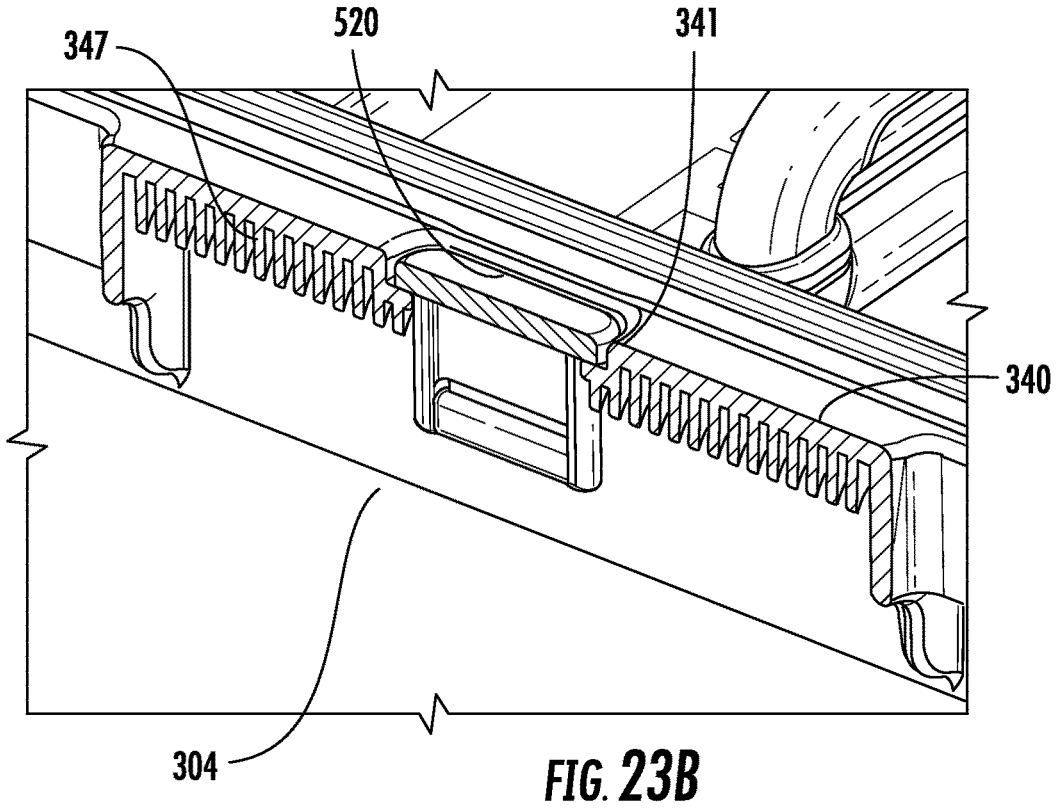
FIG. 23B illustrates a partial cross-sectional view of partial top perspective view of FIG. 23A illustrating the base portion of the container of FIG. 17A according to one or more aspects described herein.

Each handle 340 may have an opening 341 extending through the handle top surface 343 of the handle 340 where each opening 341 may align with an opening 349 of the lid 305. Thus, with the aligned openings 341 of the handle and openings 349 of the lid 305 allow locations for a strap or similar device to pass through the openings 341, 349 to anchor or tie down the container 302. Each opening 341, 349 may have an elongated shape and may all have substantially the same length and width. Thus, these openings 341, 349 may provide versatility to the user for other operations beyond just anchoring the container 302. To further assist with anchoring or securing the container 302, the lid 305 may have recesses or channels 351 that align with the openings 349 to provide guide surfaces for a strap to tie down the container 302. As another option, clips 520 may be inserted through the openings 341 to provide an additional location to use a hook and loop type connection to add further versatility of options to hold additional accessories as shown in FIGS. 23A and 23B.

Figure 24A:
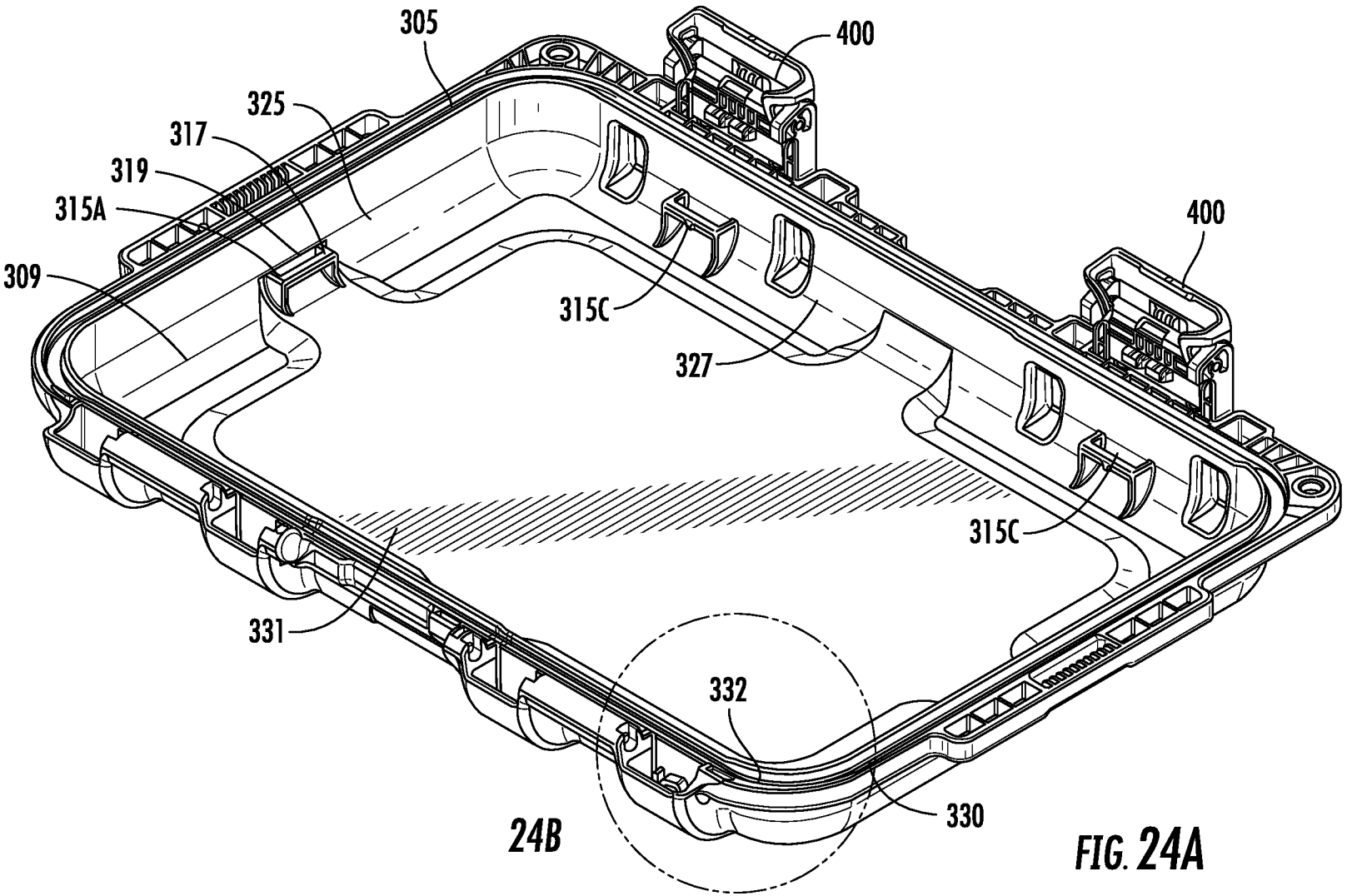
FIG. 24A illustrates a top perspective view of the interior of the lid of the container of FIG. 17A according to one or more aspects described herein.

The lid 305 of the container 302 may further comprise a plurality of clips 315 positioned along an interior surface 309 of the lid 305. For example, as shown in FIG. 24A, a clip 315A may centrally located on each of the interior surfaces 325 and while a pair of clips 315B and 315C may be evenly spaced along each of the interior surfaces 327, 329. Each of the clips 315 may also extend onto or contact the lower interior surface 331 of the lid 305. The clips 315B and 315C may be aligned to be located opposite one another. As shown in the exemplary embodiment of FIGS. 17B and 24A, the lid 305 may comprise six clips 315, although the lid 305 may comprise any number of clips 315. As another option, the plurality of clips 315 may not be located opposite one another on the interior surface of the sidewalls and have a staggered arrangement. The clips 315 may provide attachment locations for various accessories as such as a cargo net or bungie cord net 515, or straps 516 that include additional hitch points for securing any further items desired by the user.

Each clip 315 may extend from interior surfaces of the lid 305 and may include an engaging member 317 and an opening 319 extending through the engaging member 317. The openings 319 may be elongated in shape or alternatively may have any shape. In addition, the openings 319 of the clips 315 may have a similar width as the openings 324 of the tabs 321. These openings 319 may provide attachment points for straps or other attachment means to further support different accessories as shown in FIGS. 26B-26D.

Figure 24B:
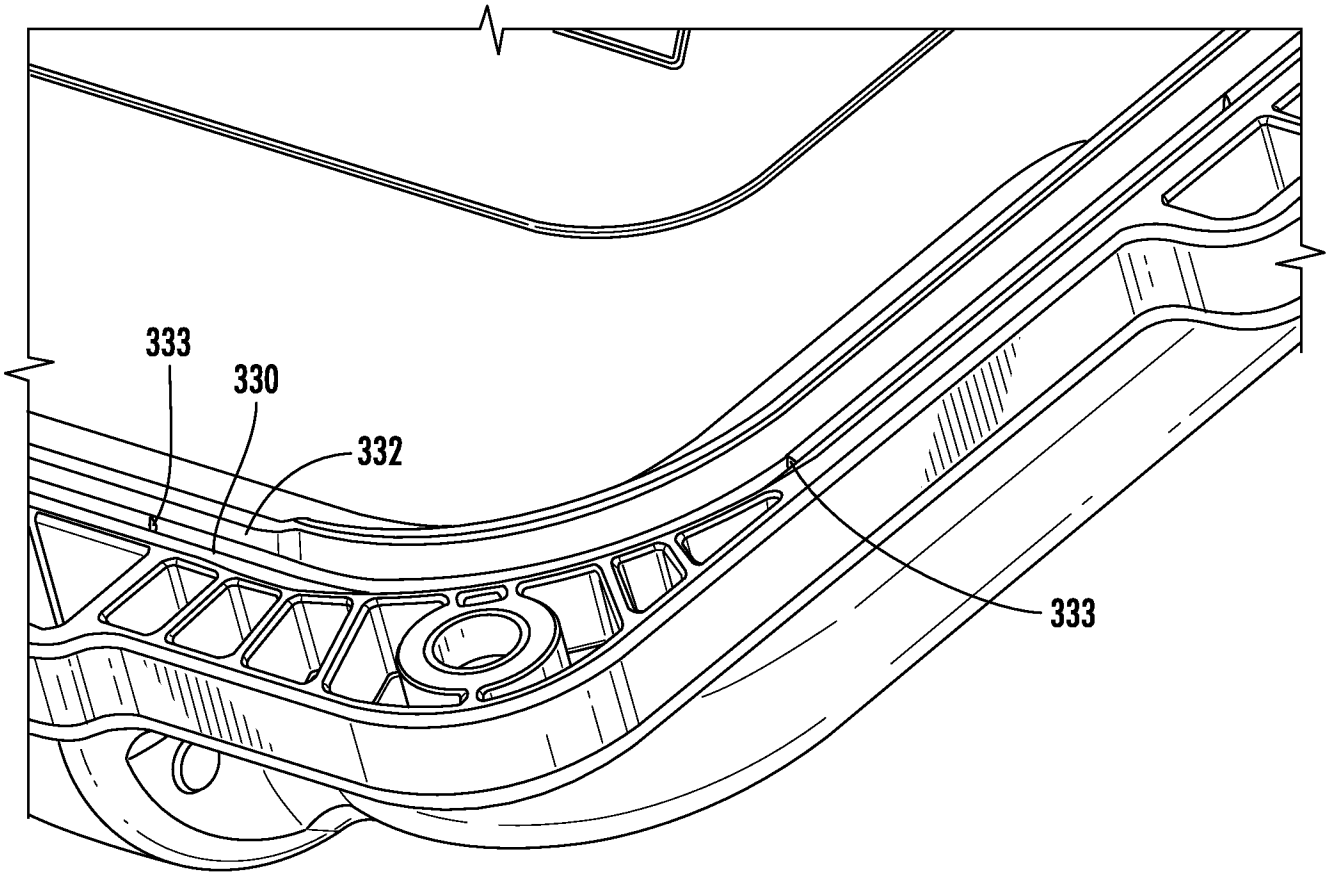
FIG. 24B illustrates an enlarged view of the top perspective view of FIG. 24A illustrating a portion of the lid of the container of FIG. 17A according to one or more aspects described herein.

As discussed above with respect to lid 5, lid 305 may include a recess 332 that may seat a gasket 330 where the recess 332 extends around a perimeter of the lid 305. The recess 332 may be positioned within the interface surface 335 of the lid 305. The recess 332 may include a plurality of retaining members 333 extending from the sides of the recess 332 as shown in FIG. 24B. The retaining members 333 may engage the gasket 330 in multiple locations around the perimeter of the recess 332 to secure the gasket 330 in the recess 332. Each retaining member 333 may include at least one tapered surface such that the retaining member 333 has a thickness near the top of the retaining member which is closer to the open end of the recess 332 than the thickness in a central portion of the retaining member 333. Additionally, in some example embodiments, the container 302 may include a ridge 334 in the base 304 opposite the recess 332 of the lid 305 extending around a perimeter of the base 304. The ridge 334 may be positioned on the interface surface 336 of the base 304. The gasket 330 may be placed between the recess 332 and the ridge 334 when the lid 305 engages the base 304.

Figure 25:
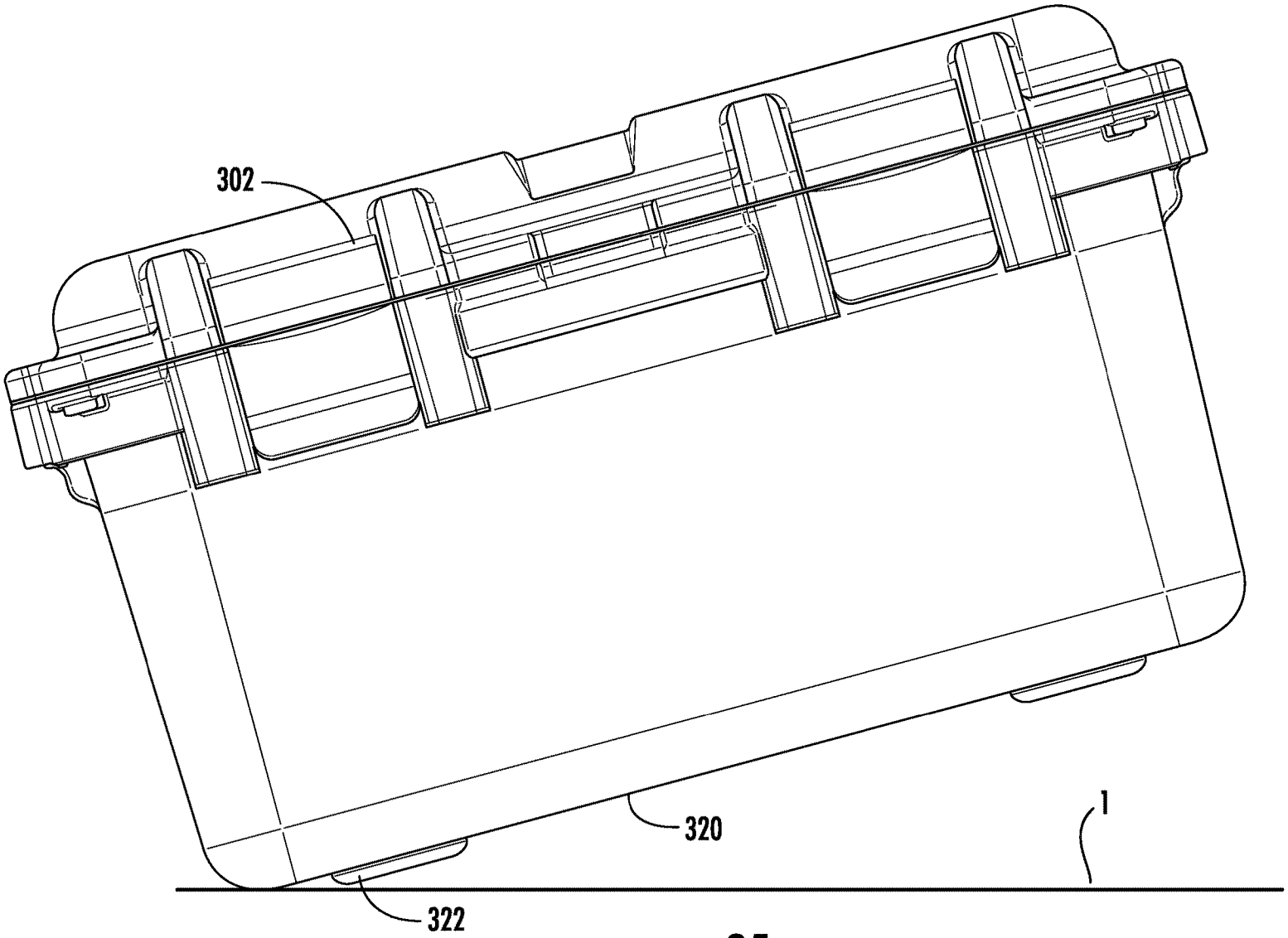
FIG. 25 illustrates a side view of the container of FIG. 17A according to one or more aspects described herein.

In some embodiments, the bottom portion 320 may also and/or alternatively include one or more feet 322 which may support the container 302 on a surface 1 such as a table, the ground, a vehicle bed, or the like. The feet 322 may be formed separately from a non-skid material like a rubber or elastomer and attached to the base 304 after being formed. The feet 322 may have a height that is considered "low profile" that allows the container 304 to be slid along one of its edges when the container 302 is tilted at an angle greater than 15 degrees relative to the surface 1 supporting the container 302 as shown in FIG. 25. Alternatively, the feet 322 may be integrally formed with the base 304.

Figure 20B:
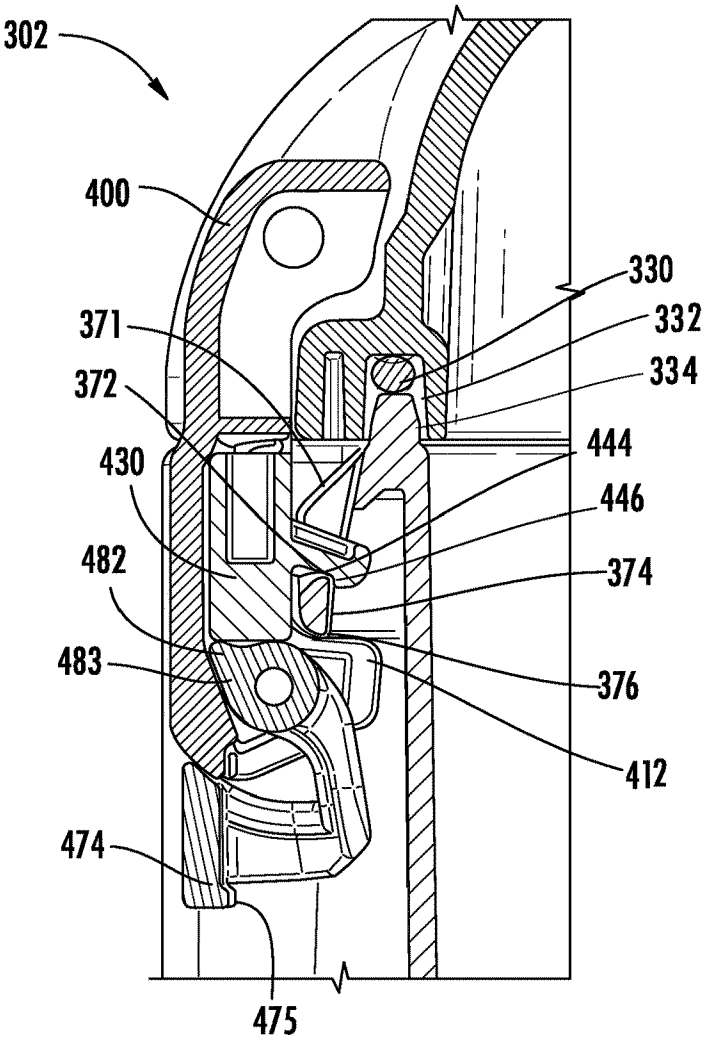
FIG. 20B illustrates a partial cross-sectional view of an alternate embodiment of the latch assembly of FIG. 20A in a locked position according to one or more aspects described herein.
Figure 20A:
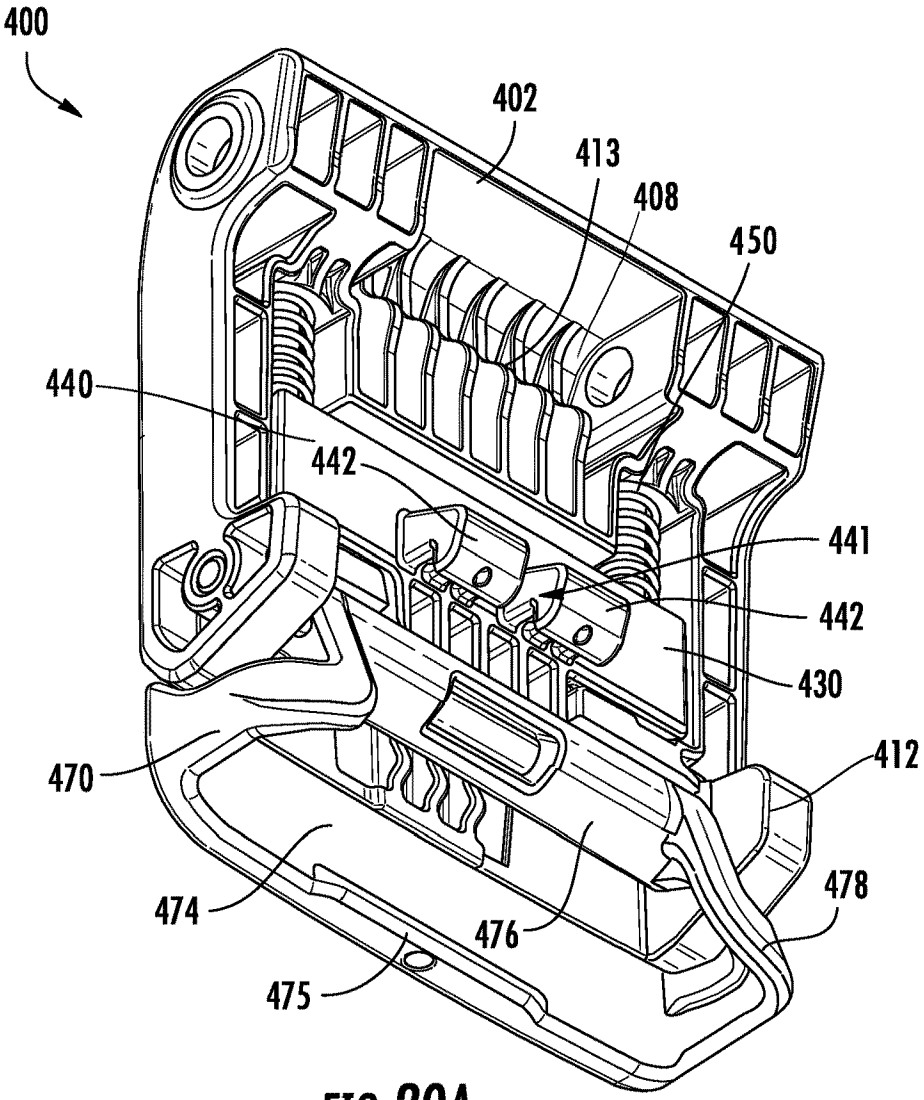
FIG. 20A illustrates a bottom rear perspective view of an alternate embodiment of a latch assembly according to one or more aspects described herein.

FIG. 20A through FIG. 21 depict an example latch assembly 400 where like reference numerals refer to the same or similar elements in latch assembly 100 but include 400 series reference numerals. Latch assembly 400 is substantially similar to latch assembly 100 and therefore similar aspects of latch assembly 100 are not discussed again herein. Latch assembly 400, as shown in FIG. 20A, may include multiple components including a latch body 402, a locking member 430, a biasing member 450, and an activating member 470. Similar to latch assembly 100 discussed above, the latch assembly 400 may include a locked position and an unlocked position.

Figure 20C:
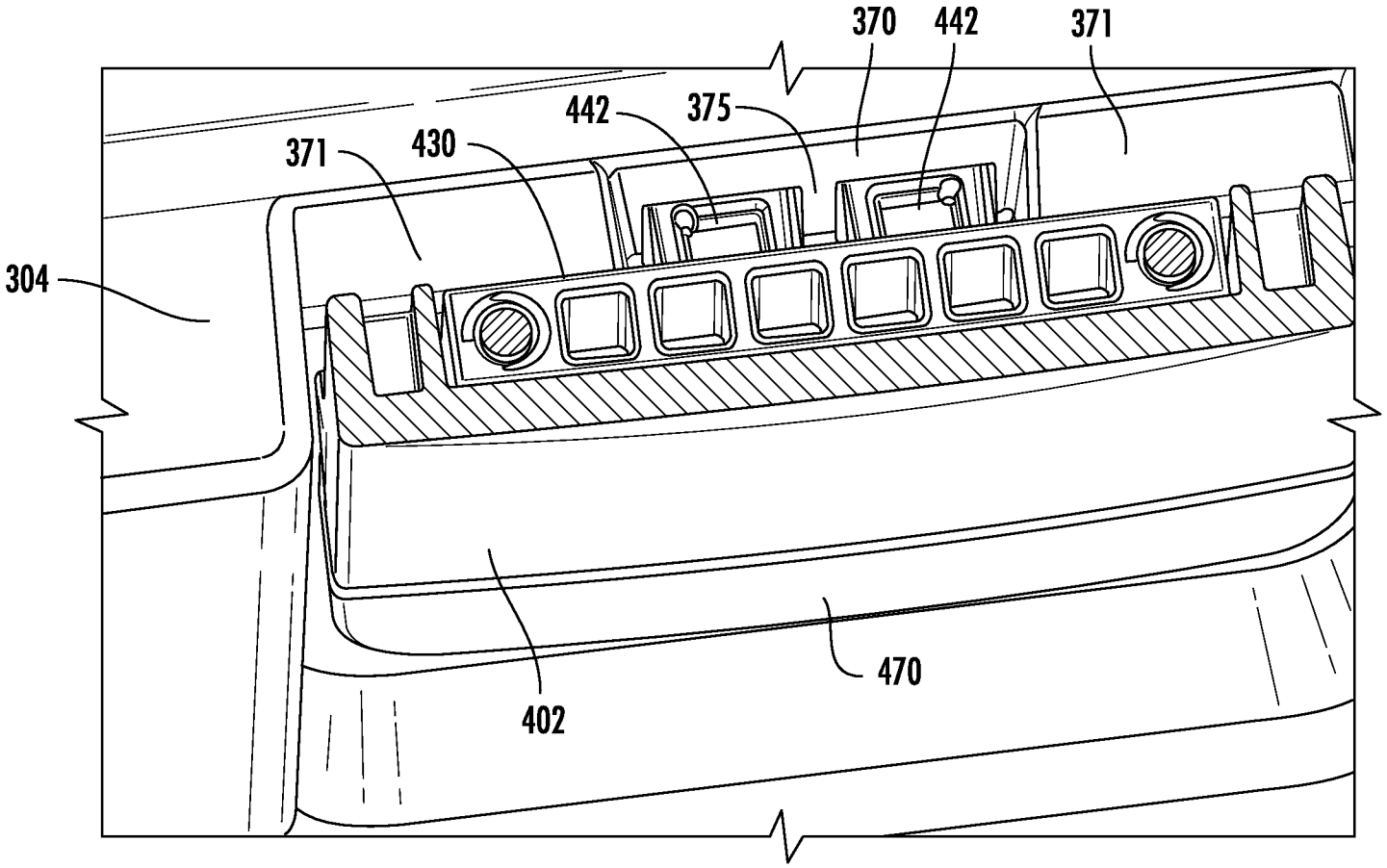
FIG. 20C illustrates a partial cross-sectional view of an alternate embodiment of a latch assembly of FIG. 20A in a locked position according to one or more aspects described herein.

The locking member 430 may include a base portion 440 and a plurality of hook portions 442 extending inward from the base portion 440. The plurality of hook portions 442 may be spaced apart from each other by a gap 441. Each hook portions 442 may each include a lower surface 444 and an inward facing surface 446. As shown in FIG. 20B, when the latch assembly 400 is in the locked position, the lower surface 444 of each hook portion 442 may engage the upper surface 372 of the latch keeper 370 and the inward facing surface 446 of each hook portion 442 may engage the inner surface 374 of the latch keeper 370. Further, the rib 375 of the latch keeper 370 may fit within the gap 441 between each of the hook portions 442 as shown in FIG. 20C. Additionally, when the latch assembly 400 is in the locked position the upper surface of the engagement lugs 412 may engage the lower surface 376 of the latch keeper 370.

The latch body 402 may include a plurality of ribs 413 along the inner surface 408 from the upper portion of the inner surface 408 towards the locking member 430. The ribs 413 may each have a contoured height such that each rib 413 has a lower height in an upper region than in the lower region as the rib extends toward the locking member 430. The ribs 413 help to strengthen the latch body 402 while reducing the overall weight of the latch assembly 400.

Similar to the latch assembly 100, the latch body 402 may also be pivotally engaged with an activating member 470.

The activating member 470 may also be engaged with the locking member 430 and may be configured to move the locking member 430 from the downward position to the upward position. The activating member 470 may be pivotally engaged to the latch body 402 by a hinge 472 extending through the latch body 402 and the activating member 470. The activating member 470 may include a grip portion 474, an activating barrel 476, and one or more arms 478 connecting the grip portion 474 and the activating barrel 476 where the activating barrel 476 may include a raised portion 482. The raised portion 482 and activating barrel 476 may be joined together along a substantially flat contact surface 483. In order to adequately support the activating barrel 476, the interior surface 408 of the latch body 402 in that region may be substantially parallel to the contact surface 483 to support the contact surface 483 and thus assist in supporting the activating barrel 476 and keep the activating member 470 from rotating backward beyond the outer surface 410 of the latch body 402. As another option the grip portion 474 may include a ridge 475 extending at least a portion of the length of the grip portion 474 to further assist a user in gripping the grip portion 474 without slipping.

As discussed above, the ramped surface 371 acts to both protect the latch assembly from getting stuck on the base 304 as well as acting to help position the latch assembly to properly engage the latch keeper 370.

Figure 26A:
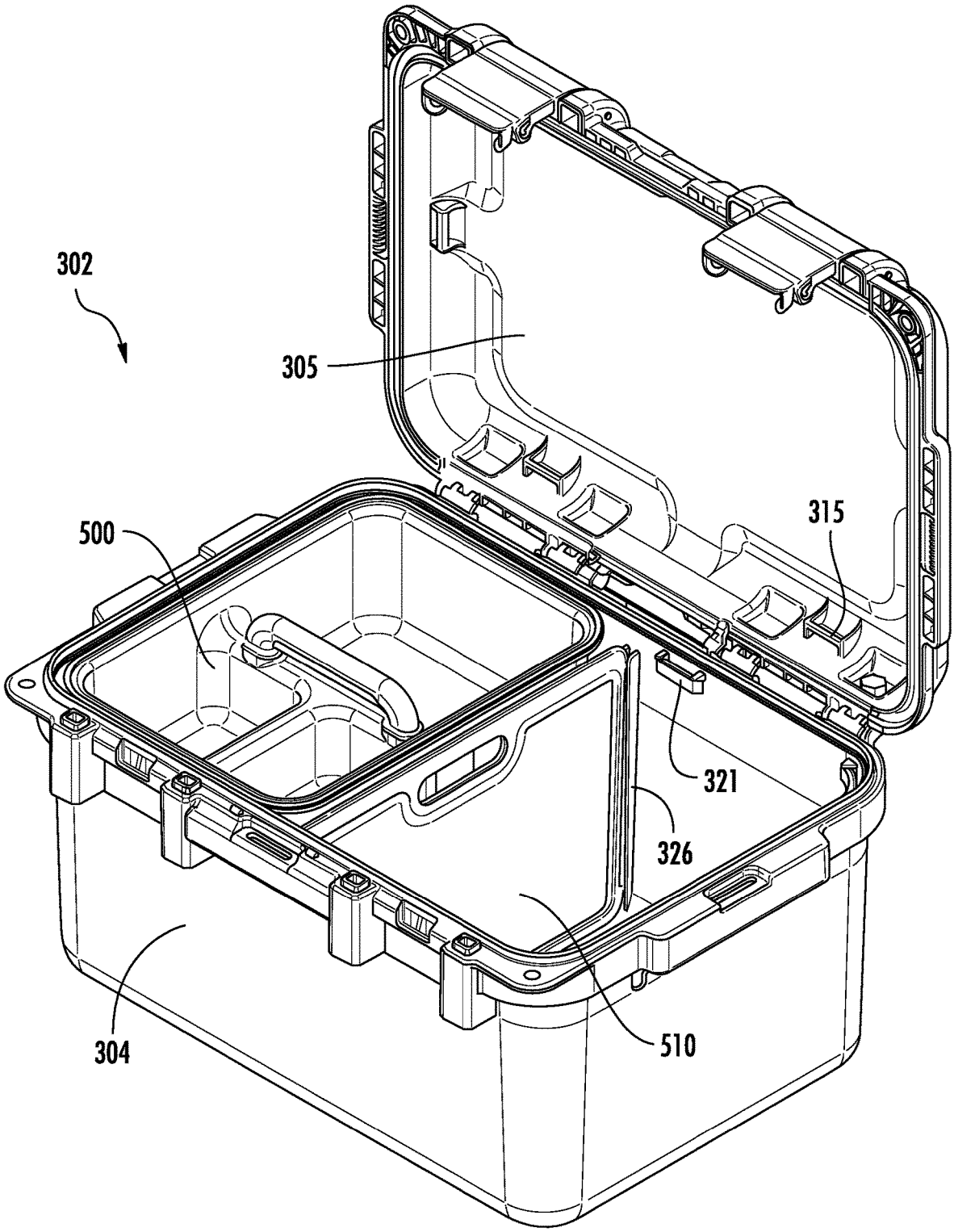
FIGS. 26A-26D illustrate a top perspective view of the container of FIG. 17A in an open position with various accessories installed according to one or more aspects described herein.
Figure 26B:
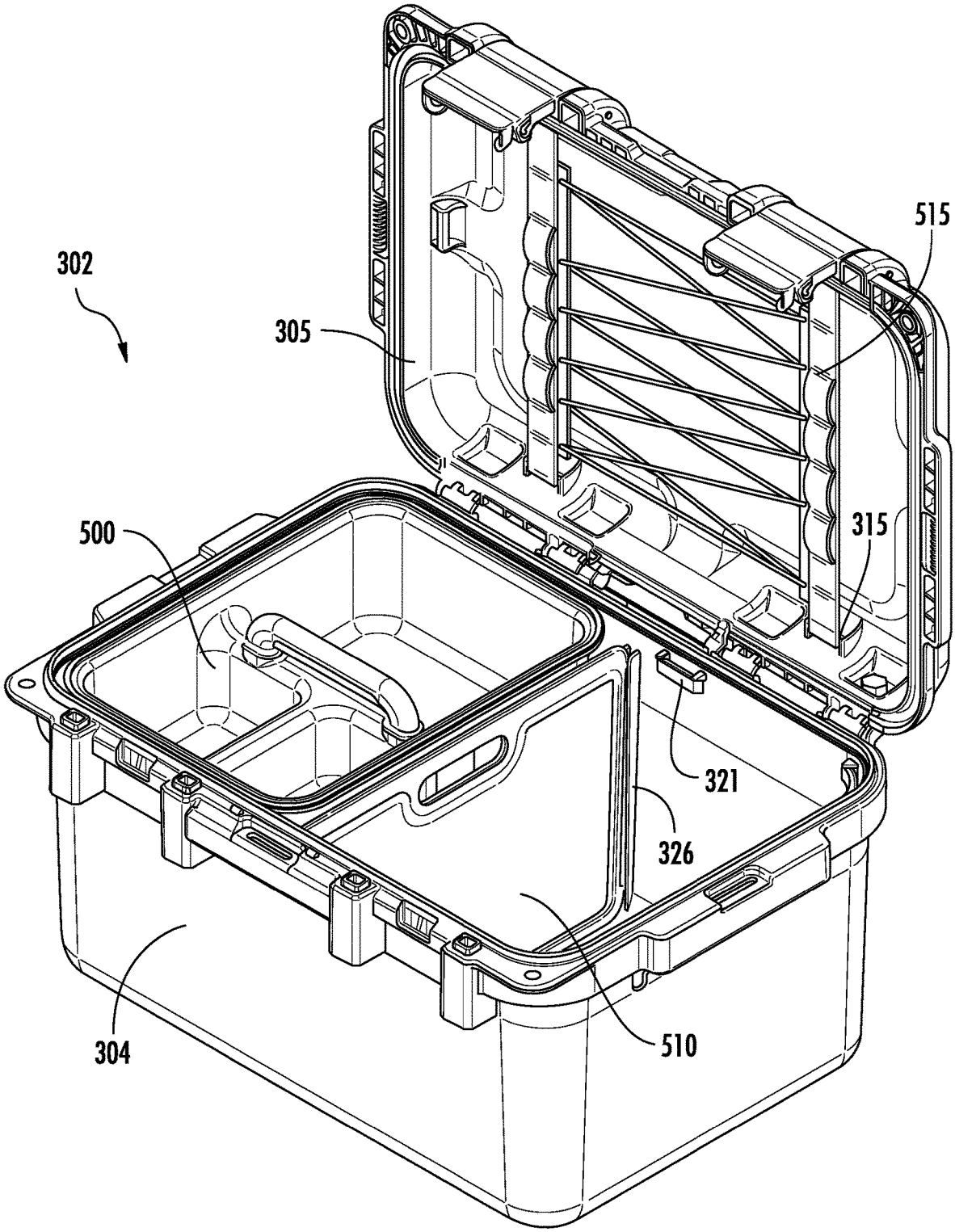
Figure 26C:
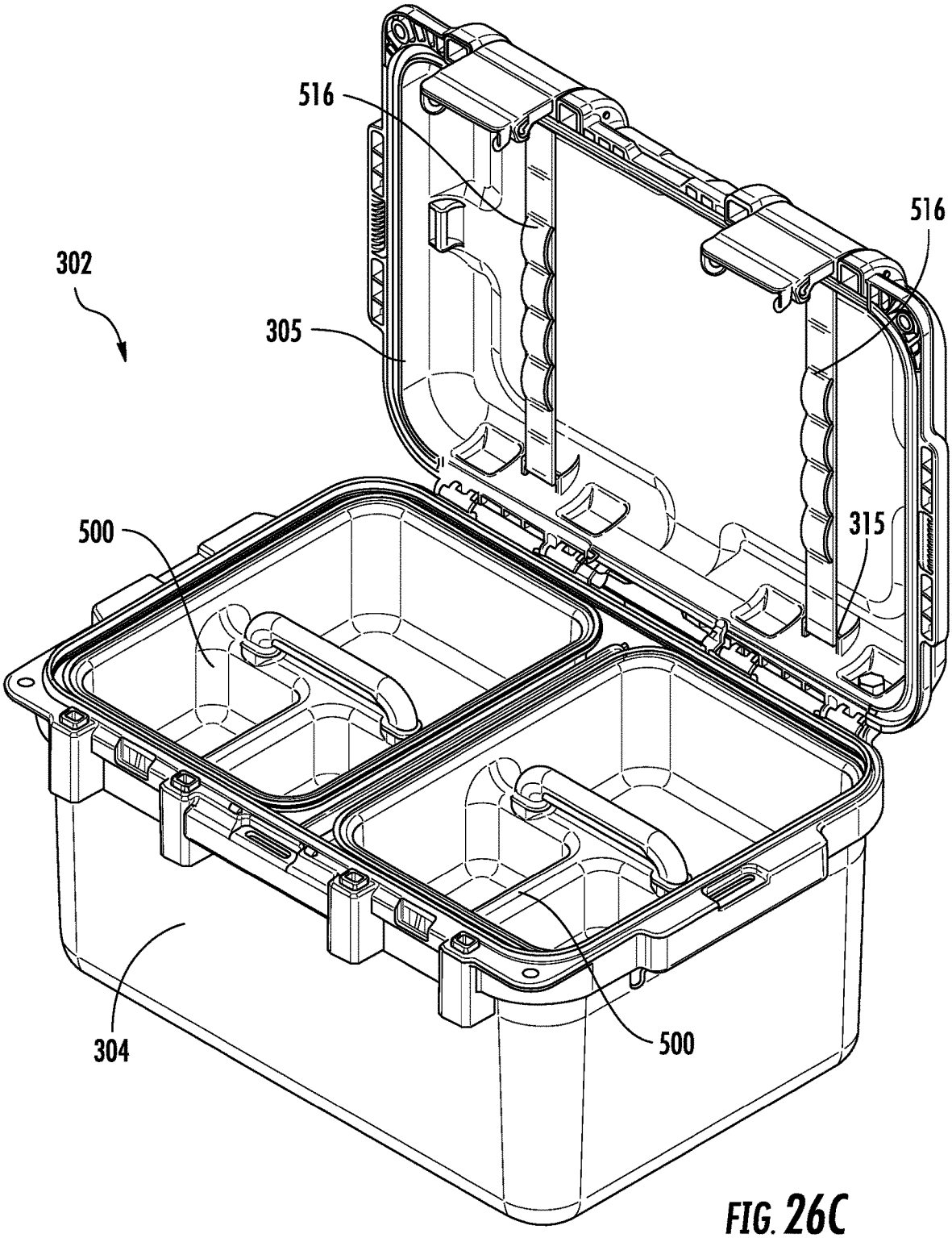
Figure 26D:
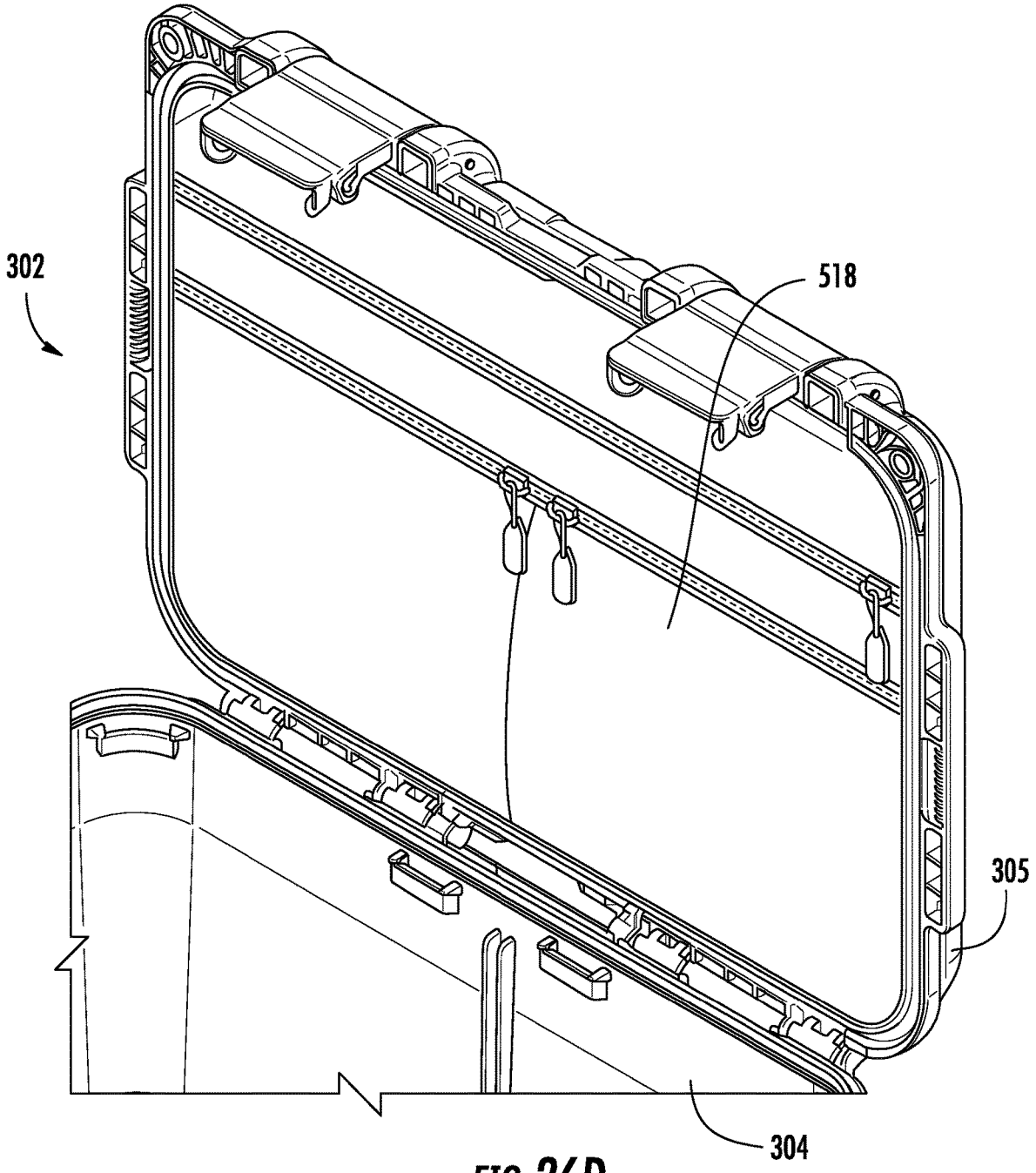

FIGS. 26A-26D illustrate the container 302 as described above that is configured with various accessories. For instance, FIG. 26A illustrates an embodiment of a storage system that includes the container 302 and a tray 500 installed where the tray 500 is supported by the plurality of tabs 321 as well as the divider wall 510 installed between the pair of tracks 326. FIG. 26B illustrates the system shown in FIG. 26A with a cargo net 515 attached to the clips 315 of the lid 305. As still another embodiment of the storage system is illustrated in FIG. 26C where the container 302 includes two trays 500 supported by the tabs 321 along with a pair of utility straps 516 connected to the clips 315 of the lid 305 to provide multiple locations for a user to attach and organize any desired items in the container 302. FIG. 26D illustrates another option where a soft sided storage bag 518 that includes a plurality of zippered storage compartments. As discussed above, by providing the multiple attachment points within the base and the lid, the container 302 may be equipped with a variety of options of accessories to provide a storage system to provide an organized storage solution for a user.

Figure 27B:
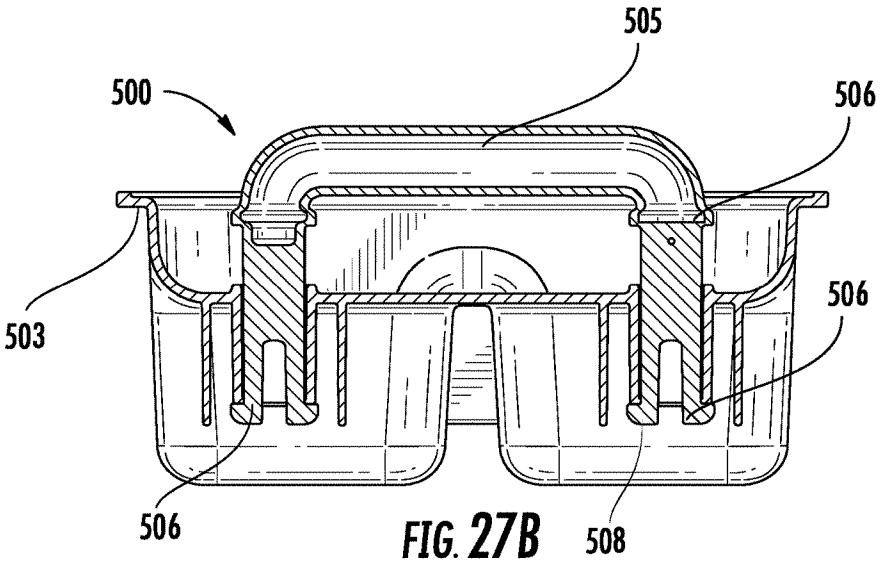
FIGS. 27B and 27C illustrate side cross-sectional views of the accessory of FIG. 27A according to one or more aspects described herein.
Figure 27C:
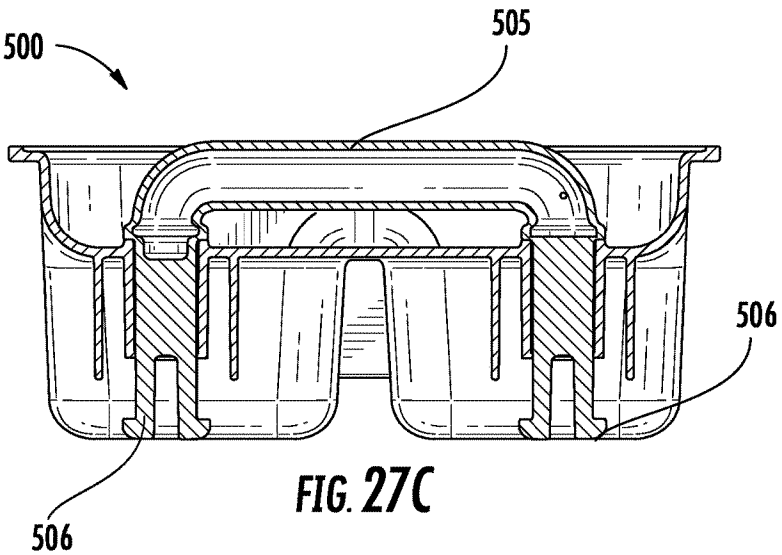
Figure 27A:
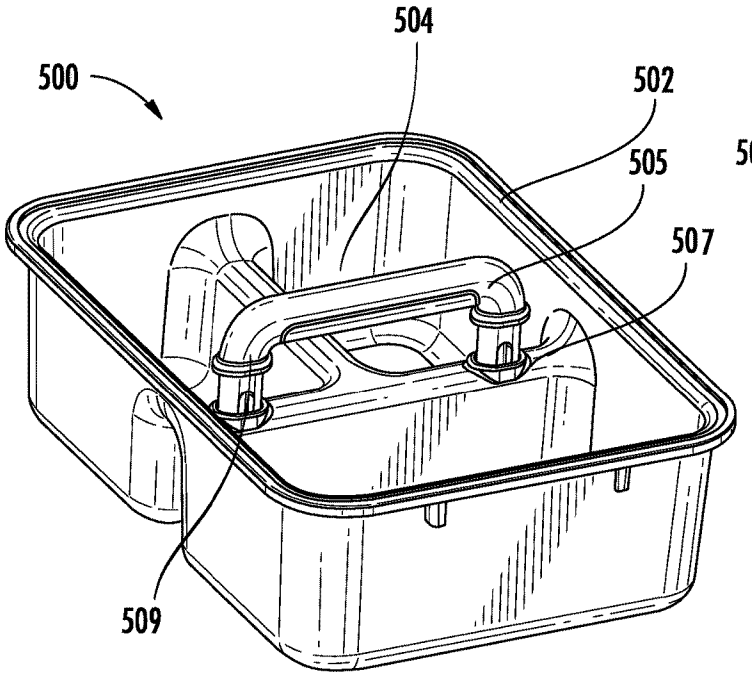
FIG. 27A illustrates a top perspective view of an accessory for the container of FIG. 17A according to one or more aspects described herein.

FIG. 27A-27C illustrate further details of the tray 500. The tray 500 may have a body 502 with a mounting surface 503 along with a plurality of storage cavities 504. The storage cavities 504 may have any size and may be configured to have any number of cavities 504. For instance, the exemplary embodiment shown in FIGS. 27A-27C comprises three cavities, where two of the cavities are smaller than the third cavity. As another feature of the tray 500, the tray 500 may include a movable handle 505. The handle 505 may move vertically from an extended position shown in FIG. 27B to a contracted or storage position shown in FIG. 27C. In the extended position, a user can easily lift the tray 500 out of the container 302 while in the contracted position, the tray 500 has a lower height profile or storage. The handle 505 may have a U-shaped tube-like structure with two ends 506 that engage into openings 507 in the body 502 of the tray. Each end 506 of the tube-like structure may have a tapered surfaces 508 that allows for installation into the openings 507 and a retaining surface 509 to keep the handle from being removed and also providing a positive stop to limit the vertical movement of the handle 505.

According to one aspect a container is disclosed. The container may include a molded base including: a sidewall structure having a first side, a second side opposite the first side, a third side extending between an edge of the first side and an edge of the second side, and a fourth side opposite the third side, the sidewall structure having a first end and a second end; a bottom portion connected to a first end of the sidewall structure and configured to support the container on a surface; and an opening formed at a second end of the sidewall structure, opposite the first end, the opening being configured to allow access to an interior void of the container formed by the sidewall structure and the bottom portion. The container may also include a latch keeper extending from the sidewall structure, the latch keeper having an upper surface, an inner surface and a lower surface; a lid, the lid pivotal between an open configuration and a closed configuration, the lid having a shape corresponding to a shape of the base and configured to cover the opening formed at the second end of the sidewall structure when the container is in the closed configuration; a hinge configured to connect the lid to the base and about which the lid is rotatable from the closed configuration to the open configuration. The container may also include a latch assembly, the latch assembly having a locked position and an unlocked position, the latch assembly comprising; a latch body pivotally engaged with the lid, the latch body having at least one engagement lug; a locking member slidably engaged with the latch body, the locking member being slidable between at least a downward position and an upward position, the locking member configured to lock the lid in the closed configuration when the locking member is in the downward position and configured to unlock the lid when the locking member is in the upward position; a biasing member engaged with the latch body and the locking member, the biasing member biasing the locking member in a downward position; and an activating member pivotally engaged with the latch body and engaged with the locking member, the activating member configured to move the locking member from the downward position to the upward position. The latch assembly may only be moved from the unlocked position to the locked position when the locking member is in the upward position. The at least one engagement lug of the latch body may engage the lower surface of latch keeper when the latch assembly is in the locked position. The lower surface of the locking member engages the upper surface of the latch keeper when the latch assembly is in the locked position.

Rotating the lid from the closed configuration to the open configuration may include rotating the lid 90° from the closed configuration. The container may contain insulation within the sidewall structure. The container may include a second latch assembly. The container may include a gasket arranged in a recess formed in at least one of the base and the lid. The container may include a channel integrally molded with an exterior surface of the base. The channel may extend around an entire exterior perimeter of the base. The container may also include at least one handle. The handle may include a first arm and a second arm, and each of the first arm and second arm may include a raised portion at a distal end of the arm.

According to another aspect a container is disclosed. The container may include a base including: a sidewall structure having at least a first side and a second side opposite the first side, the sidewall structure having a first end and a second end; a bottom portion connected to a first end of the sidewall structure and configured to support the container on a surface; an opening formed at a second end of the sidewall structure, opposite the first end, the opening being configured to allow access to an interior void of the container formed by the sidewall structure and the bottom portion; and a latch keeper extending from the sidewall structure, the latch keeper having an upper surface, an inner surface and a lower surface. The container may also include a lid, the lid pivotal between an open configuration and a closed configuration, the lid having a shape corresponding to a shape of the base and configured to cover the opening formed at the second end of the sidewall structure when the container is in the closed configuration; a hinge configured to connect the lid to the base and about which the lid is rotatable from the closed configuration to the open configuration; and a latch assembly, the latch assembly having a locked position and an unlocked position. The latch assembly may include a latch body pivotally engaged with the lid, the latch body having at least one engagement lug; a locking member engaged with the latch body, the locking member being movable between at least a downward position and an upward position, the locking member configured to lock the lid in the closed configuration when the locking member is in the downward position and configured to unlock the lid when the locking member is in the upward position; a biasing member engaged with the latch body and the locking member, the biasing member biasing the locking member in a downward position; and an activating member pivotally engaged with the latch body and engaged with the locking member, the activating member configured to move the locking member from the downward position to the upward position.

The locking member may be slidably engaged with the latch body, the locking member being slidable between the downward position and the upward position. The latch assembly may only be moved from the unlocked position to the locked position when the locking member is in the upward position. The at least one engagement lug of the latch body engages the lower surface of latch keeper when the latch assembly is in the locked position. The lower surface of the locking member may engage the upper surface of the latch keeper when the latch assembly is in the locked position. The container may also include a gasket arranged in a recess formed in at least one of the base and the lid. The container may also include a channel integrally molded with an exterior surface of the base, wherein the channel extends around the entire exterior surface of the base. The container may also include at least one handle, the handle having a first arm and a second arm, and wherein each of the first arm and second arm include a raised portion at a distal end of the arm.

According to another aspect a latch assembly for a structure is disclosed. The structure may have an open configuration and a closed configuration, the structure comprising; a first portion movable relative to a second portion; a latch keeper engaged with the first portion. The latch assembly, the latch assembly having a locked position and an unlocked position, the latch assembly may include a latch body pivotally engaged with the second portion; a locking member engaged with the latch body, the locking member being movable between at least a downward position and an upward position, the locking member configured to lock the lid in the closed configuration when the locking member is in the downward position and configured to unlock the lid when the locking member is in the upward position; and an activating member pivotally engaged with the latch body and engaged with the locking member, the activating member configured to move the locking member from the downward position to the upward position.

The latch assembly may also include a biasing member engaged with the latch body and the locking member, the biasing member biasing the locking member in a downward position. The locking member may be slidably engaged with the latch body, the locking member being slidable between the downward position and the upward position. The latch assembly may only be moved from the unlocked position to the locked position when the locking member is in the upward position.

The latch body may include an inner surface and the latch keeper may include an upper surface, an inner surface and a lower surface. The at least one engagement lug of the latch body may engage the lower surface of latch keeper when the latch assembly is in the locked position; and the lower surface of the locking member may engage the upper surface of the latch keeper when the latch assembly is in the locked position.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A container, comprising:

a molded base including:

a sidewall structure having a first side, a second side opposite the first side, a third side extending between an edge of the first side and an edge of the second side, and a fourth side opposite the third side, the sidewall structure having a first end and a second end;

a bottom portion connected to a first end of the sidewall structure and configured to support the container on a surface;

an opening formed at a second end of the sidewall structure, opposite the first end, the opening being configured to allow access to an interior void of the container formed by the sidewall structure and the bottom portion;

a latch keeper extending from the sidewall structure, the latch keeper having an upper surface, an inner surface and a lower surface;

a lid, the lid pivotal between an open configuration and a closed configuration, the lid having a shape corresponding to a shape of the base and configured to cover the opening formed at the second end of the sidewall structure when the container is in the closed configuration; and a hinge configured to connect the lid to the base and about which the lid is rotatable from the closed configuration to the open configuration; and a latch assembly, the latch assembly having a locked position and an unlocked position, the latch assembly comprising;

a latch body pivotally engaged with the lid, the latch body having at least one engagement lug;

a locking member slidably engaged with the latch body, the locking member being slidable between at least a downward position and an upward position, the locking member configured to lock the lid in the closed configuration when the locking member is in the downward position and configured to unlock the lid when the locking member is in the upward position;

a biasing member engaged with the latch body and the locking member, the biasing member biasing the locking member in a downward position; and an activating member pivotally engaged with the latch body and engaged with the locking member, the activating member configured to move the locking member from the downward position to the upward position;

wherein the latch assembly may only be moved from the unlocked position to the locked position when the locking member is in the upward position;

wherein the at least one engagement lug of the latch body engages the lower surface of latch keeper when the latch assembly is in the locked position; and wherein a hook portion of the locking member engages the upper surface of the latch keeper when the latch assembly is in the locked position.

2. The container of claim 1, wherein rotating the lid from the closed configuration to the open configuration includes rotating the lid 90° from the closed configuration.

3. The container of claim 1, wherein the latch keeper further includes a support rib that extends from an exterior surface of the base to the inner surface of the latch keeper.

4. The container of claim 3, wherein the support rib is centrally located relative to the upper surface of the latch keeper.

5. The container of claim 4, wherein the locking member comprises at least two hook portions, wherein when the latch assembly is in the locked position, the support rib is positioned between the at least two hook portions of the locking member.

6. The container of claim 1, wherein the base comprises at least one ramped surface adjacent the latch keeper, such that the ramped surface extends downwardly at an angle away from an interface surface of the base.

7. The container of claim 6, wherein the at least one ramped surface forms an angle between 30 degrees and 60 degrees relative to the interface surface of the base.

8. The container of claim 1, further including a gasket arranged in a recess formed in at least one of the base and the lid.

9. The container of claim 1, wherein the base further comprises a handle on each side of the container.

10. The container of claim 9, wherein the handle is integrally molded with the base.

11. The container of claim 10, wherein the handle has a curved profile underneath an exterior surface of the handle, and wherein the curved profile is formed by a plurality of ribs extending the sidewall structure to an interior surface of the handle.

12. A container comprising:

a base including:

a sidewall structure having at least a first side and a second side opposite the first side, the sidewall structure having a first end and a second end;

a bottom portion connected to a first end of the sidewall structure and configured to support the container on a surface; and an opening formed at a second end of the sidewall structure, opposite the first end, the opening being configured to allow access to an interior void of the container formed by the sidewall structure and the bottom portion;

a lid, the lid pivotal between an open configuration and a closed configuration, the lid having a shape corresponding to a shape of the base and configured to cover the opening formed at the second end of the sidewall structure when the container is in the closed configuration, and a latch assembly, the latch assembly having a locked position and an unlocked position, the latch assembly comprising;

a latch body pivotally engaged with the lid;

a locking member engaged with the latch body, the locking member being movable between at least a downward position and an upward position, the locking member configured to lock the lid in the closed configuration when the locking member is in the downward position and configured to unlock the lid when the locking member is in the upward position; and an activating member pivotally engaged with the latch body and engaged with the locking member, the activating member configured to move the locking member from the downward position to the upward position wherein the latch body includes at least one engagement lug, and the base includes a latch keeper that comprises an upper surface, an inner surface and a lower surface;

wherein the at least one engagement lug of the latch body engages the lower surface of latch keeper when the latch assembly is in the locked position; and wherein a lower surface of a hook portion of the locking member engages the upper surface of the latch keeper when the latch assembly is in the locked position.

13. The container of claim 12, further comprising a biasing member engaged with the latch body and the locking member, the biasing member biasing the locking member in a downward position.

14. The container of claim 12, wherein the locking member is slidably engaged with the latch body, the locking member being slidable between the downward position and the upward position.

15. The container of claim 12, wherein the latch assembly may only be moved from the unlocked position to the locked position when the locking member is in the upward position.

* * * * *